US007857430B2

(12) United States Patent
Furukawa

(10) Patent No.: US 7,857,430 B2
(45) Date of Patent: Dec. 28, 2010

(54) INK JET RECORDING HEAD AND INK JET RECORDING APPARATUS

(75) Inventor: Koji Furukawa, Shizuoka (JP)

(73) Assignee: FUJIFILM Corporation, Tokyo (JP)

( * ) Notice: Subject to any disclaimer, the term of this patent is extended or adjusted under 35 U.S.C. 154(b) by 965 days.

(21) Appl. No.: 11/714,742

(22) Filed: Mar. 7, 2007

(65) Prior Publication Data

US 2007/0211105 A1 Sep. 13, 2007

(30) Foreign Application Priority Data

Mar. 7, 2006 (JP) ..... 2006-061219
Mar. 9, 2006 (JP) ..... 2006-064629

(51) Int. Cl.
*B41J 2/05* (2006.01)

(52) U.S. Cl. ..... 347/65

(58) Field of Classification Search ..... 347/55, 347/54, 44, 47, 76, 65, 101, 102, 103, 123, 347/20, 9
See application file for complete search history.

(56) References Cited

U.S. PATENT DOCUMENTS 6,158,844 A 12/2000 Murakami et al.
2007/0002115 A1* 1/2007 Nakazawa ..... 347/102
2007/0120900 A1* 5/2007 Kosuge et al. ..... 347/76

FOREIGN PATENT DOCUMENTS

JP 10-138493 A 5/1998

* cited by examiner

*Primary Examiner*—K. Feggins
(74) *Attorney, Agent, or Firm*—Sughrue Mion, PLLC

(57) ABSTRACT

An ink jet head includes an ejecting unit for ejecting ink droplets toward a recording medium and an ejection port substrate in which ejection ports from which ink droplets are ejected are opened, in which a surface of the ejection port substrate on a side from which the ink droplets are ejected is coated with a diamond like carbon layer. Alternatively, the ink jet head includes a head substrate in which resin-made ink guides are formed, each ink guide for forming a meniscus of the ink and ejection electrodes, each for forming an electric field on a tip end of the ink guide and ejecting the ink as the ink droplets by exerting an electrostatic force onto the ink, in which the ink guide is coated with a protective layer such as the diamond like carbon layer. An ink jet recording apparatus includes the ink jet head and a moving unit for moving the ink jet head and the recording medium relatively.

12 Claims, 14 Drawing Sheets

INK JET RECORDING HEAD AND INK JET RECORDING APPARATUS

The entire contents of the document cited in this specification are herein incorporated by reference.

BACKGROUND OF THE INVENTION

The present invention relates to an ink jet head and an ink jet recording apparatus. Specifically, the present invention relates to an ink jet head for ejecting ink as ink droplets, and to an ink jet recording apparatus using the ink jet head, or the present invention relates to an electrostatic ink jet head for ejecting ink droplets by exerting an electrostatic force onto ink at a tip end of an ink guide, and to an ink jet recording apparatus using the electrostatic ink jet head.

As an ink jet recording system in which ink is ejected as ink droplets, there are an electrostatic system in which ink droplets are ejected by exerting an electrostatic force onto the ink, an electrothermal conversion system in which ink droplets are ejected by pressure of steam generated by heat of a heating element, a piezoelectric system in which ink droplets are ejected by mechanical pressure pulses generated by a piezoelectric element, and the like.

As the electrostatic ink jet recording system in which ink is ejected toward a recording medium by using the electrostatic force, for example, there is a system in which ink containing charged fine particles is used, and ink ejection is controlled by utilizing electrostatic force through application of a predetermined voltage (drive voltage) to ejection electrodes (drive electrodes) of an ink jet head in correspondence with image data to thereby record an image corresponding to the image data on a recording medium. For example, an ink jet recording apparatus disclosed in JP 10-138493 A (hereinafter, referred to as Patent Document 1) is known as an apparatus using such electrostatic ink jet recording system.

The electrostatic ink jet recording apparatus disclosed in Patent Document 1 has a configuration in which an ink guide is disposed in a through hole functioning as a nozzle for ejecting the ink, and an ejection electrode is disposed in a periphery of the through hole. The ink jet recording apparatus generates electric fields around the through holes through application of voltages to the ejection electrodes corresponding to recording data, causing the force from the electric fields act on the meniscuses of the ink formed at the tip ends of the ink guides, and ejects the ink droplets from the tip ends of the ink guides to a recording medium. The ink jet head according to the electrostatic ink jet system is capable of forming minute droplets and has a simple structure, and therefore has an advantage in that it is easy to form a multichannel structure in which a plurality of ejection ports (channels) are arrayed on one head.

FIG. 20 is a schematic configuration view of an example of the ink jet head of the electrostatic ink jet recording apparatus disclosed in Patent Document 1. In an ink jet head 300 illustrated in FIG. 20, only one ejection portion of the ink jet head disclosed in Patent Document 1 is conceptually illustrated. The ink jet head 300 comprises a head substrate 302, an ink guide 304, an insulating substrate (i.e., ejection port substrate) 306, a control electrode (i.e., ejection electrode) 308, a counter electrode 310, a DC bias voltage source 312, and a pulse voltage source 314.

The ink guide 304 is disposed on the head substrate 302, and a through hole (i.e., ejection port) 316 is opened through the insulating substrate 306 at a position corresponding to the ink guide 304. The ink guide 304 extends through the through hole 316, and a convex tip end portion 304*a* thereof protrudes above the surface of the insulating substrate 306 on a recording medium P side. The head substrate 302 and the insulating substrate 306 are arranged to have a predetermined gap therebetween to form a flow path 318 of ink Q.

The control electrode 308 is arranged in a ring shape so as to surround the through hole 316 on the surface of the insulating substrate 306 on the recording medium P side for each ejection portion. The control electrode 308 is connected to the pulse voltage source 314 which generates a pulse voltage according to the image data, and the pulse voltage source 314 is grounded through the DC bias voltage source 312.

The counter electrode 310 is arranged at a position opposing the tip end portion 304*a* of the ink guide 304, and is grounded. The recording medium P is disposed on the surface of the counter electrode 310 on the ink guide 304 side. That is, the counter electrode 310 functions as a platen for supporting the recording medium P.

Upon recording, the ink Q containing fine particles (colorant particles) charged to the same polarity as that of the voltage to be applied to the control electrode 308 is circulated by a not shown ink circulation mechanism in a direction from the right side to the left side in the ink flow path 318 in FIG. 20. Further, a high voltage of, for example, 1.5 kV is always applied to the control electrode 308 by the DC bias voltage source 312. At this time, a part of the ink Q in the ink flow path 318 passes through the through hole 316 in the insulating substrate 306 due to a capillary phenomenon or the like, and is concentrated at the tip end portion 304*a* of the ink guide 304.

When the pulse voltage source 314 supplies the control electrode 308 biased to 1.5 kV by the bias voltage source 312 with a pulse voltage of, for example, 0V, the voltage of 1.5 kV obtained by superimposition of the pulse voltage on the bias voltage is applied to the control electrode 308. In this state, the electric field strength near the tip end portion 304*a* of the ink guide 304 is relatively low, so that the ink Q containing colorant particles which are concentrated at the tip end portion 304*a* of the ink guide 304 is not ejected from the tip end portion 304*a* of the ink guide 304.

On the other hand, when the pulse voltage source 314 supplies a pulse voltage of, for example, 500V, to the control electrode 308 which is biased to 1.5 kV, the voltage of 2 kV obtained by superimposition of the pulse voltage on the bias voltage is applied to the control electrode 308. Consequently, the ink Q containing colorant particles which are concentrated at the tip end portion 304*a* of the ink guide 304 is ejected as ink droplets R from the tip end portion 304*a* due to the electrostatic force, and is attracted to the grounded counter electrode 310 to adhere to the recording medium P, thereby forming dots of colorant particles.

In this way, recording is performed with dots of colorant particles while relatively moving the ink jet head 300 and the recording medium P supported on the counter electrode 310, thereby recording an image corresponding to the image data on the recording medium P.

SUMMARY OF THE INVENTION

In the recording apparatus which uses the ink jet recording system in which ink droplets are ejected from the ejection port (i.e., through hole) 316, specially, the electrostatic ink jet recording system, it is necessary to maintain the ink meniscus formed at the ejection port with stability in order to stably eject the ink. As a method for maintaining the meniscus with stability, it is possible to implement an ink repellent treatment by forming an ink repellent layer made of fluorocarbon resin on the surface of the substrate in which the ejection port is formed. However, physical strength of the ink repellent layer as described above is weak, and there is a problem in that, for example, when maintenance is performed for the surface on the ink ejection side by rubbing the surface by means of a soft brush in order to prevent ink clogging of the nozzle, the resin-made ink repellent layer is peeled off, and the ink cannot be stably ejected from the ejection port.

Further, in the ink jet head having a structure in which the ink guide is disposed in the through hole functioning as the nozzle for ejecting the ink, it is possible to perform the maintenance for the surface of the nozzle on the ink ejection side by rubbing the surface by a soft brush in order to prevent the nozzle from being clogged with the ink. However, since the ink guide is extremely minute, the brush may come in contact with the ink guide when the surface of the nozzle on the ink ejection side is rubbed by the brush and the tip end of the ink guide may be deformed. When the ink guide is deformed, it becomes impossible to precisely eject the ink, thereby making it impossible to form the image with high precision. In particular, there is a problem in that, since the ink guide formed of a resin material is insufficient in strength, the ink guide is prone to be deformed by the contact with the brush.

The present invention has been made to solve the above-mentioned problems according to the conventional technique. It is a first object of the present invention to provide an ink jet head capable of maintaining high ink repellency for a long period of time even in a case of repeatedly performing a maintenance such as brushing of an ink ejection surface, and capable of stably ejecting ink by maintaining an ink meniscus formed at an ejection port with stability, and to provide an ink jet recording apparatus including the ink jet head.

Further, it is a second object of the present invention to provide an ink jet head including a rigid ink guide that is less subject to deformation even in a case where the ink guide comes in contact with a brush at the time of the maintenance, and to provide an ink jet recording apparatus including the ink jet head.

In order to achieve the above-mentioned first object, according to a first aspect of the present invention, there is provided an ink jet head for ejecting ink droplets toward a recording medium, including: an ejection port substrate in which ejection ports from which ink droplets are ejected are opened; and ejecting means for ejecting the ink droplets from the ejection ports of the ejection port substrate toward the recording medium, respectively, wherein a surface of the ejection port substrate on a side from which the ink droplets are ejected is coated with a diamond like carbon layer.

In the ink jet head according to the first aspect of the present invention, it is preferable that the diamond like carbon layer contain fluorine.

Further, it is preferable that the ejecting means include: ejection electrodes, each formed so as to surround an ejection port on a surface opposite to the side of the ejection port substrate from which the ink droplets are ejected; and ink guides, each for forming a meniscus of the ink at a tip end thereof, in which the tip end is provided to penetrate the ejection port so as to protrude from the surface of the ejection port substrate on the side from which the ink droplets are ejected, wherein the ink droplet is ejected from the tip end of the ink guide by using an electrostatic force exerted onto the meniscus by a voltage application to the ejection electrode.

Further, it is preferable that the ink guides be coated with a protective layer.

Further, it is preferable that the protective layer be composed substantially of diamond like carbon.

Further, according to a second aspect of the present invention, there is provided an ink jet recording apparatus, including: an ink jet head having ejecting means for ejecting ink droplets toward a recording medium and an ejection port substrate in which ejection ports from which ink droplets are ejected are opened, in which a surface of the ejection port substrate on a side from which the ink droplets are ejected is coated with a diamond like carbon layer; and moving means for moving at least one of the ink jet head and the recording medium so that the recording medium can move relatively to the ink jet head, wherein an image corresponding to image data is recorded on the recording medium by means of the ink jet head.

Further, in order to achieve the above-mentioned second object, according to a third aspect of the present invention, there is provided an ink jet head for ejecting ink as ink droplets by exerting an electrostatic force onto the ink, including: a head substrate in which resin-made ink guides are formed, each ink guide for forming a meniscus of the ink; and ejection electrodes, each for forming an electric field on a tip end of the ink guide, wherein the ink guide is coated with a protective layer.

In this case, it is preferable that the ink guide have an elongated shape. Further, it is preferable that a plurality of the ink guides be formed on the head substrate.

It is preferable that the protective layer be composed substantially of diamond like carbon, and a thickness of the protective layer be within a range of from 0.1 μm to 5 μm.

Further, it is preferable that the ink jet head further include an ejection port substrate that is disposed opposite to the head substrate and in which ejection ports for ejecting the ink droplets are opened, wherein the tip end of each ink guide is inserted into each ejection port. In this case, it is preferable that the ejection electrode be disposed so as to surround the ejection port on a surface of the ejection port substrate on a side opposite to the head substrate.

Further, it is preferable that a surface of the ejection port substrate on a side from which the droplet is ejected be coated with a diamond like carbon layer.

Further, it is preferable that the diamond like carbon layer contain fluorine.

Further, according to a fourth aspect of the present invention, there is provided an ink jet recording apparatus, including: an ink jet head having a head substrate in which resin-made ink guides are formed, each ink guide for forming a meniscus of ink, and ejection electrodes, each for forming an electric field on a tip end of said ink guide and ejecting the ink as ink droplets by exerting an electrostatic force onto the ink, in which said ink guide is coated with a protective layer; and moving means for moving at least one of said ink jet head and said recording medium so that said recording medium can move relatively to said ink jet head, wherein an image corresponding to image data is recorded on the recording medium by means of the ink jet head.

In the ink jet head of the first aspect of the present invention, the ejection port for ejecting the ink droplet is formed in the ejection port substrate, and the surface of the ejection port substrate on the side from which the ink droplet is ejected is coated with the diamond like carbon layer. Accordingly, even in the case of repeating the maintenance such as the brushing for the ink ejection surface, the high ink repellency can be maintained for a long period of time. Therefore, the meniscus of the ink, which is formed in the ejection port, is stably maintained, thereby making it possible to stably eject the droplets of the ink.

Further, the ink jet recording apparatus of the second aspect of the present invention includes the ink jet head of the first aspect of the present invention. Accordingly, the ink jet recording apparatus can stably eject the droplets of the ink from the ink jet head toward the recording medium for a long period of time. Therefore, the ink jet recording apparatus of the second aspect of the present invention can stably record high-quality images on the recording media for a long period of time.

Further, in the ink jet head of the third aspect of the present invention and the ink jet recording apparatus of the fourth aspect of the present invention which includes the ink jet head, the resin-made ink guide for forming the meniscus of the ink is coated with the protective layer, and the strength of the ink guide is thereby enhanced. Accordingly, the ink guide is not deformed even in the case of contacting the soft brush or the like at the time of the maintenance, thereby making it possible to stably record the high-quality images on the recording media for a long period of time.

DESCRIPTION OF THE PREFERRED EMBODIMENTS

Hereinafter, an ink jet head and an ink jet recording apparatus of the present invention will be described in detail based on preferred embodiments illustrated in the accompanying drawings.

First, an ink jet head of the first aspect of the present invention and an ink jet recording apparatus of the second aspect of the present invention will be explained referring to FIGS. 1A to 9B.

Figure 1A:
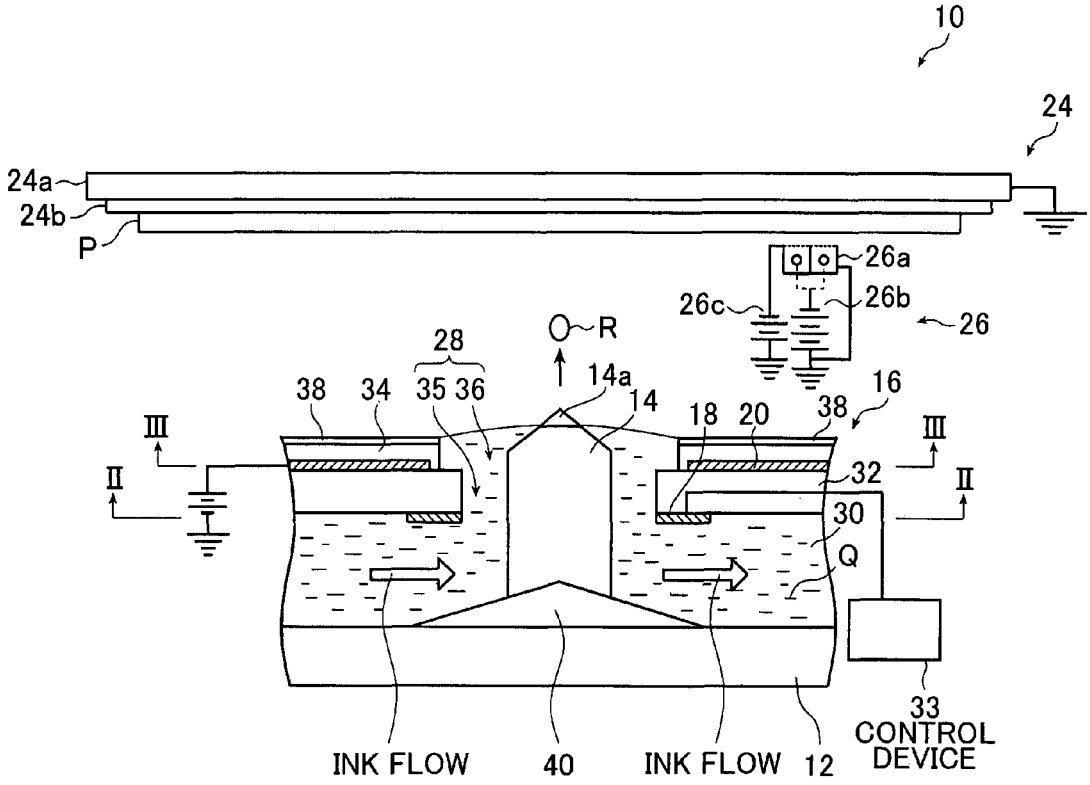
FIG. 1A is a schematic view showing a schematic configuration of an embodiment of an ink jet head of the present invention.
Figure 1B:
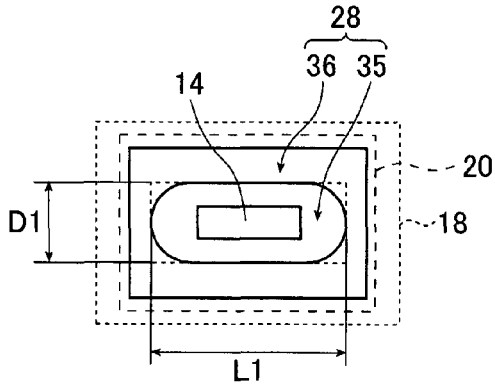
FIG. 1B is a top view of an ejection port substrate of the ink jet head shown in FIG. 1A.

FIG. 1A schematically shows a cross section of an outlined configuration of the ink jet head according to the first aspect of the present invention, and FIG. 1B shows a top view of an ejection port substrate 16 shown in FIG. 1A. As shown in FIG. 1A, an ink jet head 10 comprises a head substrate 12, ink guides 14, and the ejection port substrate 16 in which ejection ports 28 are formed. Ejection electrodes 18 are disposed on the ejection port substrate 16 so as to surround the respective ejection ports 28. At a position facing the surface of the ink jet head 10 on an ink ejection side (i.e., upper surface in FIG. 1A), a counter electrode 24 supporting a recording medium P and a charging unit 26 for charging the recording medium P are disposed.

The head substrate 12 and the ejection port substrate 16 are disposed so that they face each other with a predetermined distance therebetween. By a space formed between the head substrate 12 and the ejection port substrate 16, an ink flow path 30 for supplying ink to each ejection port 28 is formed. The ink in the ink flow path 30 generates a unidirectional ink flow (i.e., ink flow in an arrow direction in FIG. 1A) with a predetermined speed by an ink circulation device (i.e., ink circulation means) to be described later.

Figure 2:
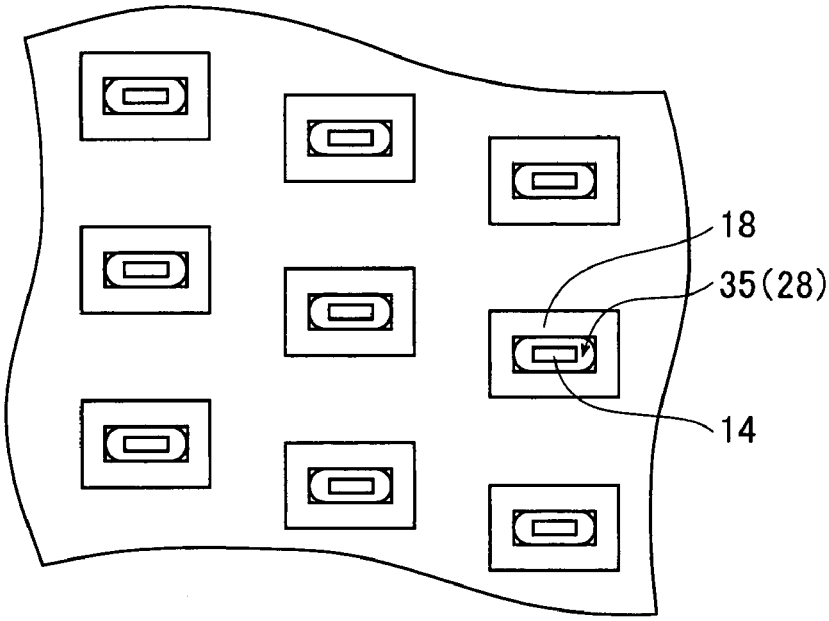
FIG. 2 is a view schematically showing an embodiment in which a plurality of ejection ports are two-dimensionally arrayed in the ejection port substrate of the ink jet head shown in FIG. 1A.

In order to perform image recording at a higher density and at high speed, the ink jet head 10 has a multichannel structure in which multiple ejection ports (i.e., nozzles) 28 are arranged in a two-dimensional manner. FIG. 2 schematically shows a state in which multiple ejection ports 28 are two-dimensionally arranged in the ejection port substrate 16 of the ink jet head 10. In FIGS. 1A and 1B, for easy-to-understand illustration of the configuration of the ink jet head 10, only one of the multiple ejection ports in the ink jet head 10 is shown.

In the present invention, it is possible to freely choose the number of the ejection ports 28 in the ink jet head 10, the physical arrangement position thereof and the like. For example, the structure may be the multichannel structure shown in FIG. 2 or a structure having only one line of the ejection ports. The ink jet head 10 may be a so-called (full-) line head having lines of ejection ports corresponding to the whole area of the recording medium P or a so-called serial head (i.e., shuttle type head) which performs scanning in a direction perpendicular to the nozzle line direction. The ink jet head 10 can cope with both of a monochrome recording apparatus and a color recording apparatus.

It should be noted here that FIG. 2 shows an arrangement of the ejection ports 28 in a part (three rows and three columns) of the multichannel structure and, as a preferable embodiment, the ejection ports 28 on a column on a downstream side in an ink flow direction are disposed so that they are displaced from the ejection ports on a column on an upstream side in the ink flow direction by a predetermined pitch in a direction perpendicular to the ink flow. By disposing the ejection ports on the column on the downstream side in the ink flow direction in this manner, it becomes possible to favorably supply ink to the ejection ports. In the ink jet head according to the present invention, a structure may be used in which an ejection port matrix with n rows and m columns (n and m are each a positive integer), in which ejection ports on a column on the downstream side are disposed so that they are displaced from ejection ports on a column on the upstream side in the direction perpendicular to the ink flow direction, is repeatedly provided in a constant cycle in the ink flow direction, or a structure may be used instead in which the ejection ports are disposed so that they are successively displaced from ejection ports, which are positioned on the upstream side, in one direction (i.e., downward direction or upward direction in FIG. 2) perpendicular to the ink flow. It is possible to appropriately set the number, pitch, and repetition cycle of the ejection ports and the like in accordance with a resolution and a feeding pitch.

Also, in FIG. 2, as a preferable embodiment, the ejection ports on the column on the downstream side in the ink flow direction are disposed so that they are displaced from the ejection ports on the column on the upstream side in the direction perpendicular to the ink flow, however, the present invention is not limited to this, and the ejection ports on the downstream side and the ejection ports on the upstream side may be disposed on the same straight line in the ink flow direction. In this case, in view of capability of supplying ink, it is preferable that ejection ports on each row be displaced in the ink flow direction from ejection ports of adjacent row.

It is possible to appropriately set the arrangement pattern of the ejection ports in accordance with the structure of each ejection portion (e.g., shapes of the ejection port, ink guide, and ejection electrode), the drive system of each ejection portion (e.g., thermal type, and piezoelectric type). The arrangement pattern can also be appropriately set in accordance with the scanning system of the ink jet head 10 and/or the recording medium P.

In the ink jet head 10, for example, the ink Q is used in which fine particles containing colorant such as pigment, and having electrical charges (hereinafter referred to as the "colorant particles") are dispersed in an insulative liquid (carrier liquid). Also, an electric field is generated between the ejection port 28, the ink guide 14, and the counter electrode 24 through application of a drive voltage to the ejection electrodes 18 provided in the ejection port substrate 16, and the ink at the ejection port 28 is ejected by means of electrostatic force. Further, by turning ON/OFF the drive voltage applied to the ejection electrode 18 in accordance with image data (ejection ON/OFF), ink droplets are ejected from the ejection port 28 in accordance with the image data and an image is recorded on the recording medium P.

The configuration of the ink jet recording head 10 of the first aspect of the present invention which is used in the ink jet recording apparatus of the second aspect of the present invention will be explained in detail referring to FIGS. 1A and 1B.

First, the ejection port substrate 16 constituting the ink jet head 10 will be explained.

As shown in FIG. 1A, the ejection port substrate 16 of the ink jet head 10 comprises an insulating substrate 32, a shield electrode 20, and an insulating layer 34. On the surface on the upper side in FIG. 1A (i.e., surface opposite to a side facing the head substrate 12) of the insulating substrate 32, the shield electrode 20 and the insulating layer 34 are laminated in order.

The ejection electrodes 18 are formed on the surface on the lower side in FIG. 1A (i.e., surface on the side opposing the head substrate 12) of the insulating substrate 32.

In the ejection port substrate 16, the ejection ports 28 are formed. The ejection ports 28 extend through the ejection port substrate 16 to be connected to the ink flow path 30, whereby the ink droplets R are ejected therefrom. In the ink jet head 10 shown in FIG. 1A, the ejection port 28 includes an opening (hereinafter, referred to as "inner opening") 35 positioned at the inner side of the ink jet head and an opening (hereinafter, referred to as "outer opening") 36 formed to extend through the insulating layer 34.

As shown in FIG. 1B, the inner opening 35 is a cocoon shaped opening (slit) elongated in the ink flow direction, which is obtained by connecting a semicircle to each short side of a rectangle. More specifically, the inner opening 35 has a noncircular shape in which an aspect ratio (L1/D1) between a length L1 in the ink flow direction and a length D1 in a direction orthogonal to the ink flow is 1 or more. The inner wall of the inner opening 35 has a surface parallel to a thickness direction of the ejection port substrate 16, that is, the cross sectional shape of the inner opening 35 taken along the plane orthogonal to the thickness direction of the ejection port substrate 16 does not change along the thickness direction.

As shown in FIG. 1B, the outer opening 36 is a rectangular shaped opening (slit) having an opening area larger than that of the inner opening 35. The inner wall of the outer opening 36 also has a surface parallel to the thickness direction of the ejection port substrate 16, that is, the cross sectional shape of the outer opening 36 taken along the plane orthogonal to the thickness direction of the ejection port substrate 16 also does not change along the thickness direction.

As above, the ejection port 28 has a shape in which the inner opening 35 and the outer opening 36 having different opening areas are connected to each other. The inner opening 35 and the outer opening 36 are connected in the thickness direction of the ejection port substrate 16 with their centers coaxial. In the illustrated embodiment, the outer opening 36 is formed such that the opening area thereof is larger than that of the inner opening 35. With the structure of the opening 28 in which the opening area of the outer opening 36 which is open on the ink droplet ejecting side is larger than that of the inner opening 35 which is open on the side of the ink flow path 30, it is possible to prevent deterioration (i.e., degradation) of the ink ejection cutoff property, e.g., prevent that ink is ejected even after the end of a drive voltage application, and improve the ejection responsivity. This point will be explained later in detail together with the ink droplet ejection action.

In this embodiment, as a preferable embodiment, the opening on the ink flow path 30 side of the ejection port 28, i.e., the inner opening 35, is formed such that the aspect ratio (L1/D1) between the length L1 in the ink flow direction and the length D1 in the direction orthogonal to the ink flow is 1 or more, so that the ink becomes easy to flow to the ejection port 28. That is, capability of supplying ink particles to the ejection port 28 is enhanced, which makes it possible to improve frequency responsivity and also prevent clogging. This point will be explained later in detail together with the ink droplet ejection action.

In this embodiment, the inner opening 35 is formed in the elongated cocoon-shaped opening, however, the present invention is not limited to this and it is possible to form the inner opening 35 in any other shape, such as a circular shape or a noncircular shape, so long as it is possible to eject ink from the ejection port 28. Specially, examples of the noncircular shape include any arbitrary shape such as an oval shape, a rectangular shape, a rhomboid shape, and a parallelogram shape, so long as the aspect ratio between the maximum length (that is, major axis) in a length direction of the opening (i.e., longitudinal direction) and the minimum length (that is, minor axis) in a direction orthogonal to the length direction is 1 or more. For instance, the inner opening 35 may be formed in a rectangular shape whose long sides extend in the ink flow direction, or an oval shape or a rhomboid shape whose major axis extends in the ink flow direction. Also, the inner opening 35 may be formed in a trapezoidal shape with its upper base being on the upstream side of the ink flow, its lower base being on the downstream side, and its height in the ink flow direction being set longer than the lower base. In this case, it does not matter whether the side on the upstream side is longer than the side on the downstream side or the side on the downstream side is longer than the side on the upstream side. Further, a shape may be formed in which to each short side of a rectangle whose long sides extend in the ink flow direction, a circle whose diameter is longer than the short side of the rectangle is connected. Also, the inner opening 35 may be formed so that the upstream side and the downstream side are symmetric or asymmetric with respect to the center thereof. For example, at least one of end portions on the upstream side and the downstream side of the rectangular ejection port may be formed in a semicircular shape to obtain the inner opening.

As shown in a dotted line in FIG. 1B, under the lower surface (i.e., surface facing the head substrate 12) of the insulating substrate 32, the ejection electrode 18 is formed. The ejection electrode 18 is arranged along the rim of the inner opening 35 so as to surround the periphery of the cocoon-shaped inner opening 35. In FIG. 1B, the ejection electrode 18 is formed to surround the inner opening 35, however, it is possible to change the shape of the ejection electrode 18 to various other shapes so long as the ejection electrode is disposed to face the ink guide. For example, the ejection electrode 18 may be a ring shaped circular electrode, an oval electrode, a divided circular electrode, a parallel electrode, or a substantially parallel electrode, corresponding to the shape of the inner opening 35. Further, the ejection electrode 18 may be formed in a reversed C-letter shape in which one side of a rectangle on the upstream side in the ink flow direction is removed.

As described above, the ink jet head 10 has a multichannel structure in which multiple ejection ports 28 are arranged in a two-dimensional manner. Therefore, as schematically shown in FIG. 2, the ejection electrodes 18 are respectively disposed for the ejection ports 28 in a two-dimensional manner.

The ejection electrodes 18 are exposed to the ink flow path 30 and in contact with the ink Q flowing in the ink flow path 30. Thus, it becomes possible to significantly improve ejecting property of ink droplets. This point will be described in detail later together with the ink droplet ejection action. However, the ejection electrodes 18 are not necessarily required to be exposed to the ink flow path 30 and in contact with the ink. For instance, the ejection electrodes 18 may be formed in the ejection port substrate 16 or the surfaces of the ejection electrodes 18 exposed to the ink flow path 30 may be covered with a thin insulating layer.

As shown in FIG. 1A, each ejection electrode 18 is connected to a control device 33 which is capable of controlling a voltage applied to the ejection electrodes 18 at the time of ejection and non-ejection of the ink.

Figure 3:
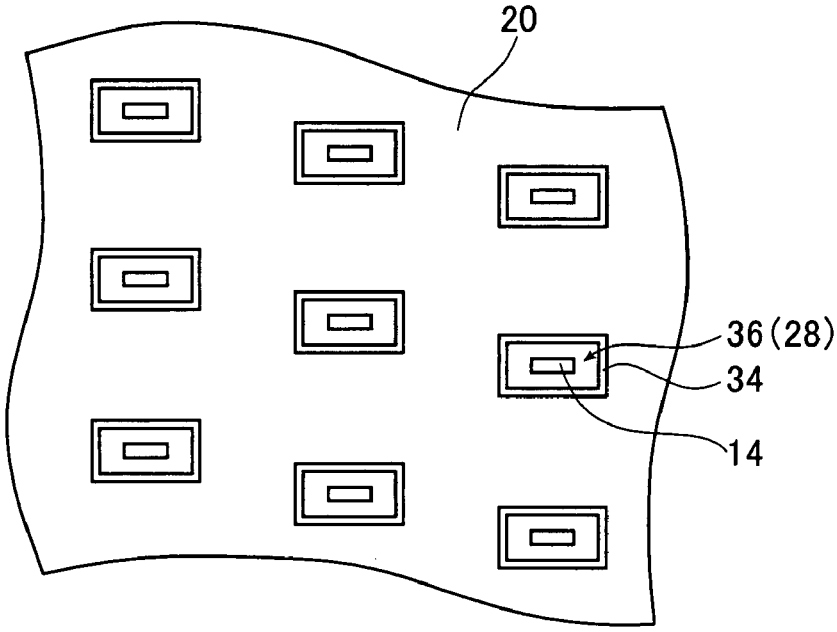
FIG. 3 is a cross-sectional view taken along line III-III of FIG. 1A, and schematically shows a planar structure of an embodiment of a shield electrode of the ink jet head with a multichannel structure shown in FIG. 2.

The shield electrode 20 is formed on the surface (i.e., upper surface) of the insulating substrate 32 which is opposite to the surface on which the ejection electrodes 18 are formed, and the surface of the shield electrode 20 is covered with the insulating layer 34. In FIG. 3, a planar structure of the shield electrode 20 is schematically shown. FIG. 3 is a cross sectional view taken along line III-III in FIG. 1A and schematically shows the planar structure of the shield electrode 20 of the ink jet head having the multichannel structure. As shown in FIG. 3, the shield electrode 20 is a sheet-shaped electrode, such as a metallic plate, which is common to each ejection electrode and has openings at positions corresponding to the ejection electrodes 18 respectively formed on the peripheries of the inner openings 35 arranged in a two-dimensional manner. Each opening of the shield electrode 20 is formed in a rectangular shape so that it has a length and a width exceeding the length and the width of the outer opening 36.

It is possible for the shield electrode 20 to suppress electric field interference by shielding against electric lines of force between adjacent ejection electrodes 18, and a predetermined voltage (including 0 v when grounded) is applied to the shield electrode 20.

As a preferred embodiment, as shown in FIG. 1A, the shield electrode 20 is formed in the layer different from that containing the ejection electrodes 18, and moreover, its whole surface is covered with the insulating layer 34.

The ink jet head 10 having such shield electrode 20 is capable of suitably preventing the electric field interference between adjacent ejection electrodes 18. Moreover, the insulating layer 34 is formed so as to cover the shield electrode 20, so discharging between the ejection electrode 18 and the shield electrode 20 can also be prevented even when the colorant particles of the ink Q are formed into a coating.

Suitable examples of the material forming the insulating layer 34 to be used include polyimide, epoxy, fluorocarbon resin, phenolic resin, and the like, and polyimide is preferably used in view of high insulating properties and heat resistance properties.

There is no limit to the thickness of the insulating layer, however, for making the ejection port substrate 16 thin while maintaining the insulating properties, the thickness of the insulating layer is preferably 10 μm to 100 μm.

The shield electrode 20 needs to be provided so as to block the electric lines of force of the ejection electrodes 18 provided on other ejection ports 28 (hereinafter referred to as "other channels") and the electric lines of force directed to the other channels while ensuring the electric lines of force acting on the corresponding ejection port 28 (hereinafter referred to as "own channel" for convenience) among the electric lines of force generated from the ejection electrodes 18.

In the case of the ink jet head with no shield electrode 20 provided therein, at the time of ejection of ink droplets, electric lines of force generated from the end portion on an ejection port side of the ejection electrode 18 (hereinafter referred to as the "inner edge portion of the ejection electrode") converge inside the ejection electrode 18, that is, in an area surrounded by the inner edge portion of the ejection electrode 18, act on the own channel, and generate an electric field necessary for the ink droplet ejection. On the other hand, electric lines of force generated from the end portion on a side opposite to the ejection port side of the ejection electrode 18 (hereinafter referred to as the "outer edge portion of the ejection electrode") may diverge further outside from the outer edge portion of the ejection electrode 18, exert influence on other channels, and cause electric field interference.

If the above points are taken into consideration, the width and the length of the rectangular opening of the shield electrode 20, when the substrate plane is viewed from above, is preferably made larger than the width and the length defined by the inner edge portion of the ejection electrode 18 of the own channel to avoid shielding against the electric lines of force directed to the own channel. Specifically, the inner edge portion (i.e., end portion on the ejection port 28 side) of the shield electrode 20 is preferably more spaced apart (retracted) from the ejection port 28 than the inner edge portion of the ejection electrode 18 of the own channel.

In addition, for the efficient shielding against the electric lines of force directed to the other channels, the length and the width of the rectangular opening of the shield electrode 20, when the substrate plane is viewed from above, is preferably made smaller than the length and the width defined by the outer edge portion of the ejection electrode 18 of the own channel. Specifically, the inner edge portion of the shield electrode 20 is preferably closer (advanced) to the ejection port 28 than the outer edge portion of the ejection electrode 18 of the own channel. According to the studies made by the inventor of the present invention, the distance between the outer edge portion of the ejection electrode 18 and the inner edge portion of the shield electrode 20 is preferably equal to or larger than 5 μm, more preferably equal to or larger than 10 μm.

With the above configuration, while ensuring the stable ejection of the ink droplets from the ejection port 28, for example, variations in the ink adhering position due to the electric field interference between the adjacent channels can be suitably suppressed, thus a high-quality image can be consistently recorded.

The shield electrode 20 may be provided so that the shape of the opening of the shield electrode 20 is made substantially similar to the shape formed by the inner edge portion or the outer edge portion of the ejection electrode 18, and the inner edge portion of the shield electrode 20 is more spaced apart (retracted) from the ejection port 28 than the inner edge portion of the ejection electrode 18 of the own channel and is closer (advanced) to the ejection port 28 than the outer edge portion of the ejection electrode 18.

In the above example, the shield electrode 20 is a sheet-shaped electrode, however, the present invention is not limited to this and the shield electrode 20 may have any other shape or structure so long as it is possible to shield the respective ejection ports against electric lines of force of other channels. For instance, the shield electrode 20 may be provided between respective ejection ports in a mesh shape. Also, when the intervals between the adjacent ejection ports in the row direction and the intervals between the adjacent ejection ports in the column direction are different from each other in the matrix of the multiple ejection ports, for instance, a construction may be used in which the shield electrode is not provided between ejection ports which are separated from each other by a degree by which no electric field interference will occur, and the shield electrode is provided only between ejection ports that are close to each other.

Even in this case, it is sufficient that the shield electrode 20 is formed so that the inner edge portion of the shield electrode 20 is more apart from the ejection port 28 than the inner edge portion of the ejection electrode 18 of an own channel and is closer to the ejection port 28 than the outer edge portion of the ejection electrode 18.

The shape of the opening of the shield electrode 20 is set approximately the same as that of the ejection port 28, however, the present invention is not limited to this and the opening of the shield electrode 20 may have any arbitrary shape so long as it is possible to prevent electric field interference by shielding against electric lines of force between adjacent ejection electrodes 18. For instance, it is possible to form the opening in a circular shape, an oval shape, a square shape, or a rhomboid shape.

As shown in FIG. 1A, on the surface of the ejection port substrate 16 on the ink ejection side, that is, on the surface of the insulating layer 32, a diamond like carbon (DLC) layer 38 is formed. Specifically, in the ink jet head 10 of this embodiment, the DLC layer 38 which has high hardness and is excellent in abrasion resistance and corrosion resistance is formed on the surface of the ejection port substrate 16 which is on the ink ejection side and is exposed to the outside. The DLC layer 38 exhibits ink repellency (oil repellency) to the ink to be used, has high hardness, and is excellent in abrasion resistance and corrosion resistance. Accordingly, even in the case of repeatedly performing the maintenance such as brushing for the ink ejection surface, the DLC layer is less peelable than in the case of forming the conventional resin exhibiting the ink repellency. Therefore, the DLC layer 38 is formed on the surface of the ejection port substrate 16 on the ink ejection side, whereby high ink repellency can be maintained for a long period of time, and the ink meniscus formed in the ejection port is stably maintained, whereby the ink can be stably ejected.

It is preferable that the thickness of the DLC layer 38 be 0.1 μm or more in order to obtain sufficient strength and ink repellency performance. Further, it is preferable that the thickness be 5 μm or less for the reason that a flow path resistance in the case of ejecting the ink from the ejection port 28 is prevented from increasing, that is, the flow path resistance in the case of ejecting the ink from the ejection port 28 is to be reduced.

Figure 4A:
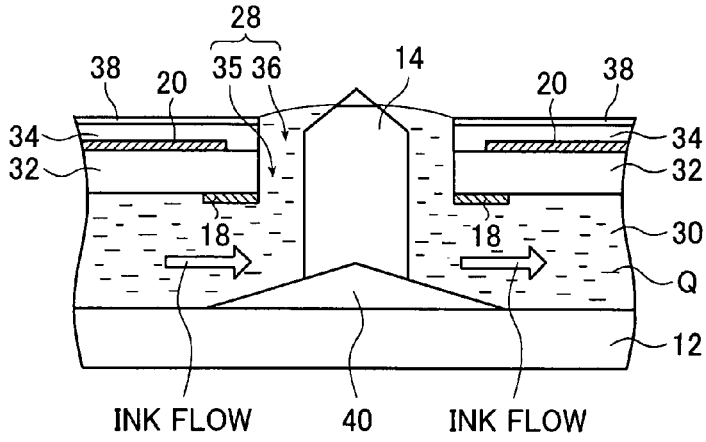
FIG. 4A is a schematic cross-sectional view showing an embodiment in which a DLC layer is formed on the surface of the ejection port substrate having an ejection port whose opening area in a depth direction is constant.
Figure 4B:
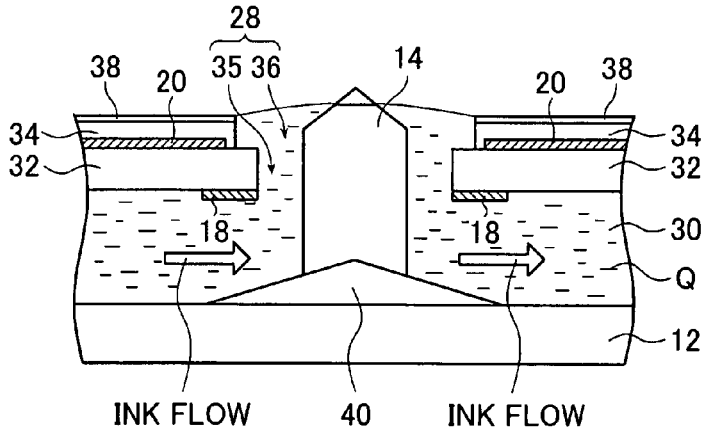
FIG. 4B is a schematic cross-sectional view showing another embodiment in which the DLC layer is formed only on an uppermost surface of an ejection port substrate in which the ejection port is composed of two openings different from each other in opening area.
Figure 4C:
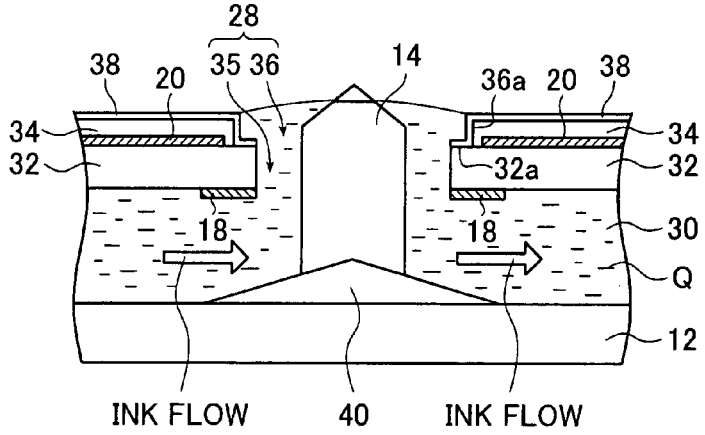
FIG. 4C is a schematic cross-sectional view showing still another embodiment in which the DLC layer is formed on the uppermost surface of the ejection port substrate in which the ejection port is composed of two openings different in opening area and on the inner wall surface of the ejection port.

In the first aspect of the present invention, it is sufficient that the DLC layer 38 is formed on the surface of the ejection port substrate 16 on the ink ejection side. For example, as shown in FIG. 4A, in the ejection port substrate 10 having the ejection port whose opening area in the depth direction is constant, it is sufficient that the DLC layer 38 is formed on the entire surface of the ejection port substrate 16 on the ink ejection side. Further, for example, as shown in FIG. 4B, when the ejection port 28 is composed of the inner opening 35 and the outer opening 36 which are different from each other in opening area, the DLC layer 38 may be formed only on the uppermost surface of the ejection port substrate 16. In this case, further, as shown in FIG. 4C, the DLC layer 38 may be formed on an inner wall surface 36*a* of the outer opening 36 and on an exposed portion 32*a* of the insulating substrate 32 at the boundary between the outer opening 36 and the inner opening 35.

The DLC layer 38 can be formed on the surface of the ejection port substrate 16, for example, by using a thin film forming method such as a chemical vapor deposition (CVD) method, a vacuum deposition method, an ionized deposition method, a sputtering method, and an arc ion plating method. As the CVD method, there can be suitably used a plasma CVD method such as a high-frequency plasma CVD method, a microwave plasma CVD method, and an ECR plasma CVD method. Further, in order to enhance a forming speed of the DLC layer 38, there can also be applied a DLC film synthesis method using a bipolar nanopulse power source that generates a voltage/current having a pulse width of 1 μsec or less. The DLC film synthesis method is described in "Dai 112 Kai Koen Taikai Ronshi-shu 5B-6, Hyomengijutsu Kyokai (The Surface Finishing Society of Japan)", pp. 73 to 74.

Various source gases containing carbon and hydrogen can be used as a source gas for use in a case of forming the DLC layer 38. For example, alkanes such as methane, ethane, propane, butane, pentane, and hexane, alkenes such as ethylene, propylene, butene, pentene, and butadiene, alkynes such as acetylene, aromatic hydrocarbons such as benzene, toluene, xylene, indene, naphthalene, and phenanthrene, nitrogen-containing hydrocarbons such as methylamine, ethylamine, and aniline, and the like can be appropriately selected for use according to the above-mentioned various thin-film forming methods, and these mixed gases can also be used. Further, carbon monoxide, carbon dioxide, and the like can be used. In particular, in the case of using the mixed gas, a flow ratio of the gas to be introduced is adjusted, and types of the gases to be mixed are changed, thereby also making it possible to adjust the hardness of the DLC layer. In the first aspect of the present invention, it is preferable to form the DLC layer on a surface of a resin substrate by the CVD method or the sputtering method by using, as the source gas, one or two or more gases selected from the group consisting of acetylene, methane, and benzene.

In the case of forming the DLC layer 38 by the sputtering method, for example, a target material containing carbon as a main component is disposed on a cathode side in a chamber of a deposition apparatus, a cathode is charged to a negative potential, plasma is generated on a surface of the target material, atoms of the target material are sputtered, and the atoms adhere to and are deposited on a sample (i.e., ejection port substrate) attached to an anode side opposing the cathode, whereby the DLC layer is formed.

Further, in the case of forming the DLC layer 38 by the plasma CVD method, the source gas is introduced into the chamber, and the plasma is generated between two electrodes (i.e., cathode and anode electrodes) arranged in the chamber so as to face each other. Then, the source gas is decomposed by the plasma, and the DLC is deposited on the surface of the sample (i.e., ejection port substrate) provided on the cathode electrode, whereby the DLC layer is formed.

Thus, the ejection port substrate on which the DLC layer is formed can be produced.

In the first aspect of the present invention, it is preferable that the DLC layer 38 further contain fluorine. The DLC layer 38 is made to contain fluorine, thereby making it possible to further enhance the ink repellency of the DLC layer 38.

It is preferable that a content of fluorine in the DLC layer 38 be 1 at % or more for the reason of enhancing the ink repellency, and be 20 at % or less for the reason of maintaining film strength.

As a method of making the DLC layer 38 contain fluorine, for example, a method of mixing a fluorine-containing gas such as tetrafluoromethane ($CF_4$) and hexafluoroethane ($C_2F_6$) to the source gas as described above can be applied. Then, a composition of the DLC layer can be adjusted by changing a flow ratio of the fluorine-containing gas.

The DLC layer 38 is formed on the surface of the insulating layer 34; however, the DLC layer 38 may be formed in place of the insulating layer 34 without forming the insulating layer 34 on the upper surface of the shield electrode 20.

Further, a foundation layer may be provided between the insulating layer 34 and the DLC layer 38 for the purpose of enhancing adhesion between the insulating layer 34 and the DLC layer 38.

Next, the head substrate 12 will be explained referring to FIG. 1A.

As shown in FIG. 1A, the ink guides 14 are provided on the surface of the head substrate 12 on the side opposing the ejection port substrate 16. The ink guide 14 is a resin-made flat plate with a predetermined thickness, and is disposed on the upper surface of the head substrate 12 for each ejection port 28 (i.e., ejection portion). The ink guide 14 is formed so that it has a somewhat wide width in accordance with the length of the cocoon-shaped inner opening 35 in a long-side direction. As described above, the ink guide 14 extends through the ejection port 28 and its tip end portion 14*a* protrudes upwardly from the surface of the ejection port substrate 16 on the recording medium P side (i.e., surface of the insulating layer 34).

The tip end portion 14*a* of the ink guide 14 is formed so that it has an approximately triangular shape (or a trapezoidal shape) that is gradually narrowed as a distance to the counter electrode 24 side is reduced. The ink guide 14 is disposed so that the surface of the tip end portion 14*a* is inclined with respect to the ink flow direction. With this configuration, the ink flowing into the ejection port 28 moves along the inclined surface of the tip end portion 14*a* of the ink guide 14 and reaches the vertex of the tip end portion 14*a*, so a meniscus of the ink is formed at the ejection port 28 with stability.

Also, by forming the ink guide 14 so that it is wide in the long-side direction of the ejection port 28, it becomes possible to reduce a width in the direction orthogonal to the ink flow and reduce influence on the ink flow, which makes it possible to form a meniscus to be described later with stability.

It should be noted here that the shape of the ink guide 14 is not specifically limited so long as it is possible to move the colorant particles in the ink Q through the ejection port 28 of the ejection port substrate 16 to be concentrated at the tip end portion 14*a*. For instance, it is possible to change the shape of the ink guide 14 as appropriate to a shape other than the shape in which the tip end portion 14*a* is gradually narrowed toward the counter electrode side. For instance, a slit serving as an ink guide groove that guides the ink Q to the tip end portion 14*a* by means of a capillary phenomenon may be formed in a center portion of the ink guide 14 in a vertical direction in FIG. 1A.

It is preferable that a metal be evaporated onto the extreme tip end portion of the ink guide 14 because the dielectric constant of the tip end portion 14*a* of the ink guide 14 is substantially increased through evaporation of metal onto the extreme tip end portion of the ink guide 14. As a result, a strong electric field is generated at the ink guide 14 with ease, which makes it possible to improve the ink ejection property.

The ink guides 14 may be formed integrally with or separately from the head substrate 12. The nanoimprint method can be utilized as the method for integrally forming the ink guides 14 and the head substrate 12. For example, integral molding of a head substrate and minute ink guides is performed as follows: a metal mold having concave-convex patterns corresponding to the ink guides is pressed against heated thermoplastic resin to transfer the concave-convex patterns to the resin, and thereafter, the resin is cooled to be cured. This method is excellent in productivity, and enables the production cost to be reduced.

In the above embodiments, the ink guide 14 is made of resin, but may be made of other material such as ceramic.

In the ink jet head 10 in this embodiment, as a preferable form, ink guide dikes 40 that guide ink to the ejection ports 28 are provided on the head substrate 12. The ink guide dike 40 will be explained below referring to FIG. 5.

Figure 5:
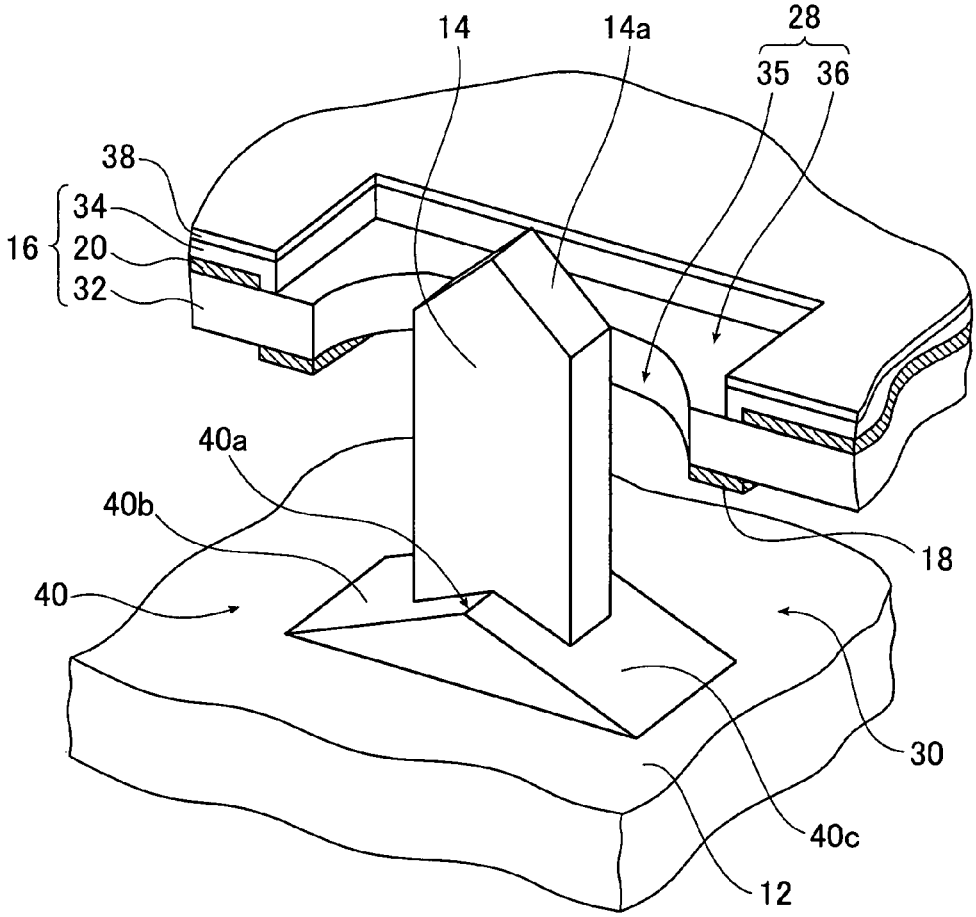
FIG. 5 is a partial cross-sectional perspective view showing a configuration in the vicinity of an ejection portion in the ink jet head shown in FIG. 1A.

FIG. 5 is a partial cross sectional perspective view showing a structure in the vicinity of the ejection portion 28 in the ink jet head 10 shown in FIG. 1A. In FIG. 5, in order to demonstrate clearly the structure of the ink guide dike 40, the vicinity of one ejection port 28 is shown by cutting the ejection port substrate 16 and the ejection electrode 18 along the ink flow direction at the substantially central position of the ink guide 14.

The ink guide dike 40 is disposed on the surface of the head substrate 12 on the ink flow path 30 side, i.e., on the bottom surface of the ink flow path 30, at a position corresponding to the ejection port 28. In the illustrated example, the ink guide dike 40 comprises an inclined surface 40*b* which inclines so as to become gradually closer to the ejection port substrate 16 from the upstream side of ink flow in the ink flow path 30 toward a predetermined position 40*a* (hereinafter referred to as "top portion 40*a*") which is on the upstream side of the center of the ejection port 28 in the ink flow direction. As a preferable embodiment, the ink guide dike 40 comprises an inclined surface 40*c* which inclines so as to be gradually spaced apart from the ejection port substrate 16 as the distance from the top portion 40*a* at which the inclined surface 40*b* is closest to the ejection port substrate 16 toward the downstream side of the ink flow is increased. That is, in the illustrated example, the ink guide dike 40 has a shape like an isosceles triangular prism with the bases of the isosceles triangles being on the head substrate and its side at the position corresponding to two vertex angles of the isosceles triangles constituting the top portion 40*a*.

In addition, the ink guide dike 40 is constructed so as to have nearly the same width as that of the inner opening in a direction intersecting perpendicularly the ink flow direction, and have a side wall which is erected on the bottom face. In addition, the ink guide dike 40 is provided at a predetermined distance from the surface of the ejection port substrate 16 on the ink flow path 30 side, i.e., from the upper surface of the ink flow path 30 so as to ensure the flow path of the ink Q without blocking up the ejection port 28. Such ink guide dike 40 is provided for each ejection portion.

The ink guide dike 40 inclining toward the ejection port 28 along the ink flow direction is provided on the bottom surface of the ink flow path 30, so that the ink flow directed to the ejection port 28 is formed and hence the ink Q is guided to the opening of the ejection port 28 on the ink flow path 30 side. Thus, it is possible to suitably make the ink Q flow to the inside of the ejection port 28, enabling enhancement of capability of supplying ink particles. Further, it is possible to more surely prevent the ejection port from being clogged.

The length of the ink guide dike 40 in the ink flow direction has to be properly set within a range in which the ink guide dike 40 does not interfere with any of the adjacent ejection ports so that the ink Q can be suitably guided to the ejection port 28. Thus, the ratio (k/h) of the length k of the ink guide dike 40 in the ink flow direction to the height h of the ink guide dike 40 at the highest point is preferably 0.5 or more ($k/h \geqq 0.5$), and is more preferably 1 or more ($k/h \geqq 1$).

The width of the ink guide dike 40 in the direction intersecting perpendicularly the ink flow direction is preferably equal to that of the ejection port 28 or slightly wider than that of the ejection port 28. In addition, the ink guide dike 40 is not limited to the illustrated example having a uniform width. There may also be adopted an ink guide dike having a gradually decreasing width, an ink guide dike having a gradually increasing width, or the like. In addition, each side wall of the ink guide dike 40 is not limited to the one having a vertical plane, and hence may also be one having an inclined plane or the like.

The inclined surface (i.e., ink guide surface) of the ink guide dike 40 need only have a shape which is suitable for guiding the ink Q to the ejection port 28. Thus, a slope having a fixed angle of inclination may be adopted for the inclined surface of the ink guide dike 40. Alternatively, a surface having different angles of inclination, or a curved surface may also be adopted for the inclined surface of the ink guide dike 40. In addition, the inclined surface of the ink guide dike 40 is not limited to a smooth surface. Thus, one or more ridges, grooves or the like may be formed along the ink flow direction, or radially toward the central portion of the ejection port 28 on the inclined surface of the ink guide dike 40.

The ink guide dike 40 may be made as a separate member from the head substrate 12 to be attached thereto, or may be formed as a part of the head substrate 12. That is, the ink guide dike 40 may have any arbitrary form so long as a part of the head substrate 12 has a raised shape in the ink ejection direction at the ejection port 28 at the position corresponding to each ejection port.

The ink guide dike 40 and the ink guide 14 may be formed as separate members so that the ink guide 14 is connected to the ink guide dike 40 to be mounted on the head substrate 12. Alternatively, the ink guide 14 and the ink guide dike 40 may be formed integrally with each other to be mounted on the head substrate 12. Still alternatively, the head substrate 12, the ink guide dike 40, and the ink guide 14 may be made from one piece of material using the conventionally known digging means (e.g., etching and the like). In addition, the perimeter of the bottom surface of the ink guide 14 may be rounded unlike the illustrated example to be smoothly connected to the upper surface of the ink guide dike 40.

In the example shown in FIG. 5, the ink guide dike 40 is disposed on the upper surface of the head substrate 12. However, the present invention is not limited to this and there may also be adopted a structure in which an ink flow groove is provided in the head substrate 12, and the ink guide dike is disposed inside the ink flow groove.

For example, the ink flow groove having a predetermined depth is provided along the ink flow direction so as to pass a position corresponding to the ejection port 28, and an ink guide dike having the surface inclining toward the ejection port 28 along the ink flow direction is provided at the position corresponding to the ejection port. In such a manner, the provision of the ink flow groove allows most of the ink Q flowing through the ink flow path 30 to selectively flow in the ink flow groove, and the provision of the ink guide dike allows the ink Q to suitably flow to the inside of the ejection port 28. Hence, it is possible to enhance capability of supplying ink to the tip end portion 14*a* of the ink guide 14.

Figure 6:
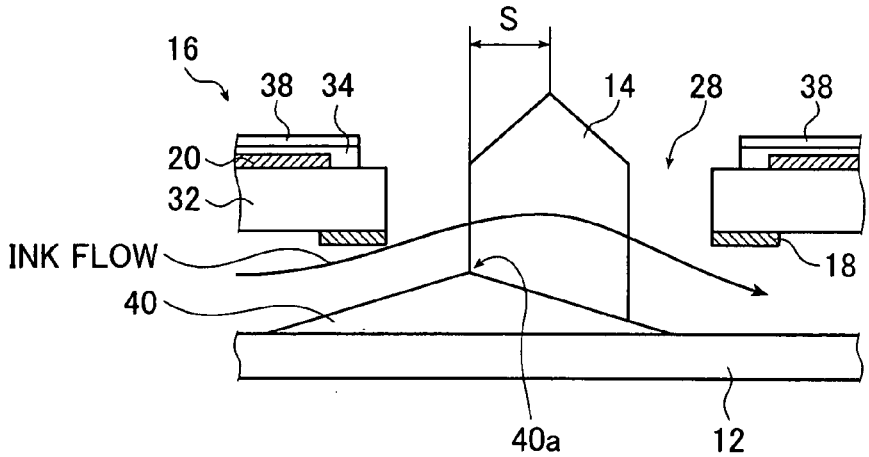
FIG. 6 is a schematic cross-sectional view of another embodiment of the ink jet head, in which a top portion of an ink guide dike is disposed to be shifted to an upstream side from a center of the ejection port.

As shown in FIG. 6, the ink guide dike 40 in this embodiment is preferably disposed so that the top portion 40*a* thereof is positioned on the upstream side of the center of the ejection port 28 in the ink flow direction. As above, the top portion 40*a* is shifted to the upstream side of the center of the ejection port 28. Thus, when the ink flow rate is increased, the ink flow toward the central portion of the ejection port 28 can be formed, so that it is possible to enhance capability of supplying ink to the ejection port 28. Further, it is possible to more surely prevent the ejection port from being clogged.

The ink guide dike 40 is provided with the inclined surface 40*b*, so that the height of the ink flow path 30 on the upstream side of the ejection port 28 (i.e., space between the ejection port substrate 16 and the inclined surface 40*b*) is gradually decreased as the inclined surface 40*b* approaches the ejection port 28. On the other hand, the height of the ink flow path 30 on the downstream side of the ejection port 28 is gradually increased and higher than the upstream side. With this structure, a turbulent flow of ink can be prevented, so that it is possible to enhance the effect of capability of supplying ink.

When the top portion 40*a* of the ink guide dike 40 is shifted to the upstream side of the center of the ejection port 28, it is sufficient that the shift amount s of the top portion 40*a* in the ink flow direction with respect to the center position of the ejection port 28 is determined so that the highest position of the ink flow guided along the inclined surface 40*b* in the thickness direction of the ejection port substrate 16 comes roughly to the center of the ejection port 28 in the ink flow direction. Thus, the shift amount s can be appropriately set in accordance with the flow rate (design flow rate) of the ink Q in the ink flow path 30, the cross sectional area of a space of the ejection port 28 and the shape of the ejection port 28, the shape of the ink guide 14, and the like. The flow rate of the ink Q in the ink flow path 30 is affected by the rate (i.e., circulation rate) at which the ink Q is supplied, the cross sectional area and the shape of the ink flow path 30, physical properties of the ink Q, and the like. The highest position of the ink flow is affected by the inclination angle and surface shape of the inclined surface 40*b* and the like. In view of these factors, the shift amount s of the top portion 40*a* is determined.

In the example shown in FIG. 6, the top portion 40*a* of the ink guide dike 40 accords with the surface of the ink guide 14 on the upstream side of the ink flow, however, the positional relation between the top portion 40*a* and the ink guide 14 is not limited thereto. For example, the top portion 40*a* may be positioned on the upstream side of the surface of the ink guide 14 on the upstream side of the ink flow and the ink guide 14 may be erected on the inclined surface 40*c* of the ink guide dike 40 which is on the downstream side in the ink flow direction. The top portion 40*a* may be positioned between the surface of the ink guide 14 on the upstream side of the ink flow and the vertical plane passing through the vertex of the tip end portion 14*a* of the ink guide 14 in the ink flow direction. The ink guide 14 is disposed so that the tip end portion 14*a* is positioned roughly in the center of the ejection port 28, and the ink guide dike 40 is disposed so that the highest position of the ink flow guided by the ink guide dike 40 comes roughly to the center of the ejection port 28 in the ink flow direction.

It should be noted that while the ink guide dike 40 has to be provided with the inclined surface 40*b* on the upstream side of the ejection port 28, as in the illustrated example, the ink guide dike 40 is preferably provided with the inclined surface 40*c* inclining so that the distance from the ejection port substrate 16 is gradually increased as the distance from the top portion 40*a* is increased toward the downstream side. As a result, the ink Q which has been guided toward the ejection port 28 by the ink guide dike 40 on the upstream side smoothly flows to the downstream side. Hence, the stability of ink flow can be maintained without a turbulent flow of the ink Q, enabling ejection stability to be maintained.

As explained in detail above, the head substrate 12, and the ink guides 14 and the ink guide dikes 40 formed on the head substrate 12 are basically configured in the above manner.

As shown in FIG. 1A, the counter electrode 24 is arranged to face the ejection surface of the ink droplets R of the ink jet head 10 having such configuration.

The counter electrode 24 is arranged at a position facing the tip end portions 14*a* of the ink guides 14, and includes an electrode substrate 24*a* which is grounded and an insulating sheet 24*b* arranged on the lower surface of the electrode substrate 24*a* in FIG. 1A, i.e., on the surface of the electrode substrate 24*a* on the ink jet head 10 side.

The recording medium P is held on the lower surface of the counter electrode 24 in FIG. 1A, i.e., on the surface of the insulating sheet 24*b*, by electrostatic attraction for example. The counter electrode 24 (insulating sheet 24*b*) functions as a platen for the recording medium P.

At least during recording, the recording medium P held on the insulating sheet 24*b* of the counter electrode 24 is charged by the charging unit 26 to a predetermined negative high voltage opposite in polarity to that of the drive voltage applied to the ejection electrode 18.

Consequently, the recording medium P is charged negative to be biased to the negative high voltage to function as the substantial counter electrode to the ejection electrode 18, and is electrostatically attracted to the insulating sheet 24*b* of the counter electrode 24.

The charging unit 26 includes a scorotron charger 26*a* for charging the recording medium P to a negative high voltage, a high voltage power source 26*b* for supplying a negative high voltage to the scorotron charger 26*a*, and a bias voltage source 26*c*. Note that the corona wire of the scorotron charger 26*a* is connected to the terminal of the high voltage power source 26*b* on the negative side, and the terminal of the high voltage power source 26*b* on the positive side and the metallic shield case of the scorotron charger 26*a* are grounded. The terminal of the bias voltage source 26*c* on the negative side is connected to the grid electrode of the scorotron charger 26*a*, and the terminal of the bias voltage source 26*c* on the positive side is grounded.

The charging means of the charging unit 26 used in the present invention is not limited to the scorotron charger 26*a*, and hence various discharge means such as a scorotron charger, a solid-state charger and an electrostatic discharge needle can be used.

In addition, in the illustrated example, the counter electrode 24 includes the electrode substrate 24*a* and the insulating sheet 24*b*, and the charging unit 26 is used to charge the recording medium P to a negative high voltage to apply a bias voltage to the medium P so that the medium P functions as the counter electrode and is electrostatically attracted to the surface of the insulating sheet 24*b*. However, this is not the sole case of the present invention and another configuration is also possible in which the counter electrode 24 is constituted only by the electrode substrate 24*a*, and the counter electrode 24 (i.e., electrode substrate 24*a* itself) is connected to a high voltage source (i.e., bias voltage power source) for supplying a negative high voltage and is always biased to the negative high voltage so that the recording medium P is electrostatically attracted to the surface of the counter electrode 24.

Further, the electrostatic attraction of the recording medium P to the counter electrode 24, and the charge of the recording medium P to the negative high voltage or the application of the negative high voltage (i.e., bias high voltage) to the counter electrode 24 may be performed using separate negative high voltage sources. Also, the holding of the recording medium P by the counter electrode 24 is not limited to the utilization of the electrostatic attraction of the recording medium P, and hence any other holding method or holding means may be used for holding the recording medium P by the counter electrode 24.

Next, the present invention will be explained in more detail below by describing the ejection action of the ink droplets R from the ink jet head 10.

As shown in FIG. 1A, in the ink jet head 10, the ink Q, which contains colorant particles charged with the same polarity (for example, charged positively) as that of a voltage applied to the ejection electrode 18 at the time of recording, circulates in an arrow direction (from left to right in FIG. 1A) in the ink flow path 30 by a not shown ink circulation mechanism including a pump and the like.

On the other hand, upon recording, the recording medium P is supplied to the counter electrode 24 and is charged to have the polarity opposite to that of the colorant particles, that is, a negative high voltage, by the charging unit 26. While being charged to the bias voltage, the recording medium P is electrostatically attracted to the counter electrode 24.

In this state, the control device 33 performs control so that a pulse voltage (hereinafter referred to as a "drive voltage") is applied to each ejection electrode 18 in accordance with supplied image data while relatively moving the recording medium P (counter electrode 24) and the ink jet head 10. Ejection ON/OFF is basically controlled depending on application ON/OFF of the drive voltage, whereby the ink droplets R are modulated in accordance with the image data and ejected to record an image on the recording medium P.

When the drive voltage is not applied to the ejection electrode 18 (or the applied voltage is at a low voltage level), i.e., in a state where only the bias voltage is applied, Coulomb attraction between the bias voltage and the charges of the colorant particles (charged particles) of the ink Q, Coulomb repulsion between the colorant particles, viscosity, surface tension and dielectric polarization force of the carrier liquid, and the like act on the ink Q, and these factors operate in conjunction with each other to move the colorant particles and the carrier liquid. Thus, the balance is kept in a meniscus shape as conceptually shown in FIG. 1A in which the ink Q slightly rises from the outer opening 36.

In addition, the colorant particles aggregate at the ejection port 28 due to the electric field generated between the negatively charged recording medium P and the ejection electrode 18. The above described Coulomb attraction and the like allow the colorant particles to move toward the recording medium P charged to the negative bias voltage through a so-called electrophoresis process. Thus, the ink Q is concentrated in the meniscus formed at the outer opening 36.

From this state, the drive voltage is applied to the ejection electrode 18. Whereby, the drive voltage is superimposed on the bias voltage. Then, the motion occurs in which the previous conjunction motion operates in conjunction with the superimposition of the drive voltage. The electrostatic force acts on the colorant particles and the carrier liquid by the electric field newly generated by the application of the drive voltage to the ejection electrode 18. Thus, the colorant particles and the carrier liquid are attracted toward the counter electrode 24 (i.e., bias voltage) side, that is, the recording medium P side, by the electrostatic force. The meniscus formed in the ejection port grows toward the recording medium P side (i.e., upward in FIG. 1A) to form a nearly conical ink liquid column, i.e., a so-called Taylor cone in a direction from the outer opening 36 to the recording medium P. In addition, similarly to the foregoing, the colorant particles are moved to the meniscus surface through electrophoresis process and the action of the electric field from the ejection electrode, so that the ink Q at the meniscus is concentrated and has a large number of colorant particles at a nearly uniform high concentration.

When a finite period of time further elapses after the start of the application of the drive voltage to the ejection electrode 18, the balance mainly between the force acting on the colorant particles (e.g., Coulomb force and the like) and the surface tension of the carrier liquid is broken at the tip end portion of the meniscus having the high electric field strength due to the movement of the colorant particles or the like. As a result, the meniscus abruptly grows to form a slender ink liquid column called a thread having about several μm to several tens of μm in diameter.

When a finite period of time further elapses, the thread grows, and is divided due to the interaction resulting from the growth of the thread, the vibrations generated due to the Rayleigh/Weber instability, the ununiformity in distribution of the colorant particles within the meniscus, the ununiformity in distribution of the electrostatic field applied to the meniscus, and the like. Then, the divided thread is ejected and flown in the form of the ink droplets R toward the recording medium P and is attracted by the bias voltage as well to adhere to the recording medium P.

The growth of the thread and its division, and moreover the movement of the colorant particles to the meniscus (thread) are continuously generated while the drive voltage is applied to the ejection electrode. Therefore, the amount of ink droplets ejected per pixel can be controlled by adjusting the time during which the drive voltage is applied.

After the end of the application of the drive voltage (ejection is OFF), the meniscus returns to the above-mentioned state where only the bias voltage is applied to the recording medium P.

As described above, the ink jet head 10 of this embodiment includes the ejection ports each shaped so that the opening area of the outer opening 36 is larger than that of the inner opening 35. By making the opening area of the outer opening 36 of the ejection port 28 larger than that of the inner opening 35, it is possible to maintain a meniscus formed at the ejection port at the time of ink ejection large in height. Also, by making the opening area of the inner opening 35 smaller than that of the outer opening 36, it is possible to suppress reduction of the ink flow path resistance at the ejection port 28.

That is, even when the opening area of the outer opening 36 is set so that a meniscus has a height equal to or greater than a certain value, the ejection port 28 is shaped so that the opening area of the inner opening 35 is smaller than that of the outer opening 36, thereby enabling the ink flow path resistance to be equal to or greater than a certain value. In other word, even when the opening area of the inner opening 35 is set so that the ink flow path resistance is equal to or greater than a certain value, the ejection port 28 is shaped so that the opening area of the outer opening 36 is larger than that of the inner opening 35, thereby enabling the meniscus to be made higher.

The ink flow path resistance of the ejection port 28 is the resistance created when ink passes through the ejection port 28. When the ink flow path resistance is reduced, the force for suppressing the ink flow becomes small. Thus, ejection of ink droplets is not stopped even in the ink ejection OFF state, i.e., ink droplets are ejected even after the end of the application of the drive voltage. That is, the ink ejection cutoff property is deteriorated (i.e., impaired).

However, in the present invention, the ink flow path resistance can be set equal to or higher than a certain value as described above, so that the ink ejection cutoff property is prevented from being deteriorated (i.e., impaired). That is, the following phenomenon is prevented: ejection of ink droplets is not stopped even in the ink ejection OFF state, i.e., ink droplets are ejected even after the end of the application of the drive voltage. Consequently, it becomes possible to control ejection and non-ejection (ejection ON/OFF) of ink droplets more precisely, thereby enabling a high quality image to be drawn.

Further, a meniscus can be made high in position (i.e., a meniscus can have a height equal to or greater than a certain value), so that it is possible to improve the ejection responsivity (i.e., ejection frequency) of ink droplets. Consequently, ink droplets can be ejected at high ejection frequency.

As above, according to the present invention, ink droplets can be stably ejected at high speed, and a high quality image can be drawn. Specifically, even when image recording is performed at the ejection frequency of 15 kHz, it is possible to maintain high ink ejection cutoff property. Thus, a high quality image can be stably drawn.

It is preferable that the ratio S1/S2 be set at 0.3 to 0.7, in which S1 is an opening area of an inner opening (i.e., opening on the ink flow path side) in the ejection port, and S2 is an opening area of an outer opening (i.e., opening on the recording medium side) in the ejection port.

As shown in FIGS. 1A and 1B, the ink jet head 10 comprises the inner opening 35 that is a slit like long hole elongated in the ink flow direction. By forming the inner opening 35 in the shape of a slit like long hole elongated in the ink flow direction, that is, by setting the aspect ratio of the inner opening 35 between the length in the ink flow direction and the length in the direction orthogonal to the ink flow at 1 or more, ink becomes easy to flow to the inside of the ejection port and capability of supplying ink particles to the ejection port 28 can be enhanced. Whereby, capability of supplying ink particles to the tip end portion 14*a* of the ink guide 14 is enhanced, which makes it possible to improve ejection frequency at the time of image recording. Therefore, even when dots are drawn continuously at high speed, dots of desired size can be consistently formed on the recording medium. In addition, by setting the aspect ratio of the inner opening at 1 or more, ink flows smoothly and the ejection port can be prevented from being clogged with ink.

It is preferable that the aspect ratio of the inner opening between the length in the ink flow direction and the length in the direction orthogonal to the ink flow direction be 1.5 or more.

By setting the aspect ratio at 1.5 or more, capability of supplying ink to the ink guide can be enhanced. Thus, it is possible to continuously form large dots with more stability, and to perform drawing at a higher drawing frequency.

The above effects can be more advantageously achieved by forming the opening of the ejection port such that the aspect ratio between the length in the ink flow direction and the length in the direction orthogonal to the ink flow is 1 or more as in the above embodiment, however, the present invention is not limited thereto. By setting the aspect ratio of the opening of the ejection port between the major axis and the minor axis at 1 or more, ink flows smoothly and the ejection port can be prevented from being clogged with ink.

It is preferable that the ejection electrode have a shape in which a part on the upstream side in the ink flow direction be removed as in this embodiment. Thus, an electric field which prevents colorant particles from flowing into the ejection port from the upstream side in the ink flow direction is not formed, whereby the colorant particles can be effectively supplied to the ejection port. In addition, since a part of the ejection electrode is present on the downstream side of the ejection port in the ink flow direction, an electric field is formed in such a direction that colorant particles having flowed into the ejection port is kept at the ejection port. Accordingly, by forming the ejection electrode into a shape in which a part on the upstream side of the ejection port in the ink flow direction is removed, it is possible to further enhance capability of supplying particles to the ejection port.

In the ink jet head 10 shown in FIGS. 1A and 1B, the ejection electrode 18 is exposed to the ink flow path 30 and is hence in contact with the ink Q in the ink flow path 30.

Therefore, when the drive voltage is applied to the ejection electrode 18 that is in contact with the ink Q in the ink flow path 30 (ejection ON), part of electric charges supplied to the ejection electrode 18 is injected into the ink Q, which increases the electric conductivity of the ink Q which is located between the ejection port 28 and the ejection electrode 18. Therefore, in the ink jet head 10 of this embodiment, the ink Q is readily ejected in the form of the ink droplets R (that is, ejection property is enhanced) when the drive voltage is applied to the ejection electrode 18 (ejection ON).

In the present invention, the cross sectional shape of the ejection port formed in the ejection port substrate is not limited to the one shown in FIG. 1A, and an ejection port substrate with arbitrary shaped ejection ports can be used so long as an opening area of an outer opening is larger than that of an inner opening in the ejection port.

It is preferable that the outer opening of the ejection port and the opening of the shield electrode be formed to have approximately the same shape.

Figure 7A:
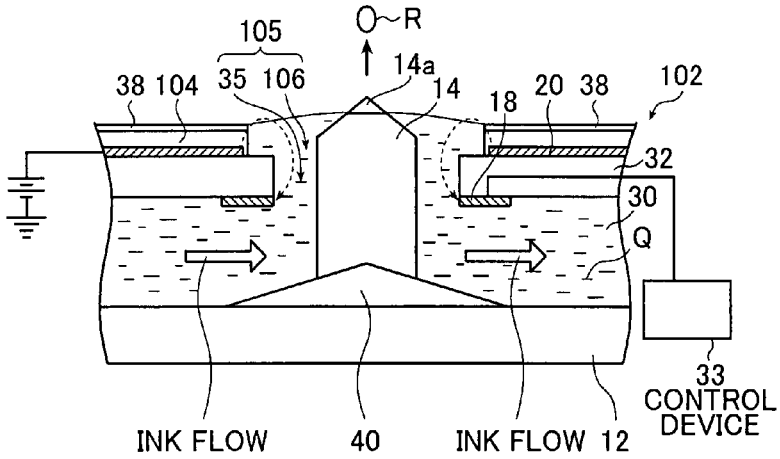
FIGS. 7A and 7B are schematic views each showing a schematic configuration of another embodiment of the ink jet head of the present invention.

As one example, as shown in FIG. 7A, it is preferable that an opening formed in an insulating layer 104 of an ejection port substrate 102 be formed in approximately the same shape as the opening of the shield electrode 20. Whereby, the opening formed in the insulating layer 104, that is, an outer opening 106 of an ejection port 105, and the opening of the shield electrode 20 can have approximately the same shape.

Figure 7B:
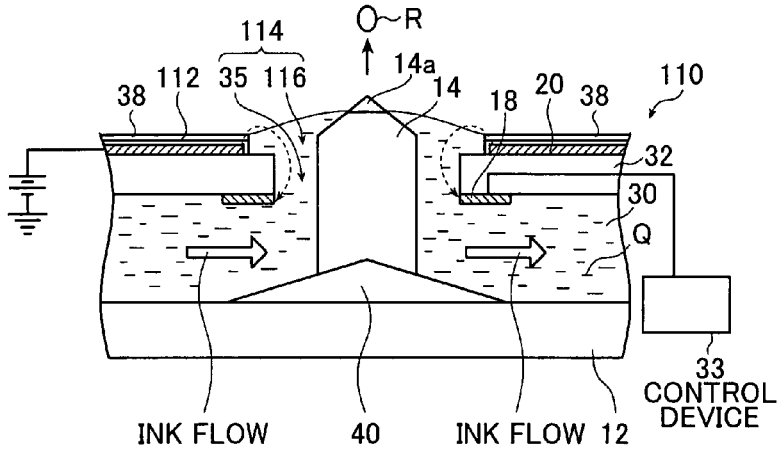

In addition, as shown in FIG. 7B, it is preferable that the insulating layer 112 covering the shield electrode 20 be a thin film. Whereby, the opening formed in the insulating layer 112 of the ejection port substrate 110, i.e., the outer opening 116 of the ejection port 114, and the opening of the shield electrode 20 can have approximately the same shape, and the ejection port substrate can be thin in the thickness direction thereof.

In FIGS. 1A, 1B, and 6, the through hole extending through the insulating substrate is formed as the inner opening, and the through hole extending through the insulating layer is formed as the outer opening. Also, in FIGS. 7A and 7B, the insulating layer is provided on the ejection port substrate. However, the configuration is not limited thereto, and another configuration is also possible in which only the shield substrate 20 is laminated on the insulating substrate 32, an opening of the shield electrode 20 is used as an outer opening, and an ejection port is formed of the outer opening and the inner opening 35 extending through the insulating substrate 32. That is, a meniscus may be formed at the opening of the shield electrode 20 having an opening area larger than that of the inner opening 35.

As shown in FIGS. 7A and 7B, by forming the outer opening and the opening of the shield electrode in approximately the same shape, or by using the opening of the shield electrode as the outer opening, a meniscus is formed in the vicinity of the shield electrode. Thus, the force for holding a meniscus (i.e., force for pinning a meniscus) at the ejection port by the electric field formed between the shield electrode and the ejection electrode can act in an arrow direction shown in dotted lines in FIGS. 7A and 7B, to form a meniscus more stably. Consequently, it becomes possible to control the ejection of ink droplets more stably, making it possible to draw a high quality image.

Figure 8:
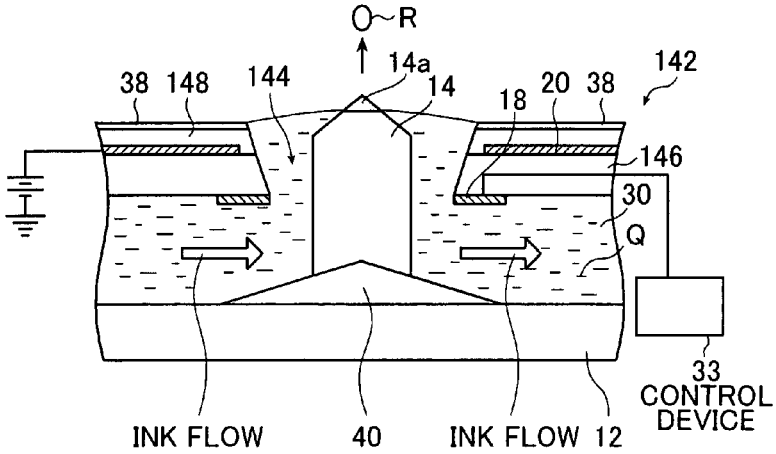
FIG. 8 is a schematic view showing a schematic configuration of still another embodiment of the ink jet head of the present invention.

In any of the above embodiments, the ejection port has a shape formed by the inner opening whose inner wall surface formed is parallel to the thickness direction of the ejection port substrate, and the outer opening which has the opening area different from that of the inner opening and whose inner wall surface formed is parallel to the thickness direction of the ejection port substrate. In other words, the inner wall of the ejection port has a stepped shape. However, the present invention is not limited thereto, and as shown in FIG. 8, the inner wall of an ejection port 144 formed to extend through an insulating substrate 146 and an insulating layer 148 of an ejection port substrate 142 may be inclined at a predetermined angle with respect to the thickness direction of the ejection port substrate 142. That is, the inner wall of the ejection port 144, i.e., the inner opening and the outer opening, may be formed in a tapered shape so that the opening area of the outer opening is larger than that of the inner opening.

In this case, a DLC layer may be formed on the inner wall of the ejection opening having a tapered shape.

The ink used in the ink jet head 10 will be explained.

The ink Q is obtained by dispersing colorant particles in a carrier liquid. The carrier liquid is preferably a dielectric liquid (non-aqueous solvent) having a high electrical resistivity (equal to or larger than $10^9$ Ω·cm, and preferably equal to or larger than $10^{10}$ Ω·cm). If the electrical resistance of the carrier liquid is low, the concentration of the colorant particles does not occur since the carrier liquid receives the injection of electric charges and is charged due to a drive voltage applied to the ejection electrodes. In addition, since there is also anxiety that the carrier liquid having a low electrical resistance causes the electrical conduction between adjacent ejection electrodes, the carrier liquid having a low electrical resistance is unsuitable for the present invention.

The relative permittivity of the dielectric liquid used as the carrier liquid is preferably equal to or smaller than 5, more preferably equal to or smaller than 4, and much more preferably equal to or smaller than 3.5. Such a range is selected for the relative permittivity, whereby an electric field effectively acts on the colorant particles contained in the carrier liquid to facilitate the electrophoresis of the colorant particles.

Note that the upper limit of the specific electrical resistance of the carrier liquid is desirably about $10^{16}$ Ω·cm, and the lower limit of the relative permittivity is desirably about 1.9. The reason why the electrical resistance of the carrier liquid preferably falls within the above-mentioned range is that if the electrical resistance becomes low, then the ejection of ink under a low electric field becomes worse. Also, the reason why the relative permittivity preferably falls within the above-mentioned range is that if the relative permittivity becomes high, then an electric field is relaxed due to the polarization of a solvent, and as a result the color of dots formed under this condition becomes light, or the bleeding occurs.

Preferred examples of the dielectric liquid used as the carrier liquid include straight-chain or branched aliphatic hydrocarbons, alicyclic hydrocarbons, aromatic hydrocarbons, and the same hydrocarbons substituted with halogens. Specific examples thereof include hexane, heptane, octane, isooctane, decane, isodecane, decalin, nonane, dodecane, isododecane, cyclohexane, cyclooctane, cyclodecane, benzene, toluene, xylene, mesitylene, Isopar C, Isopar E, Isopar G, Isopar H, Isopar L, Isopar M (Isopar: a trade name of EXXON Corporation), Shellsol 70, Shellsol 71 (Shellsol: a trade name of Shell Oil Company), AMSCO OMS, AMSCO 460 Solvent (AMSCO: a trade name of Spirits Co., Ltd.), a silicone oil (such as KF-96L, available from Shin-Etsu Chemical Co., Ltd.). The dielectric liquid may be used singly or as a mixture of two or more thereof.

For such colorant particles dispersed in the carrier liquid, colorants themselves may be dispersed as the colorant particles into the carrier liquid, but dispersion resin particles are preferably contained for enhancement of the fixing property. In the case where the dispersion resin particles are contained in the carrier liquid, in general, there is adopted a method in which pigments are covered with the resin material of the dispersion resin particles to obtain particles covered with the resin, or the dispersion resin particles are colored with dyes to obtain the colored particles.

As the colorants, pigments and dyes conventionally used in ink compositions for ink jet recording, (oily) ink compositions for printing, or liquid developers for electrostatic photography may be used.

Pigments used as colorants may be inorganic pigments or organic pigments commonly employed in the field of printing technology. Specific examples thereof include but are not particularly limited to known pigments such as carbon black, cadmium red, molybdenum red, chrome yellow, cadmium yellow, titanium yellow, chromium oxide, viridian, cobalt green, ultramarine blue, Prussian blue, cobalt blue, azo pigments, phthalocyanine pigments, quinacridone pigments, isoindolinone pigments, dioxazine pigments, threne pigments, perylene pigments, perinone pigments, thioindigo pigments, quinophthalone pigments, and metal complex pigments.

Preferred examples of dyes used as colorants include oil-soluble dyes such as azo dyes, metal complex salt dyes, naphthol dyes, anthraquinone dyes, indigo dyes, carbonium dyes, quinoneimine dyes, xanthene dyes, aniline dyes, quinoline dyes, nitro dyes, nitroso dyes, benzoquinone dyes, naphthoquinone dyes, phthalocyanine dyes, and metal phthalocyanine dyes.

Further, examples of the dispersion resin particles include rosins, rosin-modified phenol resin, alkyd resin, a (meth)acryl polymer, polyurethane, polyester, polyamide, polyethylene, polybutadiene, polystyrene, polyvinyl acetate, acetal-modified polyvinyl alcohol, and polycarbonate.

Of those, from the viewpoint of ease for particle formation, a polymer having a weight average molecular weight in a range of 2,000 to 1,000,000 and a polydispersity (weight average molecular weight/number average molecular weight) in a range of 1.0 to 5.0 is preferred. Moreover, from the viewpoint of ease for the fixation, a polymer in which one of a softening point, a glass transition point, and a melting point is in a range of 40° C. to 120° C. is preferred.

In the ink Q, the content of colorant particles (i.e., the total content of colorant particles and dispersion resin particles) preferably falls within a range of 0.5 to 30 wt % for the overall ink, more preferably falls within a range of 1.5 to 25 wt %, and much more preferably falls within a range of 3 to 20 wt %. If the content of the colorant particles decreases, the following problems become easy to arise. The density of a printed image is insufficient, the affinity between the ink Q and the surface of the recording medium P becomes difficult to obtain to prevent an image firmly stuck to the surface of the recording medium P from being obtained, and so forth. On the other hand, if the content of the colorant particles increases, problems occur in that the uniform dispersion liquid becomes difficult to obtain, the clogging of the ink Q is easy to occur in the ink jet head or the like to make it difficult to obtain the consistent ink ejection, and so forth.

In addition, the average particle diameter of the colorant particles dispersed in the carrier liquid preferably falls within a range of 0.1 to 5 μm, more preferably falls within a range of 0.2 to 1.5 μm, and much more preferably falls within a range of 0.4 to 1.0 μm. Those particle diameters are measured with CAPA-500 (a trade name of a measuring apparatus manufactured by HORIBA Ltd.).

After the colorant particles and optionally a dispersing agent are dispersed in the carrier liquid, a charging control agent is added to the resultant carrier liquid to charge the colorant particles, and the charged colorant particles are dispersed in the resultant liquid to thereby produce the ink Q. Note that in dispersing the colorant particles in the carrier liquid, a dispersion medium may be added if necessary.

As the charging control agent, for example, various ones used in the electrophotographic liquid developer can be utilized. In addition, it is also possible to utilize various charging control agents described in "DEVELOPMENT AND PRACTICAL APPLICATION OF RECENT ELECTRONIC PHOTOGRAPH DEVELOPING SYSTEM AND TONER MATERIALS", pp. 139 to 148; "ELECTROPHOTOGRAPHY-BASES AND APPLICATIONS", edited by THE IMAGING SOCIETY OF JAPAN, and published by CORONA PUBLISHING CO. LTD., pp. 497 to 505, 1988; and "ELECTRONIC PHOTOGRAPHY" by Yuji Harasaki, 16 (No. 2), p. 44, 1977.

Note that the colorant particles may be positively or negatively charged as long as the charged colorant particles are identical in polarity to the drive voltages applied to ejection electrodes.

In addition, the charging amount of the colorant particles is preferably in a range of 5 to 200 μC/g, more preferably in a range of 10 to 150 μC/g, and much more preferably in a range of 15 to 100 μC/g.

In addition, the electrical resistance of the dielectric solvent may be changed by adding the charging control agent in some cases. Thus, the distribution factor P defined in the following formula is preferably equal to or larger than 50%, more preferably equal to or larger than 60%, and much more preferably equal to or larger than 70%.

$$P=100\times(\sigma 1-\sigma 2)/\sigma 1$$

In the above formula, σ1 is an electric conductivity of the ink Q, and σ2 is an electric conductivity of a supernatant liquid which is obtained by inspecting the ink Q with a centrifugal separator. Those electric conductivities were measured by using an LCR meter (AG-4311 manufactured by ANDO ELECTRIC CO., LTD.) and an electrode for liquid (LP-05 manufactured by KAWAGUCHI ELECTRIC WORKS, CO., LTD.) under a condition of an applied voltage of 5 V and a frequency of 1 kHz. In addition, the centrifugation was carried out for 30 minutes under a condition of a rotational speed of 14,500 rpm and a temperature of 23° C. using a miniature high speed cooling centrifugal machine (SRX-201 manufactured by TOMY SEIKO CO., LTD.).

The ink Q as described above is used, which results in that the colorant particles are likely to migrate and hence the colorant particles are easily concentrated.

The electric conductivity of the ink Q is preferably in a range of 100 to 3,000 pS/cm, more preferably in a range of 150 to 2,500 pS/cm, and much more preferably in a range of 200 to 2,000 pS/cm. The range of the electric conductivity as described above is set, resulting in that the applied voltages to the ejection electrodes are not excessively high, and also there is no anxiety to cause the electrical conduction between adjacent ejection electrodes.

In addition, the surface tension of the ink Q is preferably in a range of 15 to 50 mN/m, more preferably in a range of 15.5 to 45 mN/m, and much more preferably in a range of 16 to 40 mN/m. The surface tension is set in this range, resulting in that the applied voltages to the ejection electrodes are not excessively high, and also ink does not leak or spread to the periphery of the head to make the head dirty.

Moreover, the viscosity of the ink Q is preferably in a range of 0.5 to 5 mPa·sec, more preferably in a range of 0.6 to 3.0 mPa·sec, and much more preferably in a range of 0.7 to 2.0 mPa·sec.

The ink Q can be prepared, for example, by dispersing colorant particles into a carrier liquid to form particles and adding a charging control agent to a dispersion medium to allow the colorant particles to be charged. The following methods are given as the specific methods.

(1) A method including: previously mixing (kneading) a colorant and optionally dispersion resin particles; dispersing the resultant mixture into a carrier liquid using a dispersing agent when necessary; and adding a charging control agent thereto.

(2) A method including: adding a colorant and optionally dispersion resin particles and a dispersing agent into a carrier liquid at the same time for dispersion; and adding a charging control agent thereto.

(3) A method including adding a colorant and a charging control agent and optionally a dispersion resin particles and a dispersing agent into a carrier liquid at the same time for dispersion.

Figure 9A:
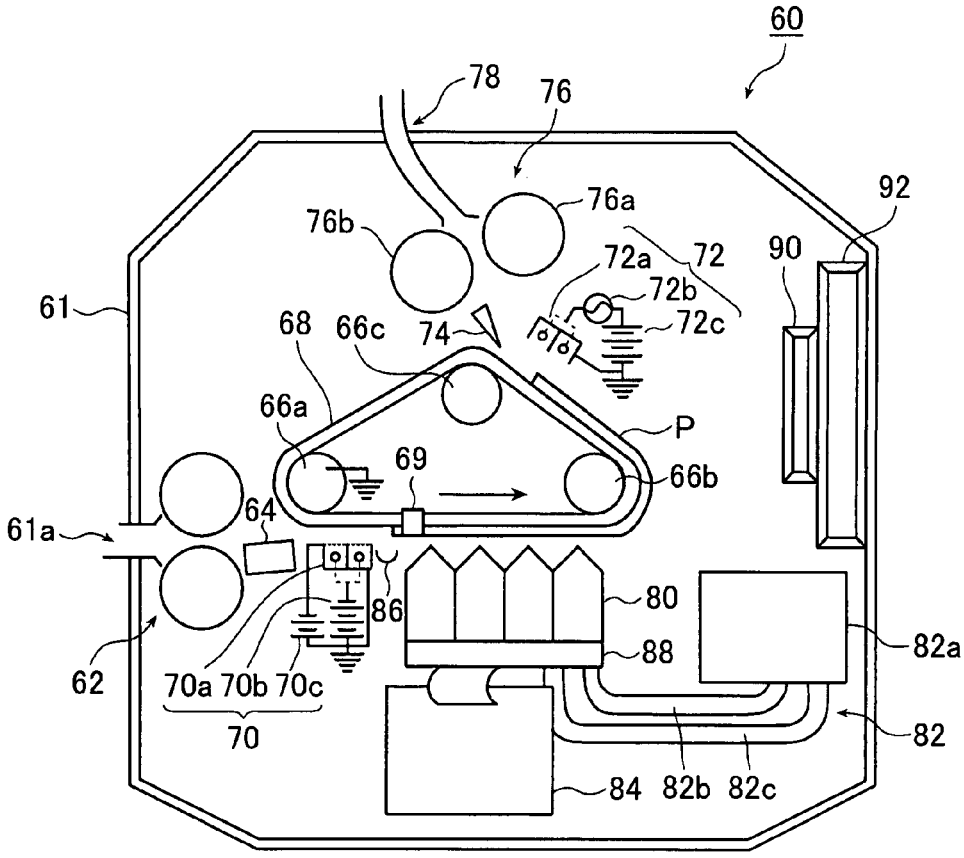
FIG. 9A is a conceptual view of an embodiment of an ink jet recording apparatus including the ink jet head according to the present invention.

FIG. 9A is a conceptual diagram of an embodiment of an ink jet recording apparatus according to the second aspect of the present invention which utilizes the ink jet head according to the first aspect of the present invention.

An ink jet recording apparatus (hereinafter, referred to as a printer) 60 shown in FIG. 9A is an apparatus for performing four-color one-side printing on the recording medium P. The printer 60 comprises conveying means for the recording medium P, image recording means, and solvent collecting means, all of which are accommodated in a casing 61.

The conveying means is moving means for moving the recording medium relatively to the ink jet head, and includes a feed roller pair 62, a guide 64, rollers 66*a*, 66*b*, and 66*c*, a conveyor belt 68, conveyor belt position detecting means 69, electrostatic attraction means 70, electrostatic elimination means 72, separation means 74, fixing/conveying means 76, and a guide 78. The image recording means includes a head unit 80, an ink circulation system 82, a head driver 84, and recording medium position detecting means 86. The solvent collecting means includes a discharge fan 90 and a solvent collecting unit 92.

In the conveying means for the recording medium P, the feed roller pair 62 is a conveying roller pair disposed in the vicinity of a feeding port 61*a* provided in a side surface of the casing 61. The feed roller pair 62 feeds the recording medium P fed from a not shown paper cassette to the conveyor belt 68 (specifically, a portion of the conveyor belt 68 supported by the roller 66*a*). The guide 64 is disposed between the feed roller pair 62 and the roller 66*a* for supporting the conveyor belt 68 and guides the recording medium P to the conveyor belt 68.

Foreign matter removal means for removing foreign matter such as dust or paper powder adhered to the recording medium P is preferably disposed in the vicinity of the feed roller pair 62.

As the foreign matter removal means, one or more of known methods including non-contact removal methods such as suction removal, blowing removal and electrostatic removal, and contact removal methods such as removal using a blush, a roller, etc., may be used in combination. It is also possible that the feed roller pair 62 is composed of a slightly adhesive roller, a cleaner is prepared for the feed roller pair 62, and foreign matter such as dust or paper powder is removed when the feed roller pair 62 feeds the recording medium P.

The conveyor belt 68 is an endless belt stretched around the three rollers 66*a*, 66*b*, and 66*c*. At least one of the rollers 66*a*, 66*b*, and 66*c* is connected to a not shown drive source to rotate the conveyor belt 68.

At the time of image recording by the head unit 80, the conveyor belt 68 functions as conveying means for scanning the recording medium P and also as a platen for holding the recording medium P. After the end of image recording, the conveyor belt 68 further conveys the recording medium P to the fixing/conveying means 76. Therefore, the conveyor belt 68 is preferably made of a material which is excellent in dimension stability and has durability. For example, the conveyor belt 68 is made of a metal, a polyimide resin, a fluorocarbon resin, other resin, or a complex thereof.

In the illustrated embodiment, the recording medium P is held on the conveyor belt 68 under electrostatic attraction. In correspondence with this, the conveyor belt 68 has insulating properties on a side (i.e., front face) on which the recording medium P is held, and conductive properties on the other side (i.e., rear face) on which the belt 68 contacts the rollers 66*a*, 66*b*, and 66*c*. Further, in the illustrated embodiment, the roller 66*a* is a conductive roller, and the rear face of the conveyor belt 68 is grounded via the roller 66*a*.

In other words, when the conveyor belt 68 holds the recording medium P, the conveyor belt 68 also functions as the counter electrode 24 including the electrode substrate 24*a* and the insulating sheet 24*b* shown in FIG. 1A.

A belt having a metal layer and an insulating material layer manufactured by a variety of methods, such as a metal belt coated with any of the above described resin materials, for example, fluorocarbon resin on the front face, a belt obtained by bonding a resin sheet to a metal belt with an adhesive or the like, and a belt obtained by vapor-depositing a metal on the rear face of a belt made of the above-mentioned resin, may be used as the conveyor belt 68.

The conveyor belt 68 preferably has the flat front face contacting the recording medium P, whereby satisfactory attraction properties of the recording medium P can be obtained.

Meandering of the conveyor belt 68 is preferably suppressed by a known method. An example of a meandering suppression method is that the roller 66*c* is composed of a tension roller, a shaft of the roller 66*c* is inclined with respect to the shafts of the rollers 66*a* and 66*b* in response to an output of the conveyor belt position detecting means 69, that is, a position of the conveyor belt 68 detected in a width direction, thereby changing a tension at both ends of the conveyor belt 68 in the width direction to suppress the meandering. The rollers 66*a*, 66*b*, and 66*c* may have a taper shape, a crown shape, or other shape to suppress the meandering.

The conveyor belt position detecting means 69 suppresses the meandering of the conveyor belt etc. in the above manner and detects the position of the conveyor belt 68 in the width direction to regulate the recording medium P to situate at a predetermined position in the scanning/conveying direction at the time of image recording. Known detecting means such as a photo sensor may be used.

The electrostatic attraction means 70 charges the recording medium P to a predetermined bias voltage with respect to the head unit 80 (i.e., the above described ink jet head), and charges the recording medium P to have a predetermined potential such that the recording medium P is attracted to and held on the conveyor belt 68 under electrostatic force.

In the illustrated embodiment, the electrostatic attraction means 70 includes a scorotron charger 70*a* for charging the recording medium P, a high voltage power source 70*b* connected to the scorotron charger 70*a*, and a bias voltage source 70*c*. The corona wire of the scorotron charger 70*a* is connected to the terminal of the high voltage power source 70*b* on the negative side, and the terminal of the high voltage power source 70*b* on the positive side and the metallic shield case of the scorotron charger 70*a* are grounded. The terminal of the bias voltage source 70*c* on the negative side is connected to the grid electrode of the scorotron charger 70*a*, and the terminal of the bias voltage source 70*c* on the positive side is grounded.

While being conveyed by the feed roller pair 62 and the conveyor belt 68, the recording medium P is charged to a negative bias voltage by the scorotron charger 70*a* connected to the high voltage power source 70*b* and electrostatically attracted to the insulating layer of the conveyor belt 68.

Note that the conveying speed of the conveyor belt 68 when charging the recording medium P may be in a range where the charging is performed with stability, so the speed may be the same as, or different from, the conveying speed at the time of image recording. Also, the electrostatic attraction means may act on the same recording medium P several times by circulating the recording medium P several times on the conveyor belt 68 for uniform charging.

In the illustrated embodiment, the electrostatic attraction and the charging for the recording medium P are performed in the electrostatic attraction means 70, but the electrostatic attraction means and the charging means may be provided separately.

The electrostatic attraction means is not limited to the scorotron charger 70*a* of the illustrated example, a scorotron charger, a solid-state charger, an electrostatic discharge needle, and various means and methods can be employed. As will be described in detail later, another method may be adapted in which at least one of the rollers 66*a*, 66*b*, and 66*c* is composed of a conductive roller or a conductive platen is disposed on the rear side of the conveyor belt 68 in a recording position for the recording medium P (i.e., side opposite to the recording medium P), and the conductive roller or the conductive platen is connected to the negative high voltage power source, thereby forming the electrostatic attraction means 70. Alternatively, it is also possible that the conveyor belt 68 is composed of an insulating belt and the conductive roller is grounded to connect the conductive platen to the negative high voltage power source.

The conveyor belt 68 conveys the recording medium P charged by the electrostatic attraction means 70 to the position where the head unit 80 to be described later is located.

The ink jet head of the present invention is used as the head unit 80. The head unit 80 ejects ink droplets in accordance with image data to thereby record an image on the recording medium P. As described above, the ink jet head of the present invention uses a charge potential of the recording medium P for the bias voltage and applies a drive voltage to the ejection electrodes 18, whereby the drive voltage is superimposed on the bias voltage and the ink droplets R are ejected to record an image on the recording medium P. At this time, the conveyor belt 68 may be provided with heating means to increase the temperature of the recording medium P, thus promoting fixing of the ink droplets R on the recording medium P and further suppressing ink bleeding, which leads to improvement in image quality.

Image recording using the head unit 80 and the like will be described in detail below.

The recording medium P on which the image has been formed is subjected to electrostatic elimination by the electrostatic elimination means 72 and separated from the conveyor belt 68 by the separation means 74 and thereafter, conveyed to the fixing/conveying means 76.

In the illustrated embodiment, the electrostatic elimination means 72 is a so-called AC scorotron charger, which includes a scorotron charger 72*a*, an AC voltage source 72*b*, and a high voltage power source 72*c*. The corona wire of the scorotron charger 72*a* is connected to the high voltage power source 72*c* through the AC voltage source 72*b*, and the other end of the high voltage power source 72*c* and the metallic shield case of the scorotron charger 72*a* are grounded. In addition thereto, various means and methods, for example, a scorotron charger, a solid-state charger, and an electrostatic discharge needle can be used for electrostatic elimination means. Also, as in the electrostatic attraction means 70 described above, a structure using a conductive roller or a conductive platen can also be preferably utilized.

A known technique using a separation blade, a counter-rotating roller, an air knife or the like is applicable to the separation means 74.

The recording medium P separated from the conveyor belt 68 is sent to the fixing/conveying means 76 where the image formed by means of the ink jet recording is fixed. A pair of rollers composed of a heat roller 76*a* and a conveying roller 76*b* is used as the fixing/conveying means 76 to heat and fix the recorded image while nipping and conveying the recording medium P.

The recording medium P on which the image has been fixed is guided by the guide 78 and delivered to a not shown delivered paper tray.

In addition to the heat roll fixation described above, examples of the heat fixing means include irradiation with infrared rays or using a halogen lamp or a xenon flash lamp, and general heat fixation such as hot air fixation using a heater. Further, in the fixing/conveying means 76, it is also possible that the heating means is used only for heating, and the conveying means and the heat fixing means are provided separately.

It should be noted that in the case of heat fixation, when a sheet of coated paper or laminated paper is used as the recording medium P, there is a possibility of causing a phenomenon called "blister" in which irregularities are formed on the sheet surface since moisture inside the sheet abruptly evaporates due to rapid temperature increase. To avoid this, it is preferable that a plurality of fixing devices be arranged, and at least one of power supply to the respective fixing devices and a distance from the respective fixing devices to the recording medium P be changed such that the temperature of the recording medium P gradually increases.

The printer 60 is preferably constructed such that no component will come in contact with the image recording surface of the recording medium P at least during a process from the image recording with the head unit 80 to the completion of fixation with the fixing/conveying means 76.

Further, the movement speed of the recording medium P at the time of fixation with the fixing/conveying means 76 is not particularly limited, and may be the same as, or different from, the speed of the recording medium conveyed by the conveyor belt 68 at the time of image formation. When the movement speed is different from the conveying speed at the time of image formation, it is also preferable to provide a speed buffer for the recording medium P immediately before the fixing/conveying means 76.

Image recording using the printer 60 will be described in detail below.

As described above, the image recording means of the printer 60 uses the ink jet head of the present invention, and includes the head unit 80 for ejecting ink, the ink circulation system 82 that supplies the ink Q to the head unit 80 and recovers the ink Q from the head unit 80, the head driver 84 that drives the head unit 80 based on an output image signal from a not-shown external apparatus such as a computer or a raster image processor (RIP), and the recording medium position detecting means 86 for detecting the recording medium P in order to determine an image recording position on the recording medium P.

Figure 9B:
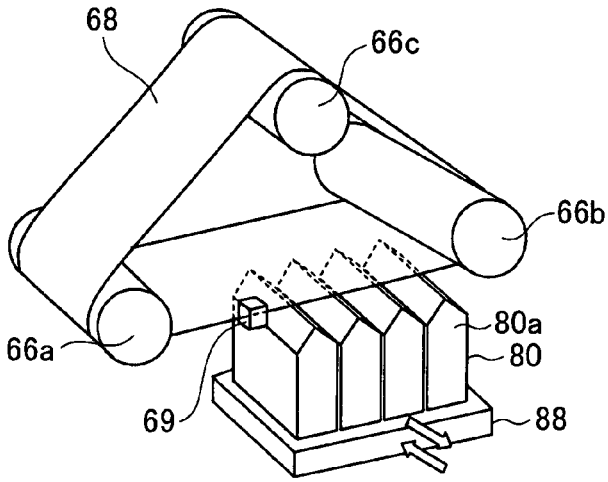
FIG. 9B is a perspective view schematically showing a head unit of the ink jet recording apparatus shown in FIG. 9A and recording medium conveying means in a periphery of the head unit.

FIG. 9B is a perspective view schematically showing the head unit 80 and the conveying means (i.e., moving means) for the recording medium P on the periphery thereof.

The head unit 80 includes four ink jet heads 80*a* for four colors of cyan (C), magenta (M), yellow (Y), and black (K) for recording a full-color image, and records an image on the recording medium P conveyed by the conveyor belt 68 at a predetermined speed by ejecting the ink Q supplied by the ink circulation system 82 as the ink droplets R in accordance with signals from the head driver 84 to which image data was supplied.

The ink jet head 80*a* has a structure similar to the above described ink jet head 10.

In the illustrated embodiment, each ink jet head 80*a* is a line head including ejection ports 28 disposed in the entire area in the width direction of the recording medium P. The ink jet head 80*a* is preferably a multichannel head as shown in FIG. 2, which has multiple nozzle lines arranged in a staggered shape.

Therefore, in the illustrated embodiment, while the recording medium P is held on the conveyor belt 68, the recording medium P is conveyed to pass over the head unit 80 once. In other words, conveying of the recording medium P for scanning is performed only once. Then, an image is formed on the entire surface of the recording medium P. Therefore, image recording (drawing) at a higher speed is possible compared to serial scanning by the ejection head.

Note that the ink jet head of the present invention is also applicable to a so-called serial head (i.e., shuttle type head), and therefore the head used in the printer 60 may be a serial head.

In this case, the head unit 80 is structured such that a line (which may have a single line or multichannel structure) of the ejection ports 28 for each ink jet head agrees with the conveying direction of the conveyor belt 68, and the head unit 80 is provided with scanning means which scans the recording medium P in a direction perpendicular to the conveying direction of the recording medium P. Any known scanning means can be used for scanning.

Image recording may be performed as in a usual shuttle type ink jet printer. In accordance with the length of the line of the ejection ports 28, the recording medium P is conveyed intermittently by the conveyor belt 68, and in synchronization with this intermittent conveying, the recording medium P is scanned by the head unit 80 when the recording medium P is at rest, whereby an image is formed on the entire surface of the recording medium P.

As described above, the image formed by the head unit 80 on the entire surface of the recording medium P is then fixed by the fixing/conveying means 76 while the recording medium P is nipped and conveyed by the fixing/conveying means 76.

In FIG. 9A, the head driver 84 receives image data from a system control unit (not shown) that receives image data from an external apparatus and performs various processing on the image data, and drives the head unit 80 based on the image data.

The system control unit color-separates the image data received from the external apparatus such as a computer, an RIP, an image scanner, a magnetic disk apparatus, or an image data transmission apparatus. The system control unit then performs division computation into an appropriate number of pixels and an appropriate number of gradations to generate image data with which the head driver 84 can drive the head unit 80 (i.e., ink jet head). Also, the system control unit controls timings of ink ejection by the head unit 80 in accordance with conveying timings of the recording medium P by the conveyor belt 68. The ejection timings are controlled using an output from the recording medium position detecting means 86 or an output signal from an encoder arranged for the conveyor belt 68 or a drive means of the conveyor belt 68.

The recording medium position detecting means 86 detects the recording medium P being conveyed to a position at which an ink droplet is ejected from the head unit 80, and known detecting means such as photo sensor can be used.

When the number of the ejection portions (i.e., the number of channels) to be controlled is large as in the case where a line head is used, the head driver 84 may separate rendering to employ a known method such as resistance matrix type drive method or resistance diode matrix type drive method. Thus, it is possible to reduce the number of ICs used in the head driver 84 and suppress the size of a control circuit while lowering costs.

The ink circulation system 82 allows each ink Q to flow in the ink flow path 30 (see FIG. 1A) of the corresponding ink jet head 80*a* of the head unit 80. The ink circulation system 82 includes: an ink circulation unit 82*a* having ink tanks, pumps, replenishment ink tanks (not shown), etc. for respective four colors (C, M, Y, K) of ink; an ink supply system 82*b* for supplying the ink Q of each color from the corresponding ink tank of the ink circulation unit 82*a* to the ink flow path 30 of the ink jet head 80*a* of the corresponding head unit 80; and an ink recovery system 82*c* for recovering the ink Q from the ink flow path 30 of each ink jet head 80*a* of the head unit 80 into the ink circulation unit 82*a*.

An arbitrary system may be used for the ink circulation system 82 as long as this system supplies the ink Q of each color from the ink tank to the head unit 80 through the ink supply system 82*b* and recovers the ink Q of each color from the head unit 80 to the ink tank through the ink recovery system 82*c* to allow ink circulation.

Each ink tank contains the ink Q of corresponding color and the ink Q is supplied to the head unit 80 by means of a pump. Ejection of the ink from the head unit 80 lowers the concentration of the ink circulating in the ink circulation system 82. Therefore, it is preferable in the ink circulation system 82 that the ink concentration be detected by an ink concentration detecting unit and the ink tank be replenished as appropriate with ink from the replenishment ink tank to keep the ink concentration in a predetermined range.

Moreover, the ink tank is preferably provided with an agitator for suppressing precipitation/aggregation of solid components of ink and an ink temperature control unit for suppressing ink temperature change. The reason thereof is as follows. If the temperature control is not performed, the ink temperature changes due to ambient temperature change or the like. Thus, physical properties of ink are changed, which causes the dot diameter change. As a result, a high quality image may not be recorded in a consistent manner.

A rotary blade, an ultrasonic transducer, a circulation pump, or the like may be used for the agitator.

Any known method can be used for ink temperature control, as exemplified by a method in which the ink temperature is controlled with the ink temperature control unit which includes a heating element and/or a cooling element such as a heater and Peltier element provided in the head unit 80, the ink tank, an ink supply line or the like, and a temperature sensor like a thermostat. When arranged inside the ink tank, the temperature control unit is preferably arranged with the agitator such that temperature distribution in the ink tank is kept constant. Then, the agitator for keeping the concentration distribution in the tank constant may double as the agitator for suppressing the precipitation/aggregation of solid components of ink.

As described above, the printer 60 comprises the solvent collecting means including the discharge fan 90 and the solvent collecting unit 92. The solvent collecting means collects the carrier liquid evaporated from the ink droplets ejected on the recording medium P from the head unit 80, in particular, the carrier liquid evaporated from the recording medium P at the time of fixing an image formed of the ink droplets.

The discharge fan 90 sucks air inside the casing 61 of the printer 60 to blow the air to the solvent collecting unit 92.

The solvent collecting unit 92 is provided with a solvent vapor adsorbent. This solvent vapor adsorbent adsorbs solvent vapor containing gaseous solvent components aspirated by the discharge fan 90, and the gas is exhausted to the outside of the casing 61 of the printer 60 after the solvent has been adsorbed and collected. Various active carbons are preferably used as the solvent vapor absorber.

While the electrostatic ink jet recording apparatus for recording a color image using the ink of four colors including C, M, Y, and K has been described, the present invention should not be construed restrictively; the apparatus may be a recording apparatus for a monochrome image or an apparatus for recording an image using an arbitrary number of other colors such as pale color ink and special color ink, for example. In such a case, the head units 80 and the ink circulation systems 82 whose number corresponds to the number of ink colors are used.

Furthermore, in the above embodiments, the ink jet recording system in which the ink droplets R are ejected by positively charging the colorant particles in the ink and charging the recording medium P or the counter electrode on the rear side of the recording medium P to the negative high voltage has been described. However, the present invention is not limited to this. Contrary to the above, the ink jet image recording may be performed by negatively charging the colorant particles in the ink and charging the recording medium or the counter electrode to the positive high voltage. When the charged color particles have the polarity opposite to that in the above-mentioned case, it is sufficient that the applied voltage to the electrostatic attraction means, the counter electrode, the drive electrode of the ink jet head, and the like are changed to have the polarity opposite to that in the above-mentioned case.

As described above, the ink jet head of the present invention is preferably used in the above described electrostatic ink jet recording system, but is not limited thereto. The ink jet head of the present invention may be used in various ink jet recording systems such as a piezo system and a thermal system.

The ink jet head of the first aspect of the preset invention and the ink jet recording apparatus of the second aspect of the present invention are basically constructed in the above described manner.

Next, the ink jet head of the third aspect of the preset invention and the ink jet recording apparatus of the fourth aspect of the present invention will be explained referring to FIGS. 10A to 19.

First, the configuration of the ink jet head shown in FIGS. 10A and 10B will be explained.

Figure 10A:
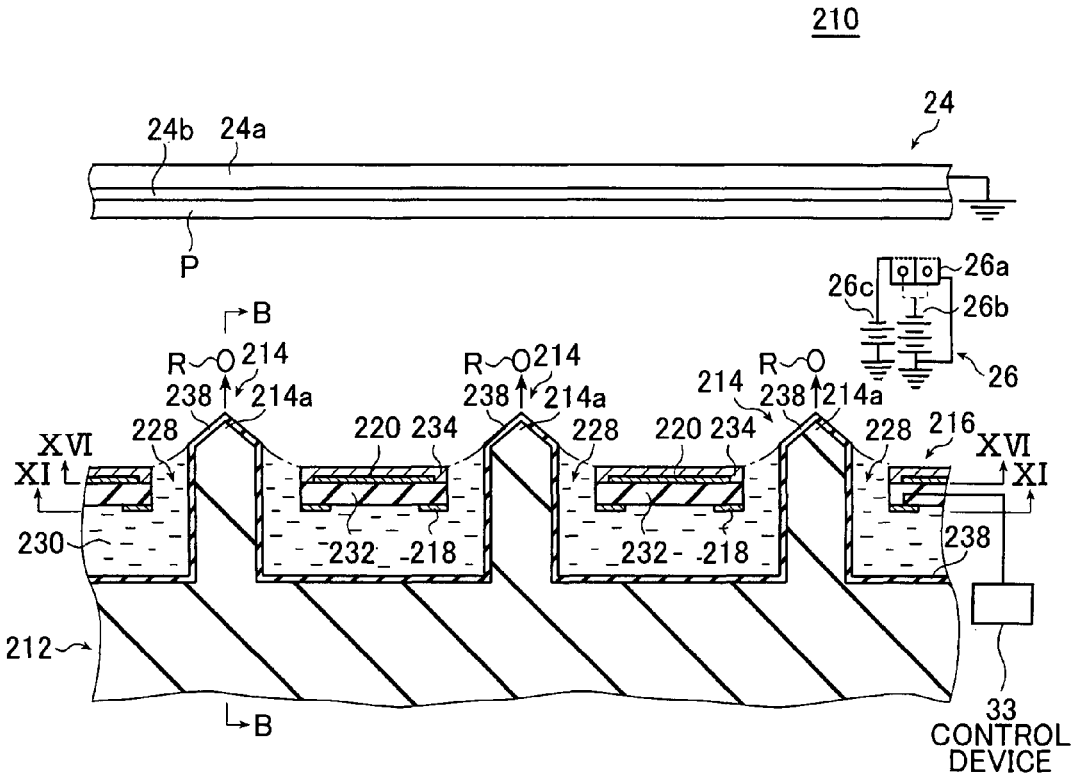
FIG. 10A is a schematic view of a cross section of a schematic configuration of yet another embodiment of the inkjet head of the present invention.
Figure 10B:
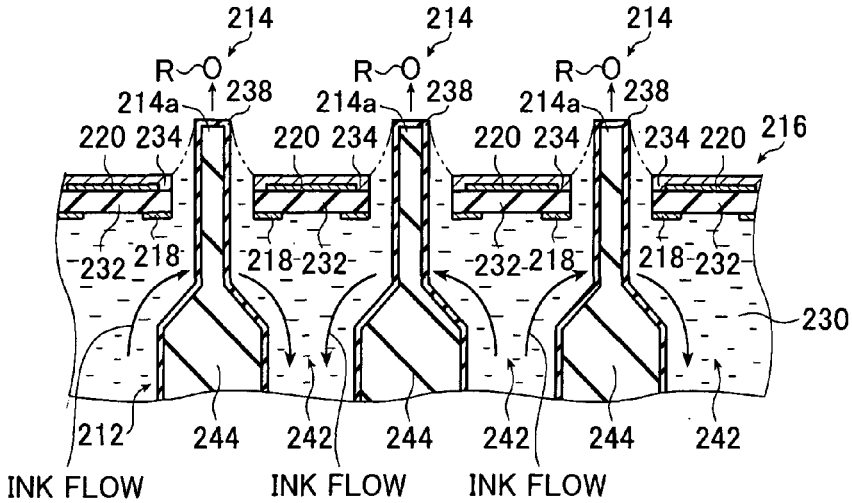
FIG. 10B is a cross-sectional view taken along line B-B of FIG. 10A.

FIG. 10A is a view schematically showing a cross section of a schematic configuration of the ink jet head according to the third aspect of the preset invention, and FIG. 10B is a cross sectional view taken along line B-B in FIG. 10A.

Regarding the configurations of a resin-made head substrate on which ink guides are formed and an ejection port substrate in which multiple ejection ports are formed, an ink jet head 210 shown in FIG. 10A is different from the ink jet head 10 shown in FIG. 1A. Specifically, in the ink jet head 210, a resin-made head substrate 212 on which ink guides 214 are formed comprises a protective layer (i.e., DLC layer) 238, ink guide dikes are not formed on the head substrate 212, and an ejection port substrate 216 in which multiple ejection ports 228 are formed does not comprise a protective layer. On the other hand, in the ink jet head 10, the resin-made head substrate 12 does not comprise a protective layer, the ink guides dikes 40 which are provided on the base portions of the ink guides 14 are formed on the head substrate 12, and the ejection port substrate 16 in which the multiple ejection ports 28 are formed comprises a protective layer. However, the ink jet head 210 has configuration and function similar to those of the ink jet head 10 except for the above described points, so the same components are denoted by the same reference numerals, and the explanations thereof are omitted. Further, an ejection electrode 218, a shield electrode 220, the opening 36 in the shield electrode 220, the ejection port 228, an insulating substrate 232, and an insulating layer 234 of the ejection port substrate 216 of the ink jet head 210 are approximately similar to the ejection electrode 18, the shield electrode 20, the opening 16 in the shield electrode 20, the ejection port 28, the insulating substrate 32, and the insulating layer 34 of the ejection port substrate 16 of the ink jet head 10, respectively, so the explanations thereof are also omitted here.

As shown in FIG. 10A, the ink jet head 210 comprises the resin-made head substrate 212 on which the ink guides 214 are formed, and the ejection port substrate 216 in which a plurality of ejection ports 228 are formed. The ejection electrodes 218 are disposed on the ejection port substrate 216 so as to surround the respective ejection ports 228. At a position facing the surface (i.e., upper surface in FIG. 1A) of the ink jet head 210 on the ink ejection side, the counter electrode 24 supporting the recording medium P is disposed.

The head substrate 212 and the ejection port substrate 216 are arranged so that they face each other with a predetermined distance therebetween. By a space formed between the head substrate 212 and the ejection port substrate 216, an ink flow path 230 for supplying ink to each ejection port 228 is formed. In the ink jet head 210 in this embodiment, the ink Q flows in a vertical direction in the ink flow path 230 as indicated by arrows in FIG. 10B (i.e., in a direction perpendicular to the paper surface of FIG. 10A).

In FIGS. 10A and 10B, for easy-to-understand illustration of the configuration of the ink jet head 210, only three of the multiple ejection ports which are adjacent to each other are shown.

In the ink jet head 210 of this embodiment, similarly to the case of the ink jet head 10 in the above described embodiments, for example, the ink Q is used in which colorant particles containing colorant such as pigment, and having electrical charges are dispersed in an insulative carrier liquid. Also, an electric field is generated between the ejection port 228 and the ink guide 214, and the counter electrode 24 through application of a drive voltage to the ejection electrodes 218, and the ink aggregated at the tip end of the ink guide 214 is ejected by means of electrostatic force. Further, by turning ON/OFF the drive voltage applied to the ejection electrode 218 in accordance with image data (ejection ON/OFF), ink droplets are ejected from the ejection port 228 in accordance with the image data and an image is recorded on the recording medium P.

In order to perform image recording at a higher density and at high speed, the ink jet head 210 has a multichannel structure in which multiple ejection ports 228 are arranged in a two-dimensional manner.

Figure 11:
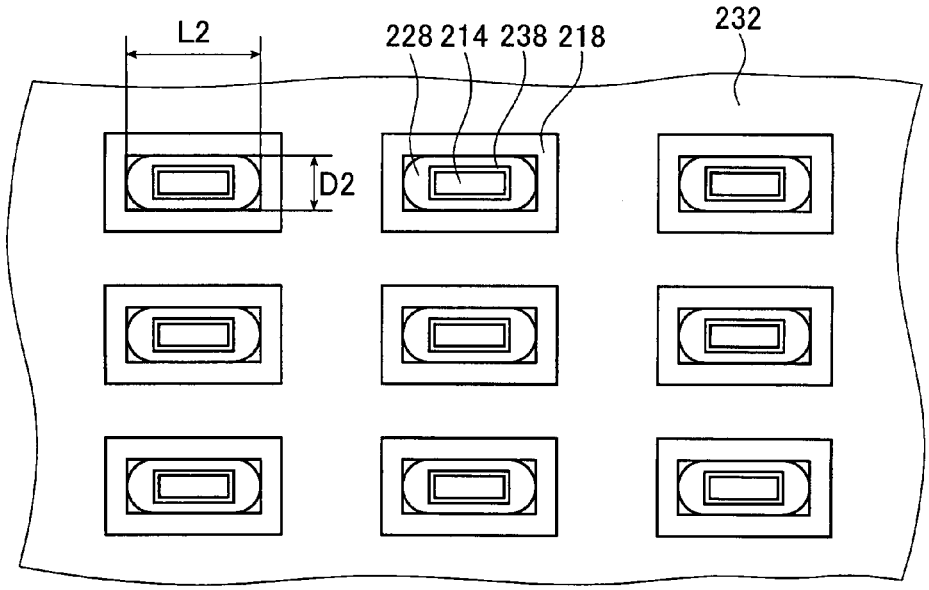
FIG. 11 is a cross-sectional view taken along line XI-XI of FIG. 10A.

FIG. 11 is a cross sectional view taken along line XI-XI in FIG. 10A, and partially and schematically shows a state in which multiple ejection ports are two-dimensionally formed in the ink jet head 210.

In the ink jet head 210 of this embodiment, similarly to the case of the ink jet head 10 in the above described embodiments, it is possible to freely choose the number of the ejection ports 228, physical arrangement position thereof and the like. The detailed explanation of the arrangement of the ejection ports 228 is omitted. In addition, similarly to the case of the ink jet head in the first aspect, the ink jet head of the third aspect of the present invention can cope with both of a monochrome recording apparatus and a color recording apparatus.

In the ink jet head 210 of this embodiment, the ejection ports 228 are arranged so that the arrangement interval between adjacent ejection ports 228 is 2 mm or less. Note that the arrangement interval between adjacent ejection ports 228 is the distance between the centers of the adjacent ejection ports 228.

The arrangement interval between adjacent ejection ports 228 is 2 mm or less, so that the ejection ports 228 are arranged at high density. Thus, the ink jet head 210 can be compact, which makes it possible to increase the number of head parts produced in one process. Further, it becomes possible to reduce the amount of materials required for producing one head, which makes it possible to reduce the production cost. Consequently, the ink jet head 210 can be produced at a lower cost.

The configuration of the ink jet head 210 shown in FIGS. 10A, 10B, and 11 will be explained in more detail.

Figure 12:
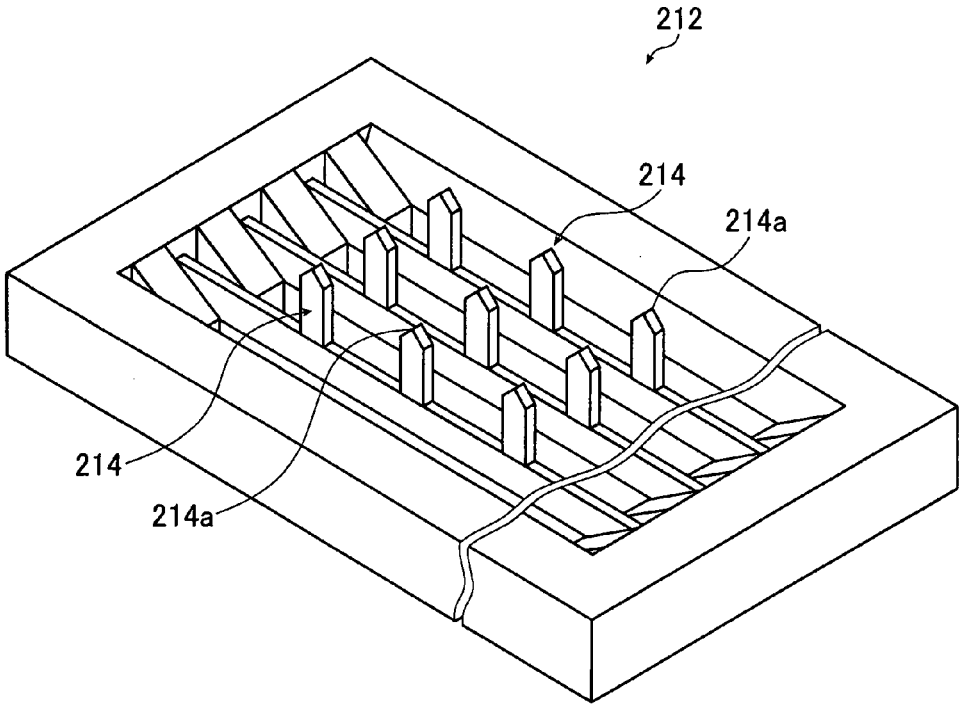
FIG. 12 is a schematic perspective view of an embodiment of a head substrate on which ink guides of the ink jet head shown in FIG. 10A are formed.
Figure 13A:
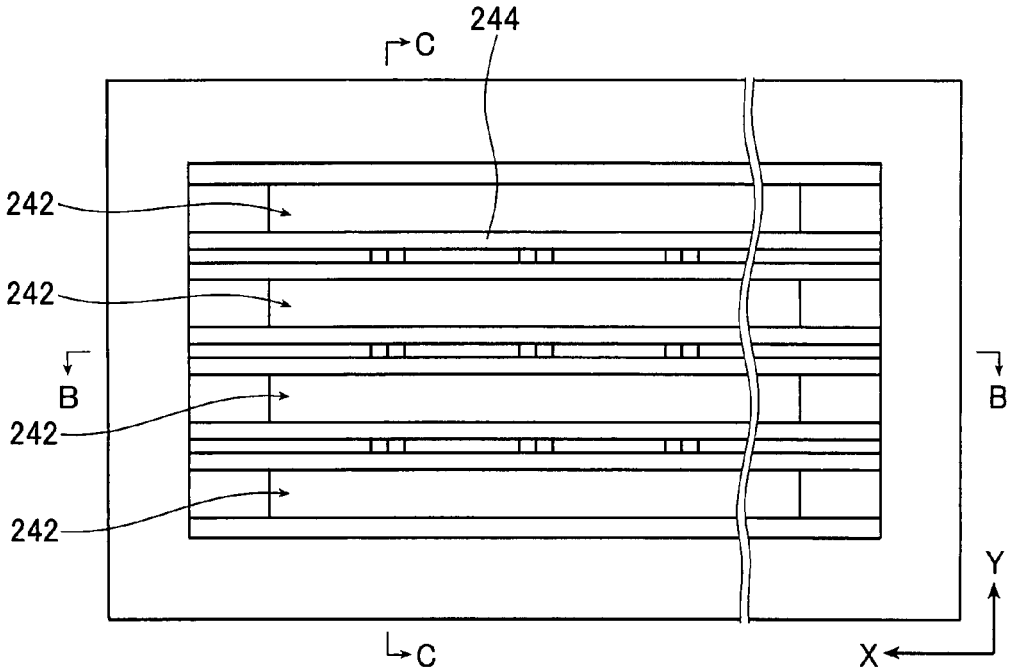
FIG. 13A is a schematic plan view of the head substrate shown in FIG. 12.
Figure 13B:
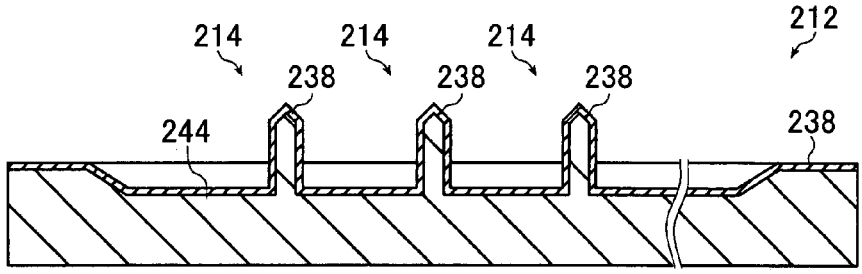
FIG. 13B is a cross-sectional view taken along line B-B of FIG. 13A.
Figure 13C:
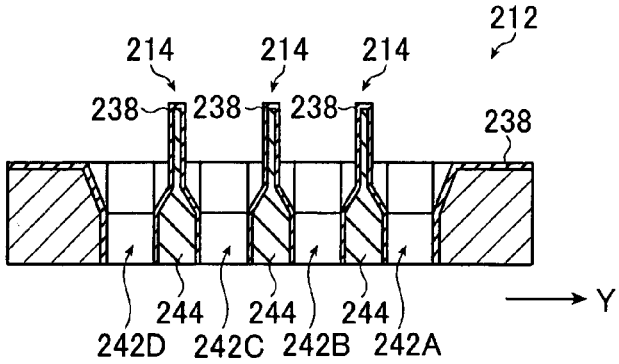
FIG. 13C is a cross-sectional view taken along line C-C of FIG. 13A.

First, the head substrate 212 will be explained. FIG. 12 shows a schematic perspective view of the head substrate 212. FIG. 13A shows a schematic plan view of the head substrate 212. FIGS. 13B and 13C show cross sectional views taken along lines B-B and C-C in FIG. 13A, respectively.

The head substrate 212 is a resin substrate having a rectangular outline. As shown in FIG. 13A, four elongated rectangular shaped openings 242 are formed in the middle of the head substrate 212. Each opening 242 is formed to extend in a longitudinal direction of the head substrate 212 (i.e., direction shown by X in FIG. 13A), and penetrates the head substrate 212 in the thickness direction thereof. Three guide bases 244 are formed each between adjacent openings 242, and they extend in parallel with each other in the longitudinal direction of the head substrate 212. A plurality of minute ink guides 214 are formed at constant intervals on the upper surface of each guide base 244. The number of the guide bases 244 formed is determined corresponding to the number of lines of the ejection ports 228 in the ejection substrate 216.

The lower part of the head substrate 212 having a structure shown in FIGS. 12 and 13B is connected to a not shown ink supply source. In the ink jet head including the head substrate 212, the ink is supplied to the ejection ports 228 in the ejection substrate 216 through the openings 242. That is, as shown in FIGS. 10A and 10B, the ink flow path 230 is formed by the space formed between the head substrate 212 and the ejection port substrate 216, and the openings 242 formed in the head substrate 212. In the head substrate 212 shown in FIG. 13C, the ink is supplied from downward to upward in the openings 242A and 242C. The ink supplied passes over the upper portions of the guide bases 244 so as to get around the ink jet heads 214. Thereafter, the ink is flown into the adjacent openings 242B and 242D to be recovered from the lower sides thereof. In this manner, the ink is circulated between the not shown ink supply source and the ejection ports 228 of the ejection port substrate 216.

As shown in FIG. 10B, the ink flows in a vertical direction of the openings 242 in the head substrate 212 to be supplied to the ejection ports 228 in the ejection port substrate 216, however, the ink may be supplied to the ejection ports 228 by causing the ink to flow in a direction parallel to the direction in which the guide bases 244 extend. Each opening 242 may not penetrate the head substrate 212, and may have finite depth so that the bottom surface thereof is formed on the head substrate 212. In this case, connection holes may be provided in the lower surface or side surface of the head substrate so that the openings 242 are connected to the ink supply source, and the ink may be caused to flow into the openings 242 through the connection holes to be supplied to the ejection ports 228.

Four openings 242 are formed in the head substrate 212, and three guide bases 244 are provided corresponding to the number of the lines of the ejection ports 228 in the ejection port substrate 216, however, the present invention is not limited thereto. For example, when the number of the lines of the ejection ports 228 is one, only one guide base may be provided, and when the number of the lines of the ejection ports 228 is two, two guide bases may be provided. When the number of the lines of the ejection ports 228 is four or more, four or more guide bases 244 may be provided at the intervals corresponding to the intervals of the lines of the ejection ports 228.

As shown in FIG. 12 and FIGS. 13A to 13C, the ink guides 214 are provided on the upper surface of each guide base 244. In this embodiment, the ink guides 214 are integrally formed on each guide base 244. In this embodiment, when the ink jet head 210 is assembled by combining the head substrate 212 and the ejection port substrate 216, each ink guide 214 has a predetermined height so that it extends through the ejection port 228 formed in the ejection port substrate 216, and the tip end portion 214*a* thereof projects above the surface of the ejection port substrate 216 on the recording medium P side. Each ink guide 214 is capable of guiding the ink to the tip end portion 214*a* thereof and stabilizing the meniscus of the ink at the ejection port 228 in the ejection port substrate 216.

As shown in FIG. 10A, the tip end of the ink guide 214, when viewed in a front view, has approximately a triangular shape with the tip end as a vertex. The angle of the tip end of the ink guide 214 is not specifically limited, however, in order to improve the responsivity and approximate the shape of the tip end of the ink guide 214 to a meniscus shape, it is preferably 60° to 100°.

In the third aspect of the present invention, the head substrate 212 includes a diamond like carbon (DLC) layer as the protective layer 238 on the surface facing the ejection port substrate 216. That is, in the illustrated embodiment, the protective layer 238 such as a DLC layer covers the surfaces of the guide bases 244 of the head substrate 212, the surfaces of the ink guides 214, and the surface of the head substrate 212 on which the ink guides 214 are not formed. The protective layer 238 is provided on the surface of the head substrate 212 so as to cover the surfaces of the ink guides 214, so the strength of the ink guides 214 is improved. Whereby, deformation of the ink guides 214 is prevented from occurring even when a brush or the like hits the ink guides 214 during maintenance.

In the present invention, the protective layer 238 such as the DLC layer needs to cover at least the surfaces of the ink guides 214. However, preferably, in addition to the surfaces of the ink guides 214, the surfaces of the guide bases 244 on which the ink guides 214 are formed are also covered with the protective layer 238. More preferably, in addition to the surfaces of the ink guides 214 and the guide bases 244, the surface of the head substrate 212 on which the ink guides 214 are not formed is also covered with the protective layer 238.

DLC is used as a material composing the protective layer 238, however, the third aspect of the present invention is not limited thereto, and any material can be used for the protective layer so long as the material has hardness enough to increase the strength of the ink guide by coating it and further has durability and ink resistance. In addition to DLC, for example, silicon carbide (SiC), and metal such as gold, copper, chromium, and nickel are also preferable as a material for the protective layer 238.

In an electrostatic ink jet printer in which an electric field is formed at the tip end of a resin-made ink guide to thereby eject ink as in this embodiment, DLC having dielectric constant approximately equal to that of the ink guide is preferably used as a material for the protective layer 238. By using DLC having dielectric constant approximately equal to that of the ink guide for the protective layer 238, the protective layer 238 has little effect on the formation of the electric field on the periphery of the ink guide.

The protective layer 238 has a thickness of, preferably, 0.1 μm or more for providing enough strength to the ink guide, more preferably, 1 μm or more. The ink guide is minute, so if the protective layer 238 is formed too thick on the surface of the ink guide, reproducibility of the shape of the ink guide is deteriorated, and the tip end of the ink guide becomes obtuse. Consequently, the electric field strength may decline, and a meniscus of the ink may not be formed appropriately. Therefore, the thickness of the protective layer 238 is preferably 5 μm or less.

In this embodiment, the protective layer 238 is formed on the surface of the resin-made head substrate 212 constituting the wall surface of the ink flow path 230, so the strength of the ink guide 214 increases and the friction force between the wall surface of the ink flow path 230 and the ink decreases. Further, it is prevented that the inside of the ink flow path 23*b* becomes dirty and ink clogging occurs.

Further, in this embodiment, the protective layer 238 is directly formed on the surface of the head substrate 212, however, a foundation layer may be provided between the head substrate 212 and the protective layer 238 for enhancing adhesiveness of the protective layer 238 to the head substrate 212.

In the above embodiments, the ink guide 214 is formed to have a plate shape having a constant thickness as a whole. Also, as viewed in a front view, the ink guide 214 has approximately a triangular shape with its tip end as a vertex. However, the ink guide 214 is not limited to have the above shape, and can be formed in various shapes. For example, the ink guide 214 may be formed in a circular cylindrical shape, a pyramid shape, or a circular cone shape. The tip end of the ink guide 214 may be formed in the shape shown in FIGS. 14A to 14C or FIGS. 15A to 15C. The head substrate including the ink guide of such various shapes can be produced with ease by using a later described nanoimprint method.

In the third aspect of the present invention, the protective layer is formed on the surface of the ink guide of any shape to thereby increase the strength of the ink guide. That is, the protective layer having a predetermined thickness is formed on the surfaces of the ink guides shown in FIGS. 14A to 14C and FIGS. 15A to 15C.

Figure 14A:
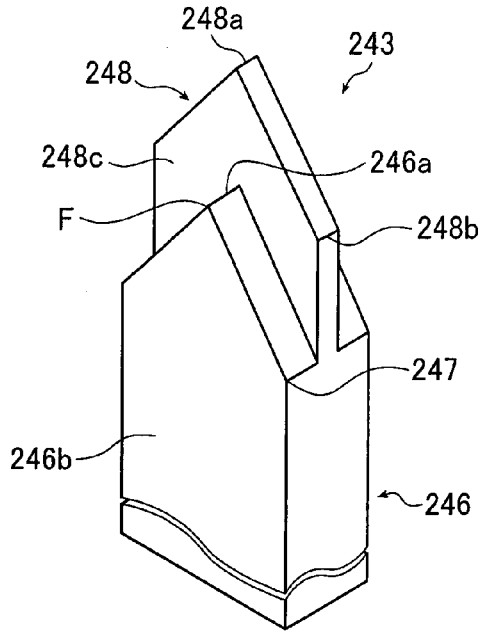
FIGS. 14A to 14C are a schematic perspective view, a schematic front view, and a schematic side view of another embodiment of the ink guide, respectively.
Figure 14B:
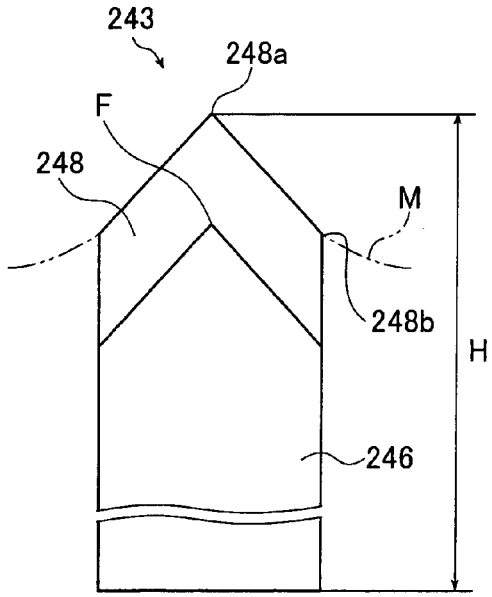
Figure 14C:
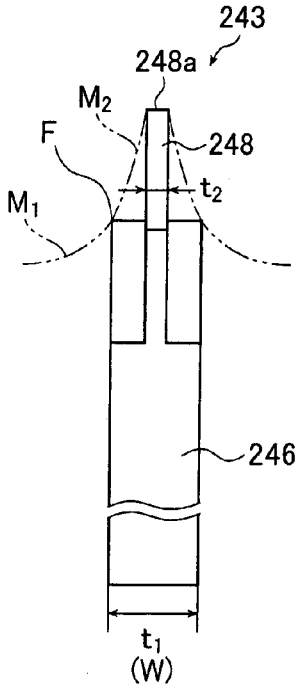
Figure 15A:
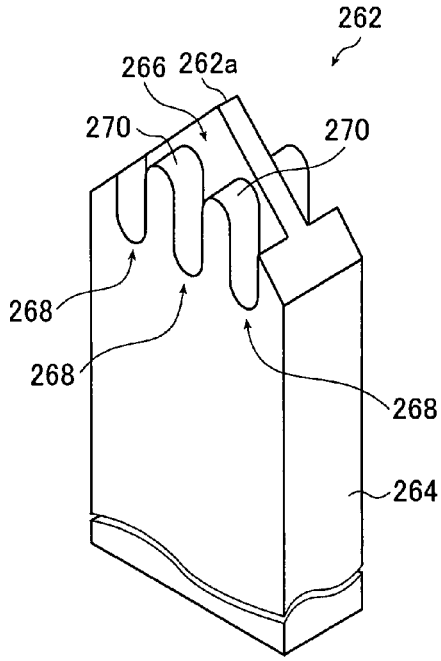
FIGS. 15A to 15C are a schematic perspective view, a schematic front view, and a schematic side view of still another embodiment of the ink guide which is different from the ink guide shown in FIGS. 14A to 14C.
Figure 15B:
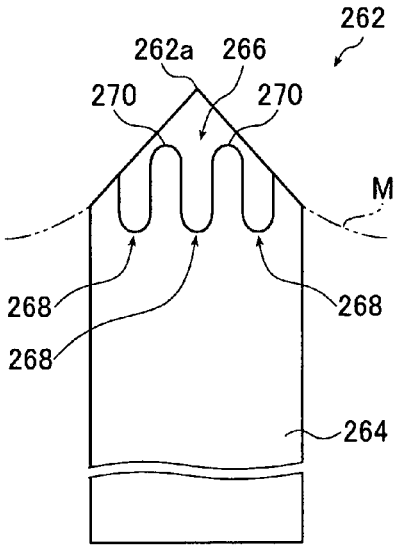
Figure 15C:
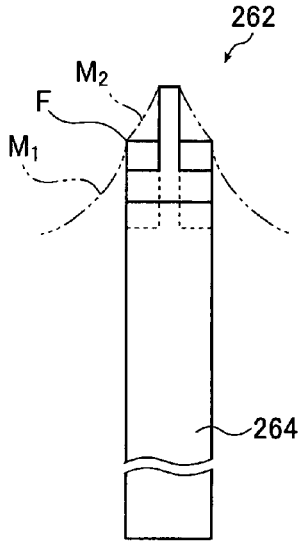

FIGS. 14A to 14C show a schematic perspective view, a schematic front view, and a schematic side view, of another example of the structure of the ink guide 214, respectively. FIGS. 15A to 15C show a schematic perspective view, a schematic front view, and a schematic side view, of still another example of the structure of the ink guide 214, respectively. The ink guide 243 shown in FIGS. 14A to 14C includes a plate shaped main body 246 having a broad width in a direction in which the guide bases 244 extend, and a projecting piece 248 formed on the tip end portion of the main body 246 to be integral therewith. The projecting piece 248 is thinner than the main body 246, and the tip end thereof is sharp. The projecting piece 248 is formed at the position approximately in the middle of the main body 246 in the thickness direction. As viewed in a front view, the tip end portion of the main body 246 has approximately a triangular shape with a tip end 246*a* as a vertex. Similarly to the tip end portion of the main body 246, as viewed in a front view, the projecting piece 248 also has approximately a triangular shape with a tip end 248*a* as a vertex. The angle of the tip end 246*a* of the main body 246 and the angle of the tip end 248*a* of the projecting piece 248 are not specifically limited, however, in order to improve the responsivity and approximate the shapes of the main body 246 and the projecting piece 248 to a meniscus shape, they are preferably 60° to 100°.

In the ink guide 243 shown in FIGS. 14A to 14C, the tip end 248*a* of the projecting piece 248 is formed sharp, however, it may be formed to have a curved shape as viewed in a front view and/or in a side view.

There is no specific limit to the thickness of the ink guide 243, however, the thickness t1 of the main body 246 is preferably 30 μm to 100 μm in order to arrange the ink guides 243 in high density while maintaining the strength thereof. The thickness t2 of the projecting piece 248 is preferably 10 μm to 20 μm in order to concentrate the electric field while maintaining the strength thereof. As shown in FIGS. 14B and 14C, the aspect ratio (H/t1) is preferably 5 or more in order to form the ink flow path 230 while the ink guide penetrates the ejection port substrate. In the aspect ration, t1 is the thickness of the main body 246 of the ink guide 243, and H is the height of the ink guide 243 (i.e., distance from the upper surface of the head substrate to the tip end of the ink guide).

The aspect ratio (H/W) is preferably 2 or more, in which W is the length in the short-lateral direction of the ink guide 243 (i.e., thickness of the ink guide), and H is the height of the ink guide 243 (i.e., distance from the upper surface of the head substrate to the tip end of the ink guide). The upper limit of the aspect ratio is 50, because the ink guide having a structure in which the aspect ratio is more than 50 is difficult to produce even by the manufacturing method of the present invention.

A meniscus of the ink formed by the ink guide 243 having the shape as shown in FIGS. 14A to 14C will be explained.

In the ink guide 243 shown in FIGS. 14A to 14C, the tip end 246*a* of the main body 246 functions as a pinning point (i.e., fixing point) F of a meniscus M. The position of the pinning point F is determined based on the shape of the tip end 246*a* of the main body 246 and is a stable point that will not move once fixed. Further, the pinning point F also functions as a pinning point that fixes a new meniscus M2 formed along the projecting piece 248. Therefore, the ink reaches the tip end 248*a* of the projecting piece 248 of the ink guide 243. The ink guide 243 of such structure allows the meniscus M2 of the ink to be formed at a higher position in comparison with the ink guide composed only of the main body 246 without having the projecting piece 248 as shown in FIG. 10A.

When the ink jet head is constituted by combining the head substrate 212 and the ejection port substrate 216, the ink guide 243 is preferably formed to have a height so that the tip end 246*a* of the main body 246 of the ink guide 243 projects from the surface of the ejection port substrate 216. With this structure, the position of the meniscus M2 of the ink formed along the projecting piece 248 of the ink guide 243 can be higher than the surface of the ejection port substrate 216.

In the length direction (i.e., height direction) of the ink guide 243, the ink guide 243 is preferably formed such that the position of the tip end 246*a* of the main body 246 of the ink guide 243 is above the position of shoulder portions 248*b* of the projecting part 248 (i.e., end portions of the projecting part 248 in the width direction). Whereby, it becomes possible to make the ink stably reach the tip end of the projecting piece 248 of the ink guide 243, and make the meniscus of the ink closer to the counter electrode 24 (refer to FIG. 10A).

In the ink guide 243 shown in FIGS. 14A to 14C, the projecting piece 248 is formed at the position approximately in the middle of the main body 246 in the thickness direction, however, for example, the ink guide 243 may be configured such that the projecting piece 248 is moved in the thickness direction so that a side surface 246*b* of the main body 246 and a side surface 248*c* of the projecting piece 248 on the same side flush with each other.

A metal film may be formed onto the tip end portion of the projecting piece 248 or the main body 246 of the ink guide 243 by evaporation. The formation of such metal film on the projecting piece or the main body of the ink guide allows the dielectric constant to be substantially increased. As a result, a strong electric field is generated with ease at the ejection port when a voltage is applied to the ejection electrode, which makes it possible to improve ejection property of the ink.

A slit serving as an ink guide groove that gathers the ink Q to the tip end 248*a* by means of a capillary phenomenon may be formed in a center portion of the ink guide 243 in a vertical direction in FIG. 14B.

Next, the ink guide shown in FIGS. 15A to 15C will be explained. In an ink guide 262 shown in FIGS. 15A to 15C, comb portions 266 are formed on both of the side surfaces (i.e., front and back side surfaces in FIG. 15A) of the tapered tip end portion of the main body 264. Each comb portion 266 includes three cutouts 268 and two teeth 270 formed between the cutouts 268. In this manner, there are formed three cutouts (vertical grooves) 268 that extend downwardly while being in parallel with each other and are spaced apart from each other at constant intervals in the width direction in each of the both side surfaces of the tip end portion of the ink guide 262. The three cutouts 268 are formed, so that two teeth 270 are formed therebetween. The tip ends (i.e., upper ends) of the teeth 270 are each formed by a curved surface.

The comb portions 266 are formed on both side surfaces in the thickness direction of a tip end portion 262*a* of the ink guide 262, so that the cutouts 268 of the comb portions 266 play a role of an ink reservoir and a role of capillaries. Accordingly, it becomes possible to stably supply the ink to the tip end portion of the ink guide 262. In order to stably supply the ink to the tip end portion of the ink guide, it is preferable that a distance between the upper ends of the teeth 270 and the upper end of the ink guide 262 be short.

Similarly to the tip end of the main body 246 of the ink guide 243 shown in FIGS. 14A to 14C, each upper end of the teeth 270 functions as a meniscus pinning point. Therefore, it is preferable that the upper ends of the teeth 270 exist on the upper side with respect to the surface of the ejection port substrate 216.

It should be noted that the ink guide 262 has the three cutouts 268 on each of the both side surfaces of the tip end portion 262*a*, but the present invention is not limited to this, and at least one cutout 268 will suffice.

Next, a meniscus formed by the ink guide having the shape shown in FIGS. 15A to 15C will be explained.

In the ink guide having the shape shown in FIGS. 15A to 15C, each edge of the upper ends of the teeth 270 of each comb portion 266 in the width direction functions as a pinning point F of a meniscus M1. The pinning point F is determined based on the shape of the comb portion 266 and is a stable point that will not move once fixed. Further, the pinning point F also functions as a pinning point that fixes a new meniscus M2 formed along the tip end portion 262*a* of the ink guide 262. Therefore, it becomes possible to make the ink reach the tip end of the tip end portion 262*a*.

In the ink guide 262 shown in FIGS. 15A to 15C, since the comb portions 266 are formed on the side surfaces in the thickness direction, even if the ink liquid surface is lower than the position of the upper ends of the teeth 270 of the comb portions 266, the ink reserved in the cutouts 268 of the comb portions 266 is supplied to the upper ends of the teeth 270 of the comb portions 266 by means of a capillary phenomenon. Also, the ink supplied to the teeth 270 is further supplied to the tip end portion 262*a* of the ink guide 262, so that a meniscus of the ink can be formed at the tip end portion 262*a* of the ink guide 262. The ink guide 262 with such shape is excellent in shape stability of a meniscus formed at the tip end portion, so even when disturbances such as vibrations are given, fluctuations of the shape of the meniscus of the ink formed at the tip end portion of the ink guide can be suppressed.

In the ink jet head including the ink guide 262 having such shape, the position of a meniscus of the ink at the opening is further raised above the surface of the ejection port substrate, and the ink is sufficiently supplied to the tip end of the ink guide. Therefore, the ejection responsivity of the ink droplets at the time of ejection is high, and the adhering position accuracy of the ink droplets is also high. In addition, it becomes possible to reduce variations in size of the ink droplets, specially, when color images are formed, it becomes possible to prevent or suppress color drift. Whereby, high definition and high quality image can be obtained.

The comb portion is formed on each of the both side surfaces of the tip end of the ink guide in this embodiment, but may be formed only on one side surface of the tip end of the ink guide.

Next, the ejection port substrate 216 of the ink jet head 210 will be explained referring to FIGS. 10A and 10B.

As shown in FIG. 10A, the ejection port substrate 216 of the ink jet head 210 comprises the insulating substrate 232, the shield electrode 220, the ejection electrodes 218, and the insulating layer 234. On the surface on the upper side in FIG. 10A (i.e., surface opposite to a side facing the head substrate 212) of the insulating substrate 232, the shield electrode 220 and the insulating layer 234 are laminated in order. Also, for the surface on the lower side in FIG. 10A (i.e., surface on the side opposing the head substrate 212) of the insulating substrate 232, the ejection electrodes 218 are formed.

As shown in FIG. 11, each ejection port 228 is an elongated cocoon-shaped (i.e., oval) opening (i.e., slit) which is obtained by connecting a semicircle to each short side of a rectangle. Also, the ejection port 228 has an aspect ratio (L2/D2) between the length L2 in the direction in which the guide base of the head substrate arranged facing the ejection port substrate extends and the length D2 in the direction perpendicular to the guide base extending direction of 1 or more.

In the present invention, the ejection port 228 whose aspect ratio (L2/D2) between the length L2 in the direction in which the guide base of the head substrate extends and the length D2 in the direction perpendicular to the guide base extending direction is 1 or more (i.e., the ejection port 28 having an anisotropic shape with its long sides extending in the guide base extending direction) is formed as an opening, so that ink becomes easy to flow to the ejection port 228. That is, capability of supplying ink particles to the ejection port 228 is enhanced, which makes it possible to improve the frequency responsivity and also prevent clogging. This point will be described later in detail together with the ink droplet ejection action.

In this embodiment, the ejection port 228 is formed as the elongated cocoon-shaped opening, however, the present invention is not limited to this and it is possible to form the ejection port 228 into arbitrary shapes such as an approximately circular shape, an oval shape, a rectangular shape, a rhomboid shape, or a parallelogram shape, so long as it is possible to eject ink from the ejection port 228 and the aspect ratio between the length in the guide base extending direction and the length in the direction perpendicular to the guide base extending direction is 1 or more. For instance, the ejection port may be formed in a rectangular shape whose long sides extend in the ink flow direction, or an oval shape or a rhomboid shape whose major axis extends in the ink flow direction.

As shown in FIG. 11, the ejection electrodes 218 are formed on the lower surface (i.e., surface facing the head substrate 212) of the ejection port substrate 232. The ejection electrodes 218 each has a rectangular frame like (square) shape, and is disposed along the rim of the cocoon-shaped ejection port 228 so as to surround the periphery of the ejection port 228. That is, the ejection electrode 218 has a rectangular frame like shape with its opening formed in a rectangular shape. In FIG. 11, the ejection electrode 218 is formed in a rectangular frame like shape, however, it is possible to change the shape of the ejection electrode 218 to various other shapes so long as the ejection electrode is disposed to face the ink guide. For example, the ejection electrode 218 may be a cocoon-shaped electrode similarly to the shape of the ejection port, a ring shaped circular electrode, an oval electrode, a divided circular electrode, a parallel electrode, a substantially parallel electrode, a reversed C-letter shaped electrode in which one side of a rectangular frame is removed, or the like, corresponding to the shape of the ejection port 228.

As described above, the ink jet head 210 has a multichannel structure in which multiple ejection ports 228 are arranged in a two-dimensional manner. Therefore, as schematically shown in FIG. 11, the ejection electrodes 218 are respectively disposed for the ejection ports 228 in a two-dimensional manner.

The ejection electrodes 218 are exposed to the ink flow path 230 and in contact with the ink flowing in the ink flow path 230. Thus, it becomes possible to significantly improve ejection property of ink droplets. This point will be described in detail later together with an action of ejection.

As shown in FIG. 10A, each ejection electrode 218 is connected to the control device 33. The control device 33 is capable of controlling a voltage value and a pulse width of the drive voltage applied to the ejection electrode 218 at the time of ejection and non-ejection of the ink.

Figure 16:
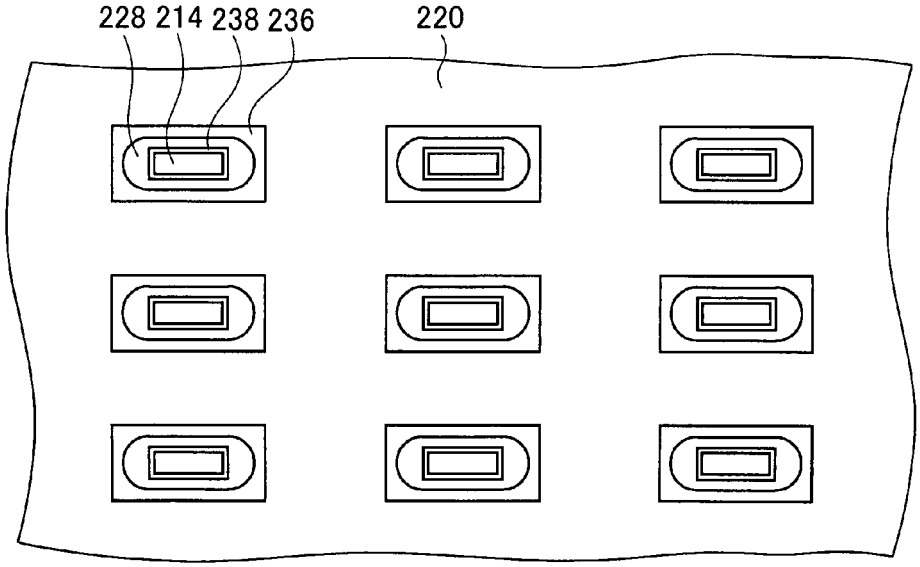
FIG. 16 is a cross-sectional view taken along line XVI-XVI of FIG. 10A, and schematically shows a planar structure of an embodiment of the shield electrode formed on an ejection port substrate of the ink jet head shown in FIG. 10A.
Figure 20:
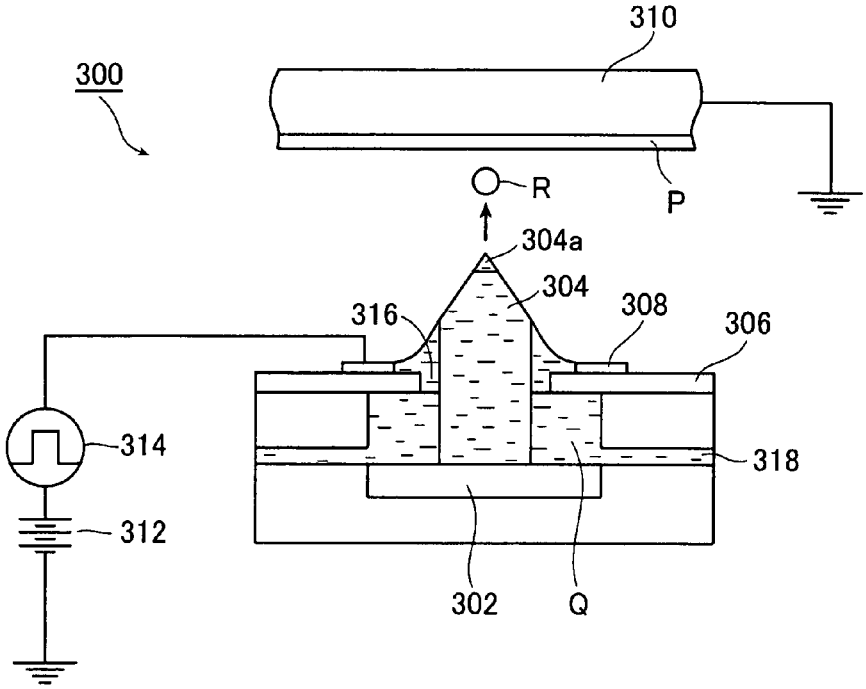
FIG.20 PRIOR ART
FIG. 20 is a schematic view showing an example of a conventional ink jet head.

The shield electrode 220 is formed on the upper surface (i.e., surface opposite to the surface on which the ejection electrodes are arranged) of the insulating substrate 232 and the surface of the shield electrode 220 is covered with the insulating layer 234. In FIG. 16, a planar structure of the shield electrode 220 is schematically shown. FIG. 16 is a cross sectional view taken along line XVI-XVI in FIG. 10A and schematically shows the planar structure of the shield electrode 220 of the ink jet head having the multichannel structure. As shown in FIG. 16, the shield electrode 220 is a sheet-shaped electrode, such as a metallic plate, which is common to each ejection electrode and has openings 236 at positions corresponding to the ejection electrodes 218 respectively formed on the peripheries of the ejection ports 228 arranged in a two-dimensional manner. Each opening 236 is formed in a rectangular shape so that it has a length and a width exceeding the length and the width of the ejection port 228.

It is possible for the shield electrode 220 to suppress electric field interference by shielding against electric lines of force between adjacent ejection electrodes 218, and a predetermined voltage (including 0 v when grounded) is applied to the shield electrode 220. In the illustrated embodiment, the shield electrode 220 is grounded and hence has 0 V as the applied voltage.

As a preferred embodiment, as shown in FIG. 10A, the shield electrode 220 is formed in the layer different from that containing the ejection electrodes 218 while the insulating substrate 232 is interposed therebetween. Moreover, its whole surface is covered with the insulating layer 234.

The insulating layer 234 is arranged on the shield electrode 220, whereby the electric field interference between adjacent ejection electrodes 218 can be suitably prevented. Moreover, discharging between the ejection electrode 218 and the shield electrode 220 can also be prevented even when the colorant particles of the ink are formed into a coating.

Similarly to the shield electrode 20 of the ink jet head 10 which has been described in detail in the above embodiment, the shield electrode 220 is provided so as to block the electric lines of force of the ejection electrodes 218 provided on ejection ports 228 of other channels and the electric lines of force directed to the other channels while ensuring the electric lines of force acting on the corresponding ejection port 228 of own channel among the electric lines of force generated from the ejection electrodes 218.

The shield electrode 20 has been explained in detail, so the explanation of the structure of the shield electrode 220 is omitted here.

With the above configuration, while ensuring the stable ejection of the ink droplets from the ejection port 228, for example, variations in the ink adhering position due to the electric field interference between the adjacent channels can be suitably suppressed, thus a high-quality image can be consistently recorded.

The shield electrode 220 may be provided (that is, the opening 236 of the shield electrode 220 may be formed) so that the shape of the opening 236 of the shield electrode 220 is made substantially similar to the shape formed by the inner edge portion or the outer edge portion of the ejection electrode 218, and the inner edge portion of the shield electrode 220 is more spaced apart (retracted) from the ejection port 228 than the inner edge portion of the ejection electrode 218 of the own channel and is closer (advanced) to the ejection port 228 than the outer edge portion of the ejection electrode 218.

In the above example, the shield electrode 220 is made as a sheet-shaped electrode, however, the third aspect of the present invention is not limited to this. Similarly to the shield electrode 20 of the ink jet head 10 which has been described in detail in the above embodiment, the shield electrode 220 may have any other shape or structure so long as it is possible to shield the respective ejection ports against electric lines of force of other channels, however, the detailed explanation thereof is omitted here.

As explained in detail above, the ink jet head 210 of the present invention is basically constructed in the above described manner.

As shown in FIG. 10A, the ink jet recording apparatus using the ink jet head 210 is constructed such that the counter electrode 24 is arranged to face the surface of the ink jet head 210 from which the ink droplets R are ejected. The counter electrode 24 has been explained above, so the explanation thereof is omitted here.

The recording medium P is held on the lower surface of the counter electrode 24 in FIG. 10A, that is, on the surface of the insulating sheet 24*b*, by electrostatic attraction for example. The counter electrode 24 (insulating sheet 24*b*) functions as a platen for the recording medium P.

At least during recording, the recording medium P held on the insulating sheet 24*b* of the counter electrode 24 is charged by the charging unit 26 to a predetermined negative high voltage opposite in polarity to that of the drive voltage applied to the ejection electrode 218.

Consequently, the recording medium P is charged negative to be biased to the negative high voltage to function as the substantial counter electrode to the ejection electrode 218, and is electrostatically attracted to the insulating sheet 24*b* of the counter electrode 24. The charging unit 26 has been explained above, so the explanation thereof is omitted here.

In addition to the holding methods of the recording medium P explained in the ink jet head 10 of the first aspect of the present invention, examples of the holding method include a mechanical method which uses fixing means of holding the forward and rear ends of the recording medium P, holding means such as a pressing roller, or the like, and a method in which suction holes communicating with a suction unit are formed in the surface of the counter electrode 24 facing the ink jet head 210 and the recording medium is fixed on the counter electrode by the suction force from the suction holes.

Next, an explanation will be made of the method of manufacturing the ink jet head 210 having the structure as shown in FIG. 10A and FIG. 10B with reference to the drawings. In the method of manufacturing the ink jet head 210, the head substrate 212 on which the ink guides 214 are formed is manufactured by the method of manufacturing a resin molded article according to the present invention. Then, the ejection port substrate 216 is manufactured by the semiconductor process. The head substrate 212 is mounted on the ejection port substrate 216 so that center axes of the ink guides 214 on the head substrate 212 can substantially coincide with centers of the ejection ports 228 in the ejection port substrate 216, and the ink jet head is thereby manufactured.

First, an explanation will be made of an example of manufacturing the head substrate 212 having the structure shown in FIGS. 12 and 13 by the method of manufacturing a resin molded article according to the present invention. The head substrate 212 is manufactured by using the nanoimprint method. Specifically, a die (e.g., metal die) having a minute irregular (concave and convex) pattern corresponding to the ink guides 214 of the head substrate 212 is pressed against a heated substrate as a molding target, whereby the irregular pattern is transferred to the resin substrate as the molding target. Then, the resin substrate is released from the die (e.g., metal die). In such a way, the head substrate is manufactured. The present invention is not limited to using a die made of metal (i.e., metal die) as the die, and it is possible to use other dies such as a die made of glass (i.e., glass die), a die made of resin (i.e., resin die), a sintered die, and a die made of ceramics (i.e., ceramic die). In the following explanation, a metal die is used as a representative example. In this embodiment, there is detected at least one of a temperature of the metal die, a temperature of the resin substrate, and resistance force received by the metal die from such a resin material when the metal die is pressed against the resin material by a predetermined amount. The metal die is pressed against the resin material while correcting press conditions based on the detected value. Specifically, the metal die is pressed against the resin substrate gradually in plural stages while controlling the temperature of the resin substrate and the temperature of the metal die. Further, when the metal die is pressed against the resin substrate in stages of a given amount, the temperature of the resin substrate, the temperature of the metal die, and the press resistance are detected for each step. Then, while correcting the press conditions (specifically, temperature of the resin substrate, temperature of the metal die, press speed, and press load) based on the detected values, the pressing of the next stage is sequentially performed under the corrected press conditions. In such a way, the irregular pattern formed on the metal die is transferred to the resin substrate, and the head substrate including the plurality of minute ink guides is formed in a lump.

Figure 17A:
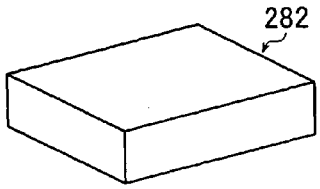
FIGS. 17A to 17H are schematic views for explaining an example of manufacturing processes for the head substrate shown in FIG. 12.

First, as shown in FIG. 17A, a flat plate-like resin substrate 282 as the molding target is prepared. As a material of the resin substrate 282, there can be used thermoplastic resin that is an amorphous material, for example, polymethyl methacrylate (PMMA), polycarbonate (PC), and cycloolefin polymer (COP). Polymethyl methacrylate (PMMA) and polycarbonate (PC) are preferable because of ink resistance inherent therein. Dimensions of the resin substrate 282 can be changed as appropriate in accordance with dimensions of the ink jet head to be manufactured.

Figure 17B:
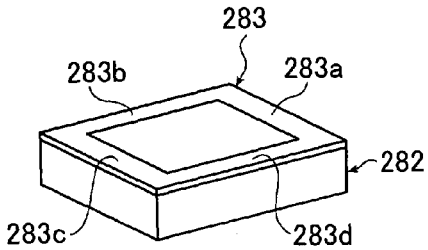

Next, as shown in FIG. 17B, a release plate 283 is mounted on a surface of the resin substrate 282. The release plate 283 is a rectangular frame body including broad and flat frame portions 283*a*, 283*b*, 283*c* and 283*d* arranged along four sides of the surface of the resin plate 282. In other words, the release plate 283 is a plate-like member having approximately the same size as the surface of the resin substrate 282 and a structure in which a rectangular opening is formed in the center. The release plate 283 is disposed so as to cover a region other than a region to which the irregular pattern of the metal die 284 is transferred.

The release plate 283 can be formed of various materials as long as the material has heat resistance and hardness enough not to be deformed by external force. For example, the release plate 283 can be formed of a material such as metal (e.g., SUS) and ceramics.

Next, the resin substrate 282 is uniformly heated up to the glass transition point or more. A heating method of the resin substrate 282 is not particularly limited. For example, there can be exemplified: a method of heating the resin substrate 282 as the molding target mounted on a support stage for supporting the resin substrate 282 in such a manner that a heater is provided to the support stage, and the support stage is heated; and a method of heating the resin substrate 282 mounted on the support stage in such a manner that a temperature regulation flow path for passing a temperature regulation medium such as water and oil therethrough is formed inside the support stage, and the temperature regulation medium heated up to a predetermined temperature is circulated through the temperature regulation flow path. Further, those methods can be used in combination.

Figure 17C:
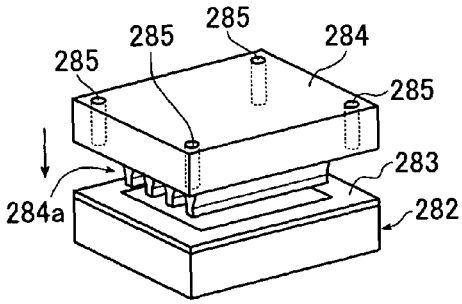

Subsequently, as shown in FIG. 17C, the metal die 284 for forming a minute irregular pattern on the resin substrate 282 is prepared. The metal die 284 is a metal die made, for example, of metal such as NAK, HPM, SKD-61, ATAVAX, PDS, SCM, and S55C. On the metal die 284, an irregular pattern 284*a* corresponding to the ink guides 214 and opening portions 242 of the head substrate 212 shown in FIGS. 12 and 13 is formed. The irregular pattern 284*a* can be formed, for example, by laser processing, cutting processing, discharge processing, and electron beam processing.

The metal die 284 is disposed so as to face the resin substrate 282 so that the surface on which the irregular pattern is formed can be parallel to the surface of the resin substrate 282. As will be described later, the metal die 284 can move in a direction perpendicular to the surface of the resin substrate 282, and can press the resin substrate 282 with a predetermined pressure. For example, hydraulic and pneumatic press mechanisms can be used as means for pressing the metal 284 against the resin substrate 282.

Further, in the vicinities of four corners of the metal die 284, columnar through holes 285 passing through the metal die 284 in a thickness direction are individually formed.

Similarly to the resin substrate 282, while being heated up to the glass transition point or more of the resin substrate 282 for use, the metal die 284 having such a structure is disposed so that the surface of the metal die 284, on which the irregular pattern 284*a* is formed, can face the surface of the resin substrate 282. In this case, a heating method of the metal die 284 is not particularly limited, either. There can be exemplified: a method of heating the metal die 282 in such a manner that a heater is provided to a metal die holding member for holding the metal die 284, and the metal die holding member is heated up by the heater; and a method of heating the metal die holding member or the metal die in such a manner that a temperature regulation flow path for passing the temperature regulation medium such as water and oil therethrough is formed inside the metal die holding member or the metal die 284, and the temperature regulation medium heated up to a predetermined temperature is circulated through the temperature regulation flow path. Those methods can be used in combination.

Figure 17D:
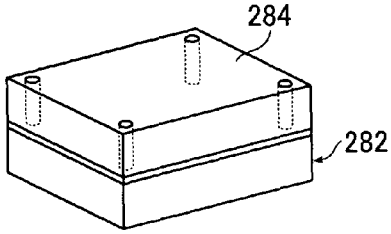

Next, as shown in FIG. 17D, the surface of the metal die 284, on which the irregular pattern is formed, is pressed against the resin substrate 282 in stages or continuously with a predetermined pressure while being maintained parallel to the surface of the resin substrate 282. When the metal die 284 is pressed against the resin substrate 282 in stages, the metal die 284 just needs to be pressed into the resin substrate 282 with the predetermined pressure in stages of a given depth (e.g., approximately 1 μm).

In this case, when the metal die 284 is pressed against the resin substrate 282, the portion of the metal die 284, on which the irregular pattern is formed, passes through the opening portion of the release plate 283, and is pressed against the resin substrate 282. Then, the above-mentioned portion is buried inside the resin substrate 282, and the resin is gradually filled into the concave portions of the irregular pattern of the metal die 284. When the metal die 284 is further pressed into the resin substrate 282 intermittently, the circumferential portion of the metal die 284, on which the irregular pattern is not formed, faces and intimately contacts the surface of the frame portions of the release plate 283. Specifically, the release plate 283 is sandwiched between the metal die 284 and the resin substrate 282.

The through holes 285 in the vicinities of the four corners of the metal die 284 face the release plate 283. Accordingly, even if the metal die 284 is pressed against and brought into intimate contact with the resin substrate 282, the inside of the through holes 285 is not filled with the heated resin. As described above, the release plate 283 has a function of preventing the heated resin from being filled into the through holes 285 of the metal die 284.

In this embodiment, when the metal die 284 is pressed against the resin substrate 282 under predetermined conditions (specifically, press speed, press load, temperature of the resin, and temperature of the metal die), it is preferable to individually detect force (hereinafter, referred to as press resistance) received by the metal die 284 from the resin substrate 282, a temperature of the resin substrate 282, and a temperature of the metal die 284. For example, in the case where the metal die 284 is pressed against the resin substrate 282 in stages, preferably, when the metal die 284 is pressed against the resin substrate 282 by a given depth, the press resistance, the temperature of the resin substrate 282, and the temperature of the metal die 284 are individually detected, and the presswork is performed while self-correcting the press conditions for the next pressing of the metal die 284 into the resin substrate 282 by the predetermined amount based on the above detected values. Further, when the metal die 284 is continuously pressed against the resin substrate 282, preferably, the press resistance, the temperature of the resin substrate 282, and the temperature of the metal die 284 are individually detected for each given time, and the presswork is performed while self-correcting the press conditions based on the detected values.

In the present invention, it is preferable to perform the presswork while self-correcting the press conditions based on the press resistance, the temperature of the resin substrate, and the temperature of the metal die as described above. In such a way, the head substrate on which the minute ink guides with an aspect ratio of 5 or more are formed can be manufactured.

In this case, the temperature of the resin substrate 282 may be detected, for example, in such a manner that a temperature of the surface of the resin substrate 282 is measured by using a temperature sensor, or alternatively, that a temperature of a heating unit of a heating device for heating the resin substrate 282 is regarded as the temperature of the resin substrate 282, and the temperature of the heating unit is measured.

Further, the temperature of the metal die 284 may be detected in such a manner that a temperature sensor is mounted onto the surface of the metal die 284, and the temperature of the surface of the metal die 284 is measured by means of the temperature sensor, or alternatively, that a temperature of a heating unit of a heating device for heating the metal die 284 is regarded as the temperature of the metal die 284, and the temperature of the heating unit of the heating device is measured by means of the temperature sensor.

Further, the press resistance can be detected, for example, in such a manner that a pressure sensor such as a piezoelectric element or the like is mounted onto a metal die support member for supporting the metal die.

As described above, in this embodiment, the metal die 284 is pressed into the resin substrate 282 in stages or continuously while controlling all of the temperature of the resin, the temperature of the metal die, the press speed, and the press load. Accordingly, even if the concave portions of the metal die 284 are minute, the resin can be filled into the concave portions positively and sufficiently, and the ink guides with an aspect ratio of 5 or more can be easily formed on the body of the head substrate.

In this case, while controlling all of the temperature of the resin, the temperature of the metal die, the press speed, and the press load, the metal die 284 is pressed against the resin substrate 282, and the irregular pattern of the metal die 284 is transferred to the surface of the resin substrate 282. However, in the present invention, the metal die may be pressed against the resin substrate while controlling at least one of the above-mentioned factors.

As described above, the metal die 284 is pressed into the resin substrate 282 in stages of the predetermined amount, and the irregular pattern 284*a* formed on the metal die 284 is transferred to the resin substrate 282. Thereafter, the metal die 284 and the resin substrate 282 are cooled to a temperature lower than the glass transition point to cure the resin substrate 282. With regard to a method of cooling the resin substrate 282, for example, in the case of heating the resin substrate 282 by the heater provided to the support stage, the resin substrate 282 may be naturally cooled only by stopping the heating by the heater, or the resin substrate 282 may be forcibly cooled by further air-cooling or water-cooling the support stage. Further, in the case of heating the resin substrate in such a manner that the temperature regulation medium heated up to the predetermined temperature is circulated through the temperature regulation flow path formed in the support stage for supporting the resin substrate 282, the resin substrate 282 may be cooled by circulating, through the temperature regulation flow path, the temperature regulation medium cooled to a predetermined temperature.

Further, with regard to a method of cooling the metal die 284, for example, in the case of heating the metal die 284 by the heater provided to the metal die holding member for holding the metal die 284, the metal die 284 may be naturally cooled by stopping the heating by the heater, or the metal die 284 may be forcibly cooled by air-cooling or water-cooling the metal die or the metal die holding member. Further, in the case of heating the metal die 284 in such a manner that the temperature regulation medium heated up to the predetermined temperature through the temperature regulation flow path formed in the metal die or the metal die holding member, the metal die 284 may be cooled by circulating, through the temperature regulation flow path, the temperature regulation medium cooled to a predetermined temperature.

Figure 17E:
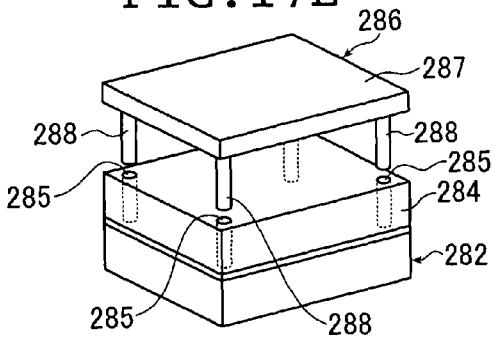

After the resin substrate 282 and the metal die 284 are cooled to cure the resin substrate 282, the resin substrate 282 is released from the metal die 284 by using a release jig 286 shown in FIG. 17E so that the irregular pattern transferred to the resin substrate 282 cannot be broken.

As shown in FIG. 17E, the release jig 286 includes a planar body portion 287, and four leg portions 288 formed at positions slightly toward the center from four corners of the body portion 287. The body portion 287 and the leg portions 288 can be formed of various materials as long as the material has hardness so that the body portion 287 and the leg portions 288 made thereof are not deformed by external force. For example, the body portion 287 and the leg portions 288 can be formed of a material such as a metal (e.g., SUS, NAK, HPM, SKD-61, ATAVAX, PDS, SCM, and S55C), ceramics, and the like. The thickness of the body portion 287 is thinner than that of the metal die 284, and the length and the width of the body portion 287 are approximately the same as those of the metal die 284; however, in the present invention, dimensions of the body portion 287 of the release jig 286 are not limited to these.

The leg portions 288 of the release jig 286 are provided perpendicularly to the surface of the body portion 287 so as to be individually insertable into the through holes 285 formed in the vicinities of the four corners of the metal die 284. All of the leg portions 288 have a columnar shape, and are formed to have mutually the same length and to be longer than the thickness of the metal die 284. Since it is necessary for the leg portions 288 to be inserted into the through holes 285 of the metal die 284, the leg portions 288 are formed with a diameter somewhat smaller than the inner diameter of the through holes 285 of the metal die 284. The leg portions 288 of the release jig 286 serve as pressing portions for pressing the release plate 283 when the resin substrate 282 is released.

Figure 17F:
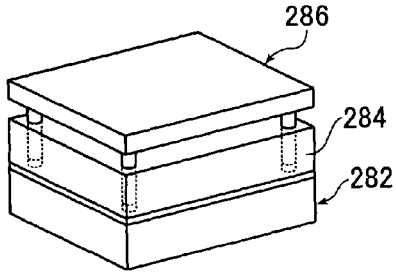
Figure 17G:
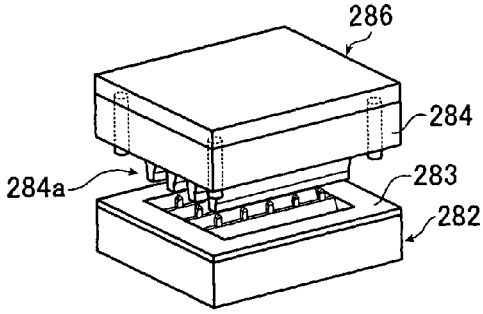
Figure 17H:
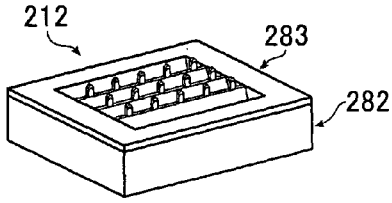

When the resin substrate 282 is released, the metal die 284 in intimate contact with the resin substrate 282 is fixed by a fixing member (not shown). Then, as shown in FIG. 17F, the leg portions 288 of the release jig 286 are inserted into the through holes 285 open to the surface of the metal die 284 which is opposite to the surface where the irregularities are formed, and the release jig 286 is made to approach the metal die 284. The leg portions 288 reach the release plate 283 located between the metal die 284 and the resin substrate 282, and press the four corner portions of the release plate 283. As described above, the four corners of the release plate 283 are simultaneously pressed with uniform force by the four leg portions 288 of the release jig 286. As shown in FIG. 17G, when the release jig 286 is made to further approach the metal die 284 in a state where the metal die 284 is fixed, the resin substrate 282 is forced out of the metal die 284 by the pressing force of the leg portions 288 of the release jig 286 through the release plate 283. At this time, the resin substrate 282 is spaced and released from the metal die 284 while maintaining a parallel state to the surface of the metal die 284. In such a way, the head substrate on which the ink guides are formed is manufactured (refer to FIG. 17H).

In this embodiment, as described above, the resin substrate 282 can be released by using the release plate 283 and the release jig 286 while maintaining the parallel state to the surface of the metal die 284. Therefore, the ink guides formed on the surface of the resin substrate 282 substantially perpendicularly can be prevented from being deformed when the resin substrate 282 is released.

Further, after the resin substrate 282 is released, the release plate 283 disposed in intimate contact with the surface of the resin substrate 282 may be removed from the resin substrate 282. Alternatively, the release plate 283 may be left on the surface of the resin substrate 282, and may be used as a reinforcement member for preventing deformation of the head substrate.

Figure 18:
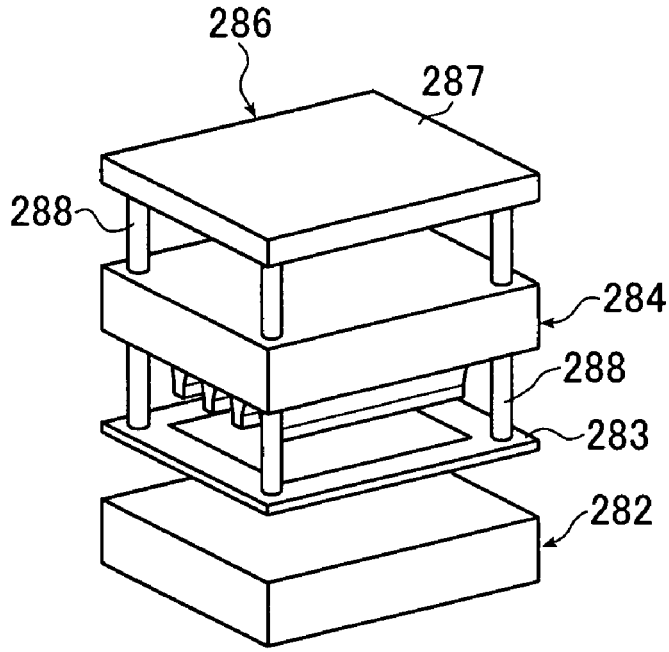
FIG. 18 is a schematic perspective view of another embodiment of a release jig in which a release plate is fixed to leg portions to integrate the leg portions and the release plate, the release jig being used in the head substrate manufacturing processes shown in FIGS. 17A to 17H.

In the above-mentioned example, the release plate 283 and the release jig 286 as shown in FIG. 17E are used, the release plate 283 is pressed by the stick-like leg portions 288 of the release jig 286, and the resin substrate 282 is released. However, in the present invention, the method of releasing the resin substrate is not limited to this method. For example, instead of constructing the release plate 283 and the leg portions 288 of the release jig 286 by separate parts, as shown in FIG. 18, the release plate 283 may be fixed and integrated with the leg portions 288 of the release jig 286. In this case, the leg portions 288 of the release jig 286 are constructed so as to be detachable from the body portion 287, and as shown in FIG. 18, there can be employed a method of fixing the leg portions 288 to the body portion 287 after inserting the leg portions 288 of the release jig 286 into the through holes 285 of the metal die 284. Then, at the time of the presswork, the metal die 284 is pressed against the resin substrate 282 together with the release plate 283 while keeping the release plate 283 in intimate contact with the metal die 284. In this case, the presswork is performed while the metal die 284 is being supported from the side surfaces thereof and the like by the release jig 286. Alternatively, in a state where only the release plate 283 is pressed against the surface of the resin substrate 282, the metal die 284 is pressed against the resin substrate 282 while being guided by the leg portions 288 of the release jig 286 which are inserted into the through holes 285. Then, after the resin substrate 282 is cooled and cured, the release jig 286 and the metal die 284 are moved relatively to each other so that the body portion 287 of the release jig 286 can approach the metal die 284, and in such a way, the resin substrate 282 is released from the metal die 284. As a method of making the body portion 287 of the release jig 286 approach the metal die 284, there can be applied a method of pressing the release plate 283 against the surface of the resin substrate 282 and moving the metal die 284 toward the body portion 287 of the release jig 286 while keeping on thrusting the resin substrate 282 against a support stage on which the resin substrate 282 is mounted, and a method of moving at least one of the metal die 284 and the body portion 287 of the release jig 286 in a direction where both of them approach each other without thrusting the resin substrate 282 against the support stage on which the resin substrate 282 is mounted.

The methods as described above also make it possible to release the resin substrate 282 from the metal die 284 without deforming the ink guides formed on the surface of the resin substrate 282 substantially perpendicularly when the resin substrate 282 is released.

In the above-mentioned example, as shown in FIGS. 17E to 17G, the release plate 283 is interposed between the metal die 284 and the resin substrate 282, the leg portions 288 of the release jig 286 are inserted into the through holes 285 formed in the metal die 284, then the release plate 283 is partially pushed by the leg portions 288, and the resin substrate 282 is thereby released. However, for example, the resin substrate 282 can also be released in such a manner that a release jig 296 with a shape shown in FIG. 19 is used, and the surface of the resin substrate 282 is directly pushed by leg portions 298 of the release jig 296.

Figure 19:
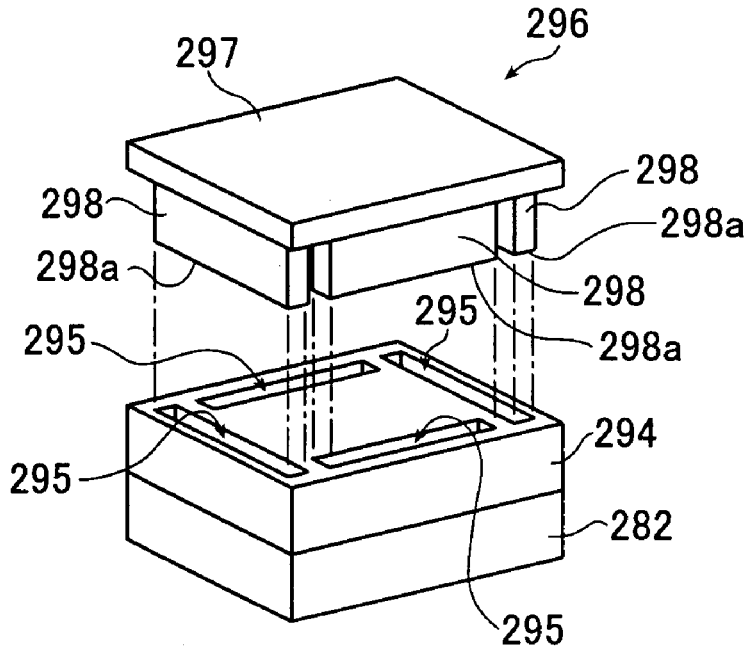
FIG. 19 is a schematic perspective view of still another embodiment of the release jig that directly presses a surface of a resin substrate, the release jig being used in the head substrate manufacturing processes.

The release jig 296 shown in FIG. 19 includes a rectangular plate-like body portion 297, and four planer leg portions 298 provided perpendicularly to a surface of the body portion 297. The respective leg portions 298 are provided to the inside of an outer circumference of the surface of the body portion 297 so as to be along the respective sides of the surface of the body portion 297. The four leg portions 298 are formed to have entirely the same length, and to be longer than the thickness of a metal die 294. Further, tip ends 298*a* of the leg portions 298 are formed to be flat.

Four through holes 295 with an elongated quadrangular prism shape, which penetrate the metal die 294 in the thickness direction thereof, are formed so as to be along four sides of the metal die 294. The through holes 295 are formed in the periphery of the irregular pattern of the metal die 294 so as to avoid a region of the metal die 294 where the irregular pattern is formed. The respective through holes 295 in the metal die 294 are formed in approximately the same dimensions as the respective leg portions 298 at positions corresponding to the respective leg portions 298 of the release jig 296, so that the respective leg portions 298 of the release jig 296 can be inserted into the through holes 295 concerned when the resin substrate 282 is released.

In the case of using the release jig 296 as described above, in order to prevent the heated resin substrate 282 from entering the through holes of the metal die 294 at the time of the presswork, it is preferable that the leg portions 298 be inserted into the through holes 295 of the metal die 294 and fixed to the metal die 294 in advance so that surfaces of the tip ends 298*a* of the leg portions 298 of the release jig 296 can construct surfaces flush with the surface of the metal die 294. In this case, since the release jig 296 is present on the back surface of the metal die 294, the presswork is performed while supporting the metal die 294 from side surfaces thereof and the like by a support jig (not shown). Then, when the cured resin substrate 282 is released from the metal die 294, the release jig 296 is pressed into the metal die 294 more deeply, and by pressing force therefrom, the resin substrate 282 is forced out of the metal die 294. In such a way, the resin substrate 282 can be detached from the metal die 294 without deforming the resin substrate 282.

As described above, in the case where the surface of the resin substrate 282 is directly pushed by the leg portions 298 of the release jig 296 as shown in FIG. 19, it is preferable that a contact area between the tip ends 298*a* of the leg portions 298 of the release jig 296 and the resin substrate 282 be large. By making the contact area between the tip ends 298*a* of the leg portions 298 and the resin substrate 282 large as described above, when the surface of the resin substrate 282 is pushed by the leg portions 298, the leg portions 298 are prevented from being buried in the resin substrate 282. In addition, the region of the resin substrate 282 other than the region where the irregularities are formed can be pushed uniformly, and the deformation of the resin substrate 282 when the resin substrate 282 is released can be prevented.

Further, also in the case of using the release jig 296 shown in FIG. 19, the construction may be such that the release plate 283 as shown in FIG. 17B is interposed between the metal die 294 and the resin substrate 282, the release plate 283 is pressed by the leg portions 298 of the release jig 296, and the resin substrate 282 is released from the metal die 294.

Further, although the surface of the resin substrate is pressed by the four leg portions in the above-mentioned embodiment, another embodiment in which the surface of the resin substrate is pressed only by two leg portions opposite to each other may be adopted. The number of leg portions is not limited as long as the surface of the resin substrate or the surface of the release plate can be pushed uniformly.

As described above, in this embodiment, the irregular pattern of the metal die is transferred to the resin substrate by using the nanoimprint method while controlling the press conditions, whereby the head substrate on which the minute ink guides are formed can be manufactured. Moreover, the resin substrate can be taken out of the metal die by using the release plate or the release jig without deforming the minute ink guides.

Subsequently, a DLC layer as a protective layer is formed on the surface of the resin substrate on which the ink guides are formed. A method of forming the DLC layer is not specifically limited, and it is possible to utilize various methods similar to the DLC layer forming method which was described in detail as a thin-film forming method for forming the DLC layer on the surface of the ejection port substrate of the ink jet head 10 in the above described embodiment. Therefore, for example, a chemical vapor deposition (CVD) method, a vacuum deposition method, an ionized deposition method, a sputtering method, and an arc ion plating method can be utilized as a method for forming the DLC layer. Thus, the detailed explanation of the method of forming the DLC layer is omitted here.

Regarding an electrode on which a sample (i.e., ejection port substrate) is provided in the DLC layer forming method, the explanation has been made of a case in which the sample is provided on the anode side in the sputtering method and on the cathode side in the plasma CVD method as an example. However, the present invention is not limited thereto, and the sample may be provided on the cathode side in the case of forming the DLC layer by the sputtering method and on the anode side in the case of forming the DLC layer by the plasma CVD method.

By forming the DLC layer with a predetermined thickness on the surface of the resin substrate in this manner, the head substrate with the DLC layer formed on the ink guides as well can be manufactured.

The method of manufacturing the head substrate on which the minute ink guides having sufficient strength are formed is basically constructed as explained in detail above.

Next, an explanation will be made of a method of manufacturing the ejection port substrate 216 having the structure shown in FIG. 10A and FIG. 10B.

As shown in FIG. 10A and FIG. 10B, the ejection port substrate 216 is an insulating substrate formed of an insulating material in which a large number of the ejection ports for ejecting the ink are formed. On one of the surfaces of the ejection port substrate 216, the shield electrode 220 is formed, and the ejection electrodes 218 are formed on the peripheries of the ejection ports on the other surface of the ejection port substrate 216.

First, a flat insulating substrate is prepared. This insulating substrate just needs to be a substrate formed of an insulating material. As the insulating material, for example, glass, ceramic materials such as $Al_2O_3$ and $ZrO_2$, and resins can be illustrated.

Subsequently, the shield electrode and the ejection electrodes are formed on the upper surface and the lower surface of the insulating substrate, respectively, by a semiconductor manufacturing process.

First, a metal layer for the shield electrode is formed on the upper surface of the insulating substrate. As a method of forming the metal layer, for example, there are given known film formation methods including a method of pasting thin metal foil by an adhesive, and a vapor deposition method such as a chemical vapor deposition (CVD) and a sputtering method.

For the metal layer, for example, a material such as copper, silver, and gold can be used.

Subsequently, on the metal layer on the upper surface of the insulating substrate, a mask having a pattern corresponding to the shield electrode is formed by a photolithography technology. Then, an etching is performed through the mask, and the metal layer formed on the upper surface of the insulating substrate is partially removed. Then, the mask is removed after the etching, and the shield electrode is thereby formed on the upper surface of the insulating substrate.

Next, an insulating layer is formed on the surface of the insulating substrate on which the shield electrode is formed. As a method of forming the insulating layer, for example, coating using a spinner, screen printing, and the like can be used. Moreover, as materials of the insulating layer, for example, polyimide, epoxy, fluorocarbon resin, phenolic resin, and the like can be used. Polyimide is preferable because of excellent insulating property and heat resistance thereof. It is preferable that a film thickness of the insulating layer be 10 to 100 μm because the ejection port substrate 216 should be thinned while maintaining the insulating property thereof.

Next, on the opposite surface (i.e., lower surface) of the insulating substrate, a metal layer for the ejection electrodes is formed. A material and a forming method of the metal layer may be similar to those of the shield electrode, or may be different therefrom. Further, it is preferable that a film thickness of the metal layer be 3 to 50 μm because the ejection port substrate 216 should be thinned while maintaining etching resistance thereof.

Subsequently, on the metal layer, a mask having a pattern corresponding to the ejection electrodes is formed by the photolithography technology. Then, etching is performed through the mask to partially remove the metal layer, and thereafter, the mask is removed. Thus, the ejection electrodes are formed on the lower surface of the insulating substrate.

In this embodiment, the ejection electrodes are formed after forming the shield electrode; however, a forming order of the shield electrode and the ejection electrodes is not particularly limited, and the ejection electrodes may be formed first. Further, although the metal layers are formed on the upper and lower surfaces of the insulating substrate in different steps, the metal layers may be formed on the upper and lower surfaces of the insulating substrate continuously or simultaneously. Meanwhile, similarly to the above, the shield electrode and the ejection electrodes can be formed on the upper and lower surfaces of the insulating substrate by using the semiconductor manufacturing process.

Through holes serving as the ejection ports are formed in the insulating substrate on which the shield electrode, the insulating layer, and the ejection electrodes are formed in the above-mentioned manner. In order to form the through holes, laser, a drill, or a sandblasting device can be used.

In the case of forming the through holes in the insulating substrate by means of the sandblasting device, a method can be applied, in which such a metal mask layer as covering regions other than regions equivalent to the through holes is formed, and an abrasive is jetted by the sandblasting device through the metal layer. For the abrasive, for example, alumina, silicon carbide, and the like can be used. It is suitable that a grain size of the abrasive be 5 to 60 μm. In order to change the shapes and dimensions of the through holes, the shapes and dimensions of the metal mask layer just need to be changed.

As the metal to be used for the metal mask layer, relatively hard metal such as stainless steel, Ni, and Cr is preferable in terms of durability. The semiconductor manufacturing process can be used as the method of forming the metal mask layer. In the case of thickening the metal mask layer in order to enhance the durability, after a thin metal mask layer is formed, the film thickness of the metal mask layer just needs to be thickened by an electrolytic plating method. After the through holes are formed in the insulating substrate, the metal mask layer is removed by an alkaline or acidic removal liquid.

In such a way described above, the ejection port substrate 216 having the structure shown in FIGS. 10A and 10B can be manufactured.

The head substrate 212 and the ejection port substrate 216, which are manufactured as described above, are arranged to face each other so that the ink guides formed on the head substrate 212 can be inserted into the ejection ports formed in the ejection port substrate 216. In this manner, the ink jet head 210 having the structure shown in FIGS. 10A and 10B is manufactured.

Next, the ejection action of the ink droplets R from the ink jet head 210 having a structure shown in FIGS. 10A and 10B will be explained.

As shown in FIG. 10A, in the ink jet head 210, the ink Q, which contains colorant particles charged with the same polarity (for example, charged positively) as that of a voltage applied to the ejection electrode 218 at the time of recording, circulates in a vertical direction in FIG. 10A by a not shown ink circulation mechanism including a not shown pump and the like.

On the other hand, upon recording, the recording medium P is supplied to the counter electrode 24 and is charged to have the polarity opposite to that of the colorant particles, that is, a negative high voltage, by the charging unit 26. While being charged to the bias voltage, the recording medium P is electrostatically attracted to the counter electrode 24.

In this state, the control device 33 performs control so that a pulse voltage (hereinafter referred to as a "drive voltage") is applied to each ejection electrode 218 in accordance with supplied image data while relatively moving the recording medium P (counter electrode 24) and the ink jet head 210. Ejection ON/OFF is basically controlled depending on application ON/OFF of the drive voltage, whereby the ink droplets R are modulated in accordance with the image data and ejected to record an image on the recording medium P.

When the drive voltage is not applied to the ejection electrode 218 (or the applied voltage is at a low voltage level), i.e., in a state where only the bias voltage is applied, Coulomb attraction between the counter electrode 24 (recording medium P) to which the bias voltage is applied and the charges of the colorant particles (charged particles) of the ink, Coulomb repulsion among the colorant particles, viscosity, surface tension and dielectric polarization force of the carrier liquid, and the like act on the ink Q, and these factors operate in conjunction with one another to move the colorant particles and the carrier liquid. Thus, the balance is kept in a meniscus shape as conceptually shown in FIG. 10A in which the ink Q slightly rises from the ejection port 228.

In addition, the colorant particles aggregate at the ejection port 228 due to the electric field generated from the ejection electrode 218. The above described Coulomb attraction and the like allow the colorant particles to move toward the recording medium P charged to the bias voltage through a so-called electrophoresis process. Thus, the ink is concentrated in the meniscus formed at the ejection port 228.

From this state, the drive voltage is applied to the ejection electrode 218. Whereby, the drive voltage is superimposed on the bias voltage. Then, the motion occurs in which the previous conjunction motion operates in conjunction with the superimposition of the drive voltage. The electrostatic force acts on the colorant particles and the carrier liquid by the electric field generated by the application of the drive voltage to the ejection electrode 218. Thus, the colorant particles and the carrier liquid are attracted toward the bias voltage (i.e., counter electrode) side, that is, the recording medium P side by the electrostatic force. The meniscus formed in the ejection port grows upward in FIG. 10A (i.e., toward the recording medium P side) to form a nearly conical ink liquid column, i.e., a so-called Taylor cone upward of the ejection port 228 (i.e., extending in a direction from the ejection port 228 toward the recording medium P). In addition, similarly to the foregoing, the colorant particles are moved to the meniscus surface through electrophoresis process and the action of the electric field from the ejection electrode, so that the ink at the meniscus is concentrated and has a large number of colorant particles at a nearly uniform high concentration.

When a finite period of time further elapses after the start of the application of the drive voltage to the ejection electrode 218, the balance mainly between the force acting on the colorant particles (e.g., Coulomb force and the like) and the surface tension of the carrier liquid is broken at the tip end portion of the meniscus having the high electric field strength due to the movement of the colorant particles or the like. As a result, the meniscus abruptly grows to form a slender ink liquid column called a thread having about several μm to several tens of μm in diameter.

When a finite period of time further elapses, the thread grows, and is divided due to the interaction resulting from the growth of the thread, the vibrations generated due to the Rayleigh/Weber instability, the ununiformity in distribution of the colorant particles within the meniscus, the ununiformity in distribution of the electrostatic field applied to the meniscus, and the like. Then, the divided thread is ejected and flown in the form of the ink droplets R toward the recording medium P and is attracted by the bias voltage as well to adhere to the recording medium P. The growth of the thread and its division, and moreover the movement of the colorant particles to the meniscus (thread) are continuously generated while the drive voltage is applied to the ejection electrode. Therefore, the amount of ink droplets ejected per pixel can be controlled by adjusting the time during which the drive voltage is applied.

After the end of the application of the drive voltage (ejection is OFF), the meniscus returns to the above-mentioned state where only the bias voltage is applied to the recording medium P.

According to the above principle, minute ink droplets are ejected from the meniscus of the ink formed at the tip end of the ink guide according to recording data for forming an image.

As shown in FIG. 11, each ejection port in the ink jet head of this embodiment is a slit like long hole. The ejection port 228 is the slit like long hole, so ink becomes easy to flow to the inside of the ejection port and capability of supplying ink particles to the ejection port 228 can be enhanced. Whereby, capability of supplying ink particles to the tip end portion 214*a* is enhanced, which makes it possible to improve ejection frequency at the time of image recording. Therefore, even when dots are drawn continuously at high speed, dots of desired size can be consistently formed on the recording medium.

In view of the output time of an image, the ejection frequency for drawing an image is set at 5 kHz, preferably at 10 kHz, and more preferably at 15 kHz.

Next, an ink jet recording apparatus of the fourth aspect of the present invention comprising the ink jet head according the third aspect of the present invention will be explained. The ink jet recording apparatus of the fourth aspect of the present invention has a configuration the same as that of the ink jet recording apparatus of the second aspect of the present invention except for an ink jet head, so the detailed explanation thereof is omitted.

Specifically, the ink jet recording apparatus of the fourth aspect of the present invention uses the ink jet head 210 shown in FIGS. 10A to 19 instead of the ink jet head 10 shown in FIGS. 1A to 8 which is used as the ink jet head 80*a* of the head unit 80 in the ink jet recording apparatus (i.e., printer) 60 of the second aspect of the present invention shown in FIG. 9A, and the explanation thereof is omitted.

Further, the ink jet recording apparatus is used as an ink jet printer in the above described embodiments. However, the ink jet recording apparatuses of the second and the fourth aspects of the present invention are not limited thereto, and can be used as an ink jet plate making apparatus.

The ink jet heads of the first and the third aspects of the present invention, and the ink jet recording apparatuses of the second and the fourth aspects of the present invention using the ink jet heads of the first and the third aspects of the present invention, have been explained in detail above by referring to various embodiments. However, the present invention is not limited to the above embodiments, and various improvements and modifications may of course be made without departing from the scope of the invention.

For example, the ink jet head of the first aspect of the present invention preferably comprises the ink guides 14 in order to improve stability of the direction in which ink droplets are ejected, ejection responsivity, stability of a meniscus, and the like. However, the first aspect of the present invention is not limited to this, and the ink jet head may not comprise the ink guides.

In the ink jet head of the present invention, in addition to or instead of the DLC layer 38 on the surface on the ink droplet ejection side of the ejection port substrate 16, similarly to the ink jet head 210 shown in FIG. 10A, the ink jet head 10 shown in FIG. 1A may comprise a DLC layer at least on the upper surfaces of the ink guides 14 (preferably, on the upper surfaces of the head substrate 12, the ink guide dikes 40, and the guides 14). Further, in the ink jet head 210 shown in FIG. 10A, in addition to or instead of the DLC layer 238 on the upper surfaces of the head substrate 212 and the ink guides 214, a DLC layer may be provided on the surface on the ink droplet ejection side of the ejection port substrate 216.

What is claimed is:

1. An ink jet head for ejecting ink droplets toward a recording medium, comprising:

an ejection port substrate in which ejection ports from which ink droplets are ejected are opened; and ejecting means for ejecting the ink droplets from said ejection ports of said ejection port substrate toward the recording medium, respectively, wherein a surface of said ejection port substrate on a side from which the ink droplets are ejected is coated with a diamond like carbon layer.

2. The ink jet head according to claim 1, wherein said diamond like carbon layer contains fluorine.

3. The ink jet head according to claim 1, wherein said ejecting means comprises:

ejection electrodes, each formed so as to surround an ejection port on a surface opposite to the side of said ejection port substrate from which the ink droplets are ejected; and ink guides, each for forming a meniscus of the ink at a tip end thereof, in which said tip end is provided to penetrate said ejection port so as to protrude from the surface of said ejection port substrate on the side from which the ink droplets are ejected, wherein the ink droplet is ejected from said tip end of said ink guide by using an electrostatic force exerted onto the meniscus by a voltage application to said ejection electrode.

4. The ink jet head according to claim 3, wherein said ink guides are coated with a protective layer, respectively.

5. The ink jet head according to claim 4, wherein said protective layer is composed substantially of diamond like carbon.

6. An ink jet recording apparatus, comprising:

an ink jet head having ejecting means for ejecting ink droplets toward a recording medium and an ejection port substrate in which ejection ports from which ink droplets are ejected are opened, in which a surface of said ejection port substrate on a side from which the ink droplets are ejected is coated with a diamond like carbon layer; and moving means for moving at least one of said ink jet head and said recording medium so that said recording medium can move relatively to said ink jet head, wherein an image corresponding to image data is recorded on said recording medium by means of said ink jet head.

7. An ink jet head for ejecting ink as ink droplets by exerting an electrostatic force onto the ink, comprising:

a head substrate in which resin-made ink guides are formed, each ink guide for forming a meniscus of the ink; and ejection electrodes, each for forming an electric field on a tip end of said ink guide, wherein said ink guide is coated with a protective layer, and wherein said protective layer is composed substantially of diamond like carbon.

8. The ink jet head according to claim 7, wherein a thickness of said protective layer is within a range of from 0.1 μm to 5 μm.

9. The ink jet head according to claim 7, further comprising: an ejection port substrate that is disposed opposite to said head substrate and in which ejection ports for ejecting the ink droplets are opened, wherein said tip end of each ink guide is inserted into each ejection port.

10. The ink jet head according to claim 9, wherein a surface of said ejection port substrate on a side from which the ink droplet is ejected is coated with a diamond like carbon layer.

11. The ink jet head according to claim 7, wherein said ejection electrode is disposed so as to surround said ejection port on a surface of said ejection port substrate on a side opposite to said head substrate.

12. The ink jet head according to claim 7, wherein said diamond like carbon layer contains fluorine.

* * * * *